US010856608B2

(12) United States Patent
Hoffer et al.

(10) Patent No.: US 10,856,608 B2
(45) Date of Patent: Dec. 8, 2020

(54) SOLE SYSTEM HAVING MOVABLE PROTRUDING MEMBERS

(71) Applicant: NIKE, Inc., Beaverton, OR (US)

(72) Inventors: Kevin W. Hoffer, Portland, OR (US); Elizabeth Langvin, Sherwood, OR (US); James C. Meschter, Portland, OR (US); Tetsuya T. Minami, Portland, OR (US); Jeff Rasmussen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 2 days.

(21) Appl. No.: 16/204,236

(22) Filed: Nov. 29, 2018

(65) Prior Publication Data

US 2019/0090584 A1 Mar. 28, 2019

Related U.S. Application Data

(60) Division of application No. 15/271,796, filed on Sep. 21, 2016, now Pat. No. 10,172,417, which is a (Continued)

(51) Int. Cl.
*A43B 13/18* (2006.01)
*A43B 13/14* (2006.01)
(Continued)

(52) U.S. Cl.
CPC ..... *A43B 13/184* (2013.01); *A43B 7/146* (2013.01); *A43B 13/122* (2013.01);
(Continued)

(58) Field of Classification Search
CPC ..... A43B 13/18; A43B 13/184–186; A43B 13/188; A43B 13/122; A43B 13/141; A43B 13/223; A43B 13/26; A43C 15/14
(Continued)

(56) References Cited

U.S. PATENT DOCUMENTS

D15,185 S 8/1884 Brooks
2,061,962 A 11/1936 Carlo
(Continued)

FOREIGN PATENT DOCUMENTS

CA 2052070 1/1993
CN 102164518 8/2011
(Continued)

OTHER PUBLICATIONS

International Search Report and Written Opinion for Application No. PCT/US2015/042822, dated Oct. 21, 2015; 15 pages.
(Continued)

*Primary Examiner* — Ted Kavanaugh
(74) *Attorney, Agent, or Firm* — Klarquist Sparkman, LLP

(57) ABSTRACT

An article of footwear with a sole system includes a sole member and a protruding member assembly. The sole system provides tactile sensation. Protruding members of the protruding member assembly can translate through holes in the sole member to facilitate tactile sensation. Some embodiments can include an inner member that is configured to accommodate the movement of a protruding member. Other embodiments can include a plurality of recessed portions or nub portions formed along an outwardly facing surface of the sole member.

18 Claims, 36 Drawing Sheets

Related U.S. Application Data division of application No. 14/995,891, filed on Jan. 14, 2016, now Pat. No. 9,516,917, which is a continuation-in-part of application No. 14/156,491, filed on Jan. 16, 2014, now Pat. No. 9,516,918.

(51) Int. Cl.

| | |
|---|---|
| ***A43B 13/22*** | (2006.01) |
| ***A43B 13/26*** | (2006.01) |
| ***A43C 15/14*** | (2006.01) |
| ***A43B 7/14*** | (2006.01) |
| ***A43B 13/12*** | (2006.01) |

(52) U.S. Cl.

CPC ..... *A43B 13/141* (2013.01); *A43B 13/18* (2013.01); *A43B 13/185* (2013.01); *A43B 13/186* (2013.01); *A43B 13/188* (2013.01); *A43B 13/223* (2013.01); *A43B 13/26* (2013.01); *A43C 15/14* (2013.01)

(58) Field of Classification Search

USPC ..... 36/59 R, 59 C, 61

See application file for complete search history.

(56) References Cited

U.S. PATENT DOCUMENTS

| | | | | |
|---|---|---|---|---|
| 2,327,360 | A | 11/1939 | Meyer | |
| 2,330,317 | A | 9/1943 | Stewart | |
| 2,853,809 | A | 10/1957 | Bianchi | |
| 3,191,321 | A | 6/1965 | Bruiting | |
| 3,204,347 | A | 9/1965 | Snow | |
| 3,328,901 | A | 7/1967 | Strickland | |
| 3,626,611 | A | 12/1971 | Bernier et al. | |
| 3,718,996 | A | 3/1973 | Austin | |
| 3,722,113 | A | 3/1973 | Birkenstock | |
| 3,757,774 | A | 9/1973 | Hatuno | |
| 3,834,046 | A | 9/1974 | Fowler | |
| 4,063,371 | A * | 12/1977 | Batra | A43B 13/223 36/3 B |
| 4,067,123 | A | 1/1978 | Minihane | |
| 4,085,526 | A | 4/1978 | Hemmer | |
| 4,715,133 | A | 12/1987 | Hartjes et al. | |
| 4,747,220 | A | 5/1988 | Autry et al. | |
| 4,782,604 | A | 11/1988 | Wen-Shown | |
| 4,798,009 | A | 1/1989 | Colonel et al. | |
| 4,811,501 | A | 3/1989 | Okayasu | |
| 4,823,799 | A | 4/1989 | Robbins | |
| 5,077,916 | A | 1/1992 | Beneteau | |
| 5,367,791 | A | 11/1994 | Gross et al. | |
| 5,595,003 | A | 1/1997 | Snow | |
| 5,607,749 | A | 3/1997 | Strumor | |
| 5,768,802 | A | 6/1998 | Bramani | |
| 5,775,005 | A * | 7/1998 | McClelland | A43B 1/0072 36/134 |
| 5,915,819 | A | 6/1999 | Gooding | |
| 5,946,825 | A | 9/1999 | Koh et al. | |
| 5,987,781 | A | 11/1999 | Pavesi et al. | |
| 6,029,377 | A * | 2/2000 | Niikura | A43B 13/223 36/59 C |
| 6,082,024 | A | 7/2000 | Del Biondi | |
| 6,138,281 | A | 10/2000 | Chiaruttini | |
| 6,161,315 | A * | 12/2000 | Dalton | A43B 5/001 36/134 |
| 6,275,997 | B1 | 8/2001 | Richardson | |
| 6,516,540 | B2 | 2/2003 | Seydel et al. | |
| 6,523,282 | B1 | 2/2003 | Johnston | |
| 6,691,432 | B2 | 2/2004 | Masseron | |
| 6,715,221 | B1 | 4/2004 | Sasaki | |
| 6,732,457 | B2 | 5/2004 | Gardiner | |
| 7,013,588 | B2 | 3/2006 | Chang | |
| 7,089,690 | B2 | 8/2006 | Krstic | |
| 7,140,129 | B2 | 11/2006 | Newson et al. | |
| 7,264,599 | B1 | 9/2007 | Milligan | |
| 7,290,357 | B2 | 11/2007 | McDonald et al. | |
| 7,346,936 | B2 | 3/2008 | Vargas et al. | |
| 7,451,557 | B2 | 11/2008 | McDonald et al. | |
| 7,523,566 | B2 | 4/2009 | Young-Chul | |
| 7,665,229 | B2 | 2/2010 | Kilgore et al. | |
| 7,752,772 | B2 | 7/2010 | Hatfield et al. | |
| 7,849,609 | B2 | 12/2010 | Edington et al. | |
| 7,913,420 | B2 | 3/2011 | Arizumi | |
| 7,918,811 | B2 | 4/2011 | Lussier et al. | |
| 7,941,943 | B2 | 5/2011 | Baker et al. | |
| 8,006,411 | B2 | 8/2011 | Manz et al. | |
| 8,162,860 | B1 | 4/2012 | Ali | |
| 8,215,032 | B2 | 7/2012 | Sokolowski et al. | |
| 8,256,145 | B2 | 9/2012 | Baucom et al. | |
| 8,333,022 | B2 | 12/2012 | Crowley, II et al. | |
| 8,387,281 | B2 | 3/2013 | Loverin et al. | |
| D684,756 | S | 6/2013 | Denis | |
| 8,661,712 | B2 | 3/2014 | Aveni et al. | |
| 8,950,087 | B2 | 2/2015 | Baucom et al. | |
| 9,516,917 | B2 | 12/2016 | Hoffer et al. | |
| 9,516,918 | B2 | 12/2016 | Meschter et al. | |
| 10,285,468 | B2 | 5/2019 | Van Atta et al. | |
| 2002/0184793 | A1 | 12/2002 | Sato | |
| 2005/0188562 | A1 | 9/2005 | Clarke et al. | |
| 2005/0241189 | A1 | 11/2005 | Elkington et al. | |
| 2006/0000119 | A1 | 1/2006 | Endo | |
| 2006/0048413 | A1 | 3/2006 | Sokolowski et al. | |
| 2007/0113425 | A1 | 5/2007 | Wakley et al. | |
| 2007/0180730 | A1 | 8/2007 | Greene | |
| 2008/0078106 | A1 | 4/2008 | Montgomery | |
| 2009/0056172 | A1 | 3/2009 | Cho | |
| 2009/0083993 | A1 | 4/2009 | Plank | |
| 2010/0011620 | A1 | 1/2010 | Nakano | |
| 2010/0077635 | A1 | 4/2010 | Baucom et al. | |
| 2010/0175276 | A1 | 7/2010 | Dojan et al. | |
| 2011/0088287 | A1 | 4/2011 | Auger et al. | |
| 2011/0192056 | A1* | 8/2011 | Geser | A43B 13/26 36/114 |
| 2011/0247243 | A1* | 10/2011 | Eder | A43B 13/26 36/67 A |
| 2011/0252671 | A1 | 10/2011 | Maron et al. | |
| 2011/0277346 | A1 | 11/2011 | Peyton et al. | |
| 2012/0023777 | A1 | 2/2012 | Greene | |
| 2012/0023786 | A1 | 2/2012 | Dojan | |
| 2012/0055047 | A1 | 3/2012 | Youngs | |
| 2012/0167414 | A1 | 7/2012 | Shrairman | |
| 2012/0240432 | A1 | 9/2012 | Lambertz | |
| 2012/0291315 | A1 | 11/2012 | Baucom | |
| 2012/0317843 | A1 | 12/2012 | Bove | |
| 2013/0152424 | A1 | 6/2013 | Dojan | |
| 2015/0366281 | A1 | 12/2015 | Miller et al. | |
| 2016/0095389 | A1 | 4/2016 | Minami et al. | |
| 2016/0302523 | A1 | 10/2016 | Fujita et al. | |
| 2016/0360829 | A1 | 12/2016 | Meschter et al. | |

FOREIGN PATENT DOCUMENTS

| | | |
|---|---|---|
| DE | 8304272 | 10/1983 |
| DE | 3520956 | 1/1987 |
| DE | 202010017958 | 6/2013 |
| EP | 1557105 | 7/2005 |
| EP | 2494879 | 9/2012 |
| EP | 2594146 | 5/2013 |
| JP | 5-115308 | 1/2013 |
| SU | 971240 | 11/1982 |
| WO | WO 1993/005674 | 4/1993 |
| WO | WO 2004/014171 | 2/2004 |
| WO | WO 2007/087581 | 8/2007 |
| WO | WO 2015/108593 | 7/2015 |
| WO | WO 2015/108594 | 7/2015 |
| WO | WO 2016/085553 | 6/2016 |

OTHER PUBLICATIONS

International Search Report and Written Opinion of the International Searching Authority, for Application No. PCT/US2015/047956, dated Nov. 30, 2015; 14 pages.

(56) References Cited

OTHER PUBLICATIONS

International Search Report and Written Opinion for Application No. PCT/US2014/062104, dated Jan. 29, 2015.
International Search Report and Written Opinion for Application No. PCT/US2015/042822, dated Oct. 21, 2015.
Office Action, dated May 2, 2017, for corresponding Chinese Patent Application No. 201480077128.6, 8 pages. No English translation provided.
Response to Rules 161 and 162 EPC Communication, filed Mar. 13, 2017, in corresponding European Patent Application No. 14806112.0, 9 pages.

* cited by examiner

SOLE SYSTEM HAVING MOVABLE PROTRUDING MEMBERS

CROSS REFERENCE TO RELATED APPLICATIONS

This application is a divisional of U.S. patent application Ser. No. 15/271,796, filed Sep. 21, 2016, which is a divisional of U.S. patent application Ser. No. 14/995,891, filed Jan. 14, 2016, now U.S. Pat. No. 9,516,917, which is a continuation-in-part of U.S. patent application Ser. No. 14/156,491, filed Jan. 16, 2014, now U.S. Pat. No. 9,516,918, all of which are incorporated by reference herein in their entirety.

BACKGROUND

The present embodiments relate to articles of footwear and in particular to a sole system for articles of footwear.

Athletic shoes often have two major components, an upper that provides the enclosure for receiving the foot, and a sole secured to the upper. The upper may be adjustable using laces, hook-and-loop fasteners or other devices to secure the shoe properly to the foot. The sole has the primary contact with the playing surface. The sole may be designed to absorb the shock as the shoe contacts the ground or other surfaces. The upper may be designed to provide the appropriate type of protection to the foot and to maximize the wearer's comfort.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
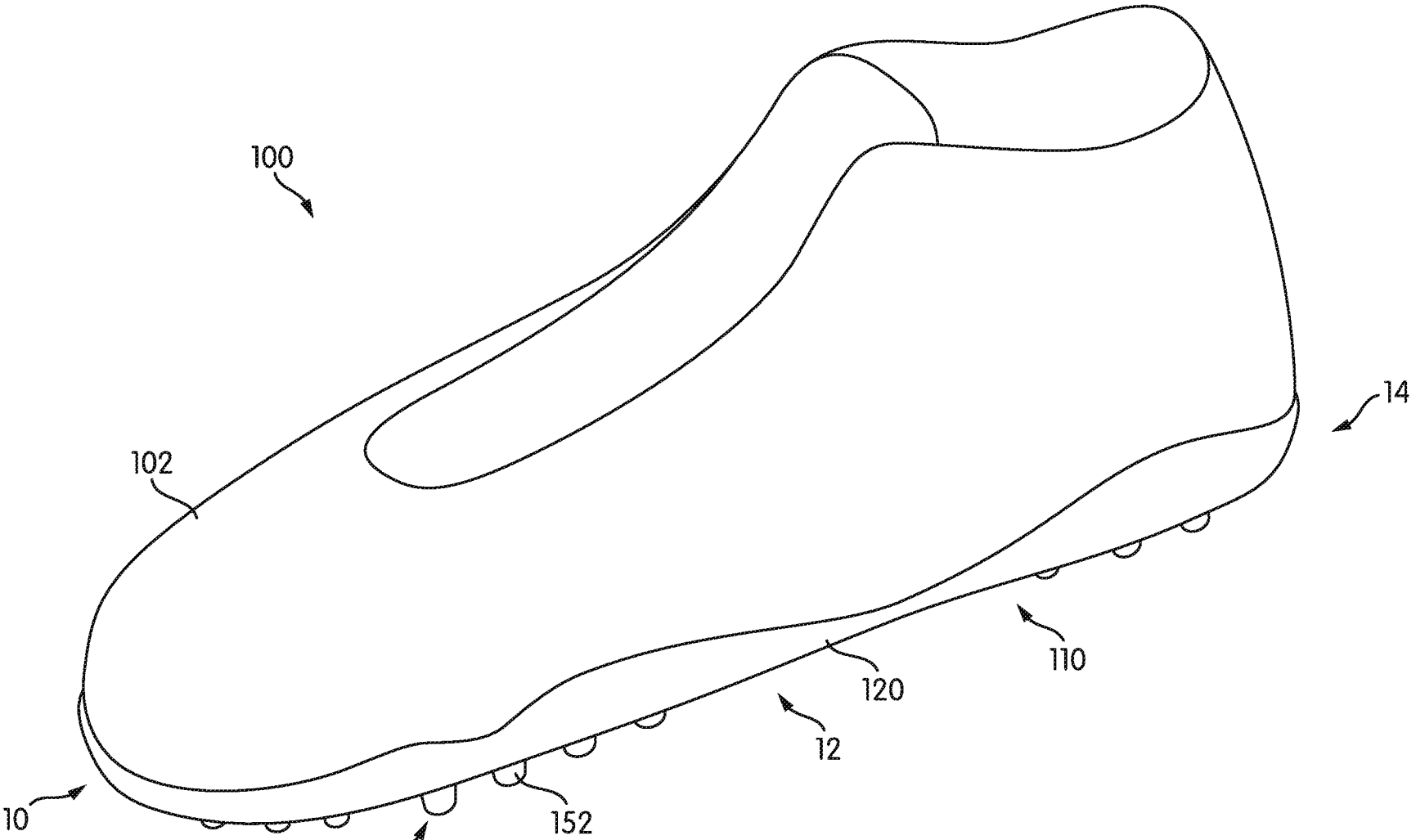
FIG. 1 is an isometric view of an embodiment of an article of footwear.

In one embodiment, an article of footwear includes a sole member a sole member having an outwardly facing surface and an inwardly facing surface disposed opposite the outwardly facing surface. The article of footwear also includes a protruding member assembly positioned proximal to the inwardly facing surface of the sole member. The outwardly facing surface of the sole member comprises a base portion and a plurality of raised portions, where the plurality of raised portions include a first raised portion, and where the base portion extends outwardly a first distance from the inwardly facing surface of the sole member. Furthermore, the first raised portion extends outwardly a second distance from the inwardly facing surface of the sole member, where the second distance is greater than the first distance. The sole member also includes a first hole and a second hole, and the protruding member assembly includes a first protruding member and a second protruding member. In addition, the first protruding member extends outward through the first hole and the second protruding member extends outward through the second hole, where the first protruding member includes a proximal end portion and a distal end portion positioned outward from the proximal end portion. The distal end portion extends outwardly a third distance from the inwardly facing surface of the sole member, where the third distance is at least as great as the second distance.

In another embodiment, an article of footwear includes a sole member having an outwardly facing surface and an inwardly facing surface disposed opposite the outwardly facing surface and a protruding member assembly including a plurality of protruding members connected together by a plurality of connecting portions. The article of footwear also includes an inner member (e.g., an insole, etc.) having a proximal side and a distal side disposed opposite the proximal side, where the protruding member assembly is positioned between the sole member and the inner member. In addition, each of the plurality of protruding members includes a proximal end portion and a distal end portion, and the sole member includes a plurality of holes that receive the plurality of protruding members such that the distal end portion of each of the plurality of protruding members extends away from the outwardly facing surface. The plurality of protruding members include a first protruding member that extends through a first hole in the sole member, and the first protruding member extends from the outwardly facing surface of the sole member a first distance when the first protruding member is compressed inward with a first degree compression. Furthermore, the first protruding member extends from the outwardly facing surface of the sole member a second distance less than the first distance when the first protruding member is compressed inward with a second degree of compression greater than the first degree of compression.

In another embodiment, an article of footwear includes a sole member having an outwardly facing surface and an inwardly facing surface disposed opposite the outwardly facing surface, an inner member having a proximal side and a distal side disposed opposite the proximal side, and a plurality of protruding members. The outwardly facing surface of the sole member comprises a base portion and a plurality of raised portions, where each of the plurality of raised portions extend a greater distance away from the inwardly facing surface of the sole member than the base portion. In addition, the sole member includes a plurality of holes in the base portion, where each of the plurality of holes is a through-hole that extends from the inwardly facing surface of the sole member to the outwardly facing surface of the sole member, and the plurality of holes include a first hole. The plurality of protruding members include a first protruding member having a proximal end portion, an intermediate portion, and a distal end portion, where the proximal end portion is disposed between the distal side of the inner member and the inwardly facing surface of the sole member, the intermediate portion is disposed at least partially within the first hole of the sole member, and the distal end portion provides a ground-contacting surface of the first protruding member.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

FIG. 1 is an isometric view of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

In some embodiments, article of footwear 100 may include upper 102 and sole system 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper. In some embodiments, upper 102 could further include provisions for fastening article 100 to a foot, such as a lacing system (not shown) and may include still other provisions found in footwear uppers.

Sole system 110 is secured to upper 102 and extends between the foot and the ground when article 100 is worn. In different embodiments, sole system 110 may include different components. For example, sole system 110 may include an outsole, a midsole, and/or an insole. In some cases, one or more of these components may be optional.

Sole system 110 may provide one or more functions for article 100. For example, in some embodiments, sole system 110 may be configured to provide traction for article 100. In addition to providing traction, sole system 110 may attenuate ground reaction forces when compressed between the foot and the ground during walking, running or other ambulatory activities. The configuration of sole system 110 may vary significantly in different embodiments to include a variety of conventional or non-conventional structures. In some cases, the configuration of sole system 110 can be selected according to one or more types of ground surfaces on which sole system 110 may be used. Examples of ground surfaces include, but are not limited to: natural turf, synthetic turf, dirt, as well as other surfaces.

As described in further detail below, in some embodiments, sole system 110 may also include provisions to enhance tactile sensation at the sole of the foot. For example, sole system 110 can include features that provide a tactile response to variations in a ground surface.

Figure 2:
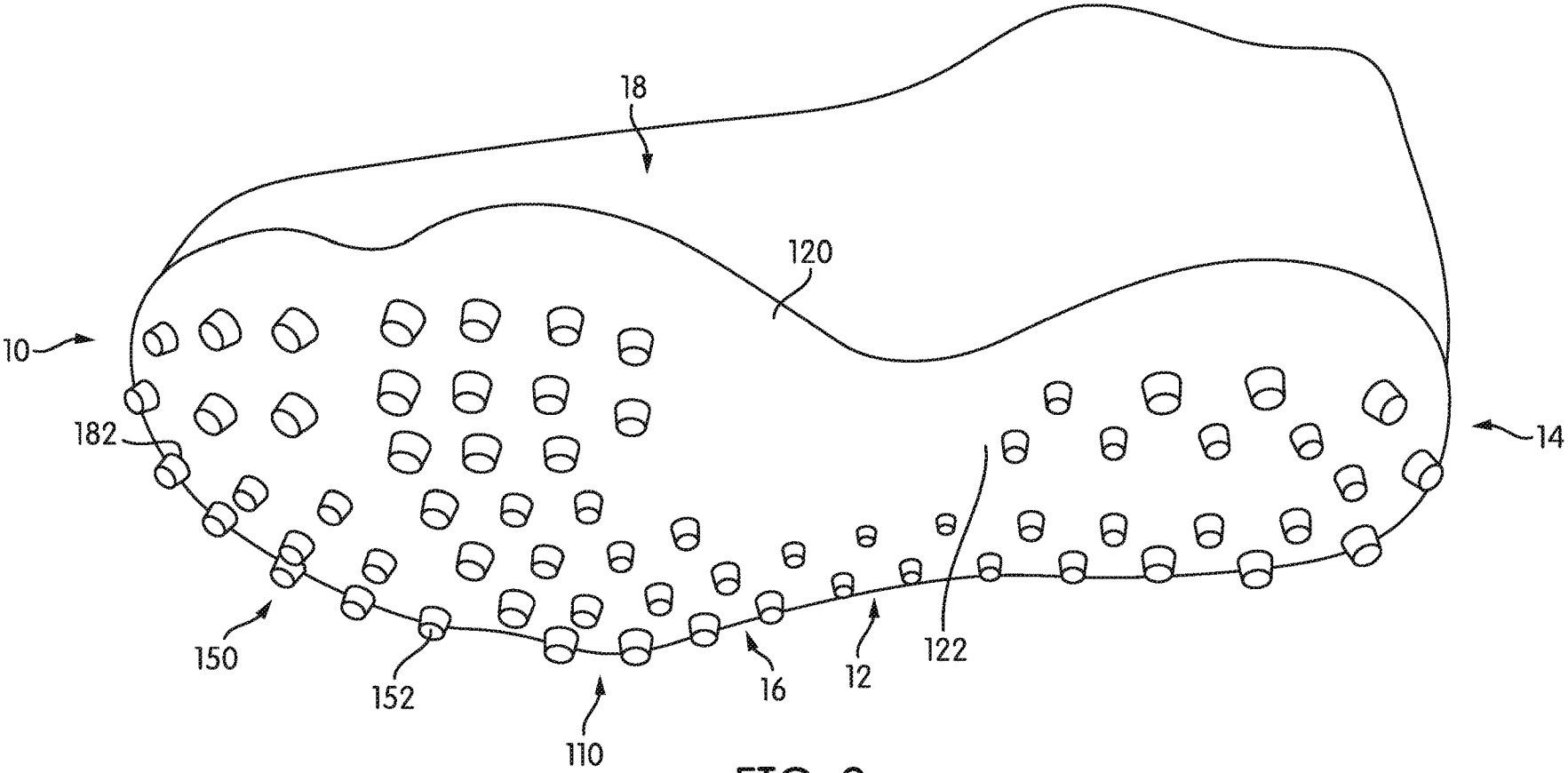
FIG. 2 is a bottom isometric view of an embodiment of an article of footwear, in which a sole system of the article is visible.

Referring to FIG. 1, for purposes of reference, sole system 110 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, sole system 110 may include lateral side 16 and medial side 18 (see FIG. 2). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of sole system 110. Likewise, lateral side 16 and medial side 18 are intended to represent generally two sides of sole system 110, rather than precisely demarcating system 110 into two halves.

For consistency and convenience, directional adjectives are employed throughout this detailed description corresponding to the illustrated embodiments. The term "longitudinal" as used throughout this detailed description and in the claims refers to a direction extending a length of a component. For example, the longitudinal direction of sole system 110 may extend from forefoot portion 10 to heel portion 14 of sole system 110. Also, the term "lateral" as used throughout this detailed description and in the claims refers to a direction extending along a width of a component. For example, the lateral direction of sole system 110 may extend between medial side 18 and lateral side 16 of sole system 110. Additionally, the term "vertical" as used throughout this detailed description and in the claims refers to a direction that is perpendicular to both the longitudinal and lateral directions. For example, the vertical direction of sole system 110 may extend through the thickness of sole system 110.

In addition, the term "proximal" refers to a portion of a footwear component that is closer to a portion of a foot when an article of footwear is worn. Likewise, the term proximal direction refers to a direction oriented towards a foot when an article is word. The term "distal" refers to a portion of a footwear component that is further from a portion of a foot when an article of footwear is worn. The distal direction refers to a direction oriented away from a foot when an article is worn.

In some embodiments, sole system 110 may further include a sole member 120 and a protruding member assembly 150. In some embodiments, protruding member assembly 150 may comprise a plurality of protruding portions 152, as well as a plurality of connecting portions (not shown in FIG. 1). In some embodiments, sole member 120 may be adapted to receive protruding member assembly 150, as described in further detail below.

Figure 3:
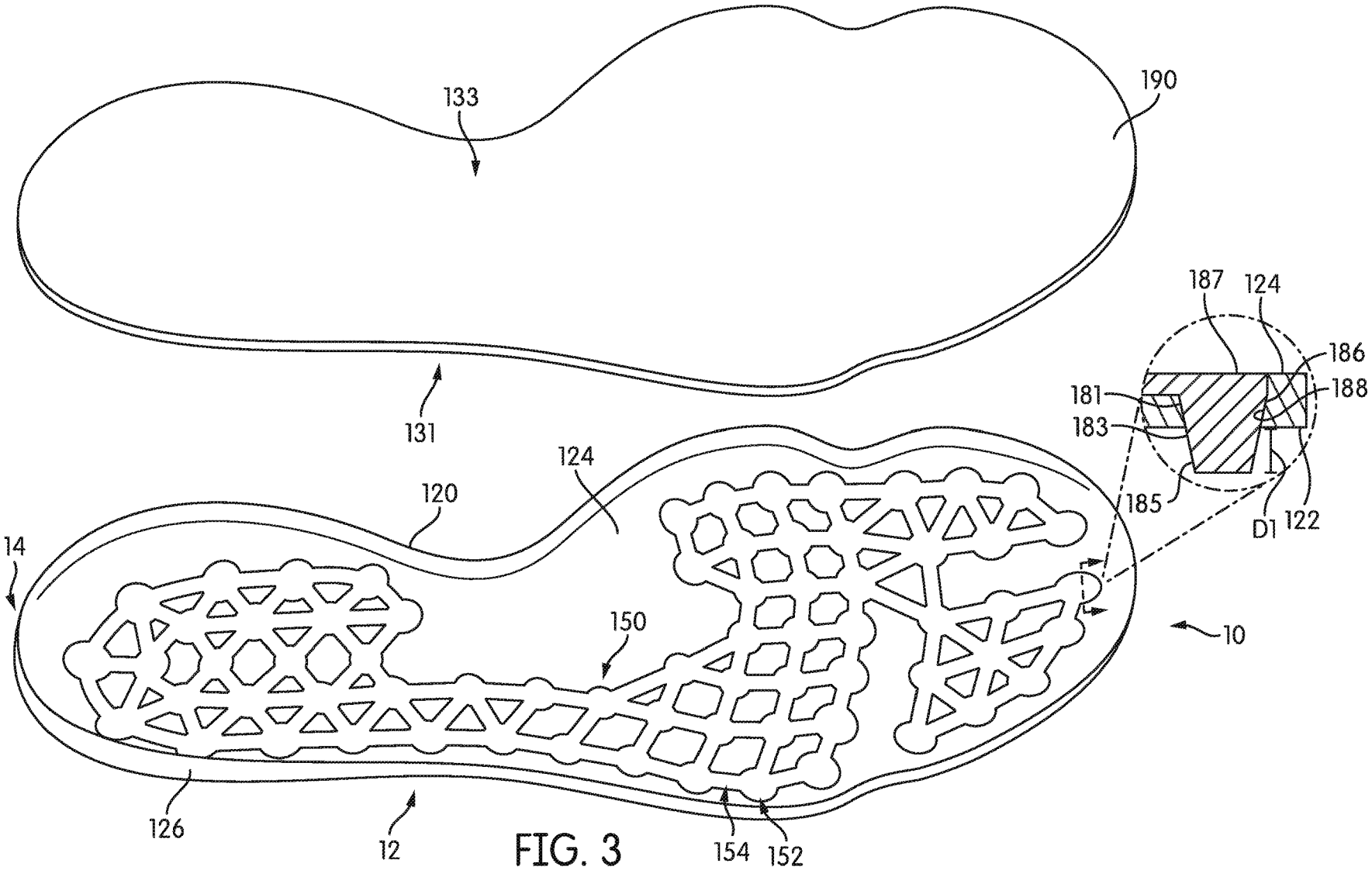
FIG. 3 is an isometric view of an embodiment of a sole member and an inner member.
Figure 22:
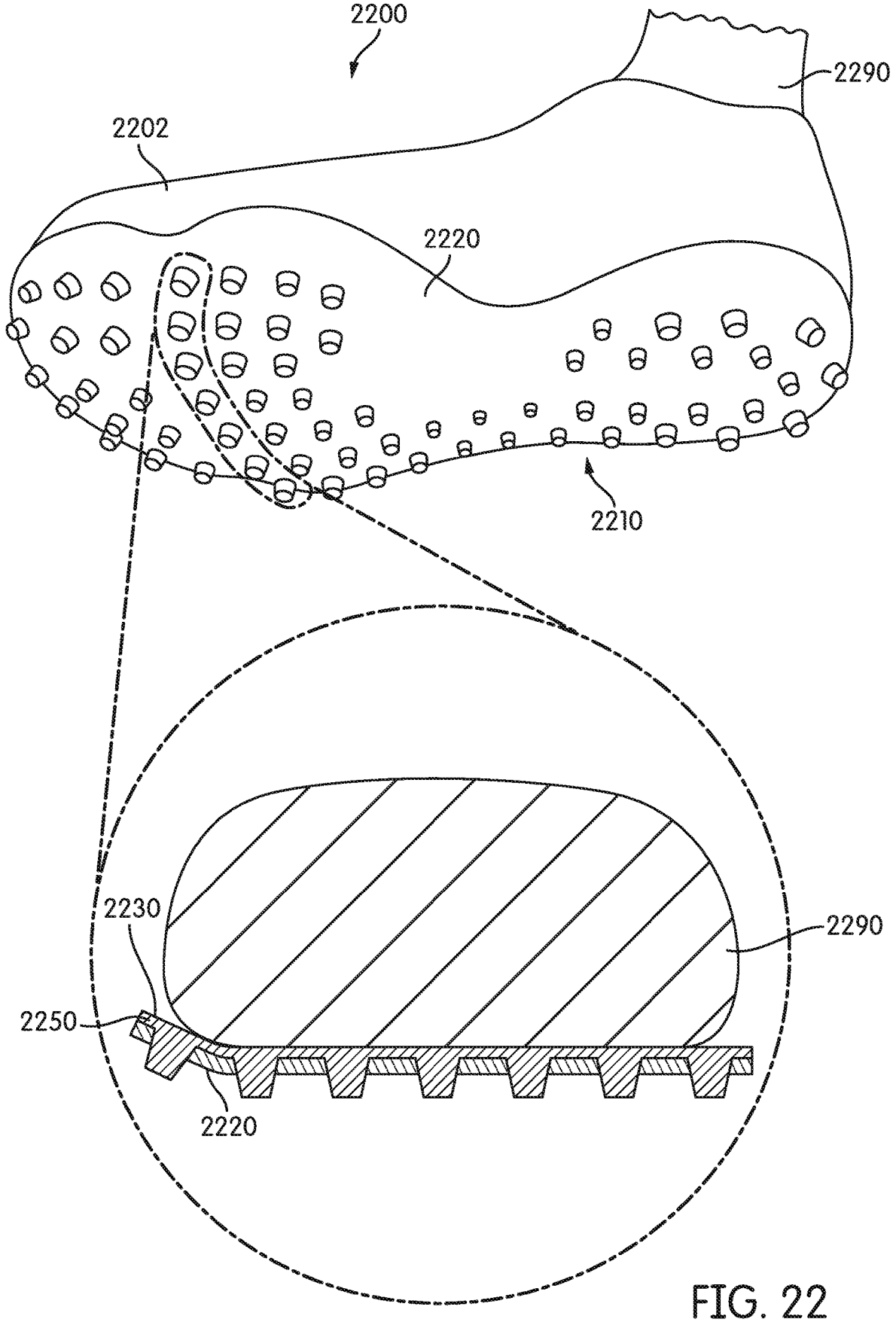
FIG. 22 is an isometric view of another embodiment of a sole system, in which a protruding member assembly may be disposed directly against a foot.

FIGS. 2 through 6 illustrate various views of an embodiment of some possible components of sole system 110. These components may include sole member 120 and protruding member assembly 150. In some embodiments, sole system 110 may optionally include an inner member 190, which is shown in FIG. 3. For purposes of illustration, inner member 190 is not shown in all of the figures. FIG. 22, which is described in further detail below, depicts an alternative embodiment in which a protruding member assembly 150 may be configured to contact a foot directly.

In different embodiments, inner member 190 could be configured as a variety of different footwear components including, but not limited to: an insole or a sockliner. Thus, inner member 190 may be configured to provide enhanced support for a foot as well as increased cushioning and comfort. In some embodiments, inner member 190 may be primarily associated with sole system 110 (e.g., inner member 190 may be an insole). In other embodiments, inner member 190 may be primarily associated with upper 102 (e.g., inner member 190 may be a part of a sockliner). In some embodiments, inner member 190 could comprise all or part of a slip last or strobel.

In some embodiments, inner member 190 may be a full length member, which extends from a forefoot portion 10 to a heel portion 14 of sole system 110. In other embodiments, however, inner member 190 could be a partial length member that extends through some portions of sole system 110, but not others. As one example, in another embodiment, inner member 190 could extend through only forefoot portion 10. In another embodiment, inner member 190 could extend through only heel portion 14.

When used, inner member 190 may be disposed between a foot and other components of sole system 110, including both sole member 120 and protruding member assembly 150. In some embodiments, for example, a first surface 131 of inner member 190 confronts sole member 120 and protruding member assembly 150 while a second surface 133 of inner member 190 faces towards a foot and/or additional layers such as a strobel or other liner. In some cases, second surface 133 may directly contact a foot during use.

In some embodiments, sole member 120 may be configured as a midsole and/or outsole of sole system 110. In the exemplary embodiment, sole member 120 comprises a monolithic or unitary structure that provides support and strength, as well as a durable outer ground engaging surface for sole system 110. Optionally, in other embodiments, sole member 120 could comprise a separate midsole and outsole. As an example, in another embodiment, sole member 120 could be further covered on a lower surface by a separate outsole, which further includes holes to receive protruding members.

In some embodiments, sole member 120 may be characterized as having an outwardly facing surface 122 (as shown, for example, in FIG. 2) and an inwardly facing surface 124 (as shown, for example, in FIG. 3) that is disposed opposite of outwardly facing surface 122. Outwardly facing surface 122 may be a ground facing, or ground engaging, surface. In contrast, inwardly facing surface 124 may be disposed closer to a foot than outwardly facing surface 122. Inwardly facing surface 124, in some embodiments, may confront inner member 190. It will be understood that outwardly facing surface 122 and inwardly facing surface 124 may optionally be characterized as a distal surface and a proximal surface, respectively. In addition, sole member 120 includes a sidewall surface 126 that extends between outwardly facing surface 122 and inwardly facing surface 124, which is oriented approximately in the vertical direction.

In some embodiments, protruding member assembly 150 may comprise plurality of protruding members 152 that are connected to one another by a plurality of connecting portions 154. As used throughout this detailed description and in the claims, the term "protruding member" refers to any component or structure that can protrude outwardly from a surface of a sole system. In some embodiments, a protruding member may be a cleat member or other traction element that is configured to engage a ground surface and provide increased traction between sole member 120 and a ground surface. However, in other embodiments a protruding member may not be configured to facilitate ground engagement and/or traction. Instead, it is possible that in some embodiments a protruding member may be primarily utilized to enhance tactile sensation, as discussed in further detail below. In an exemplary embodiment, each protruding member of plurality of protruding members 152 may be configured as a cleat member that improves traction and also facilitates enhanced tactility and sensation on the bottom of the foot.

Figure 5:
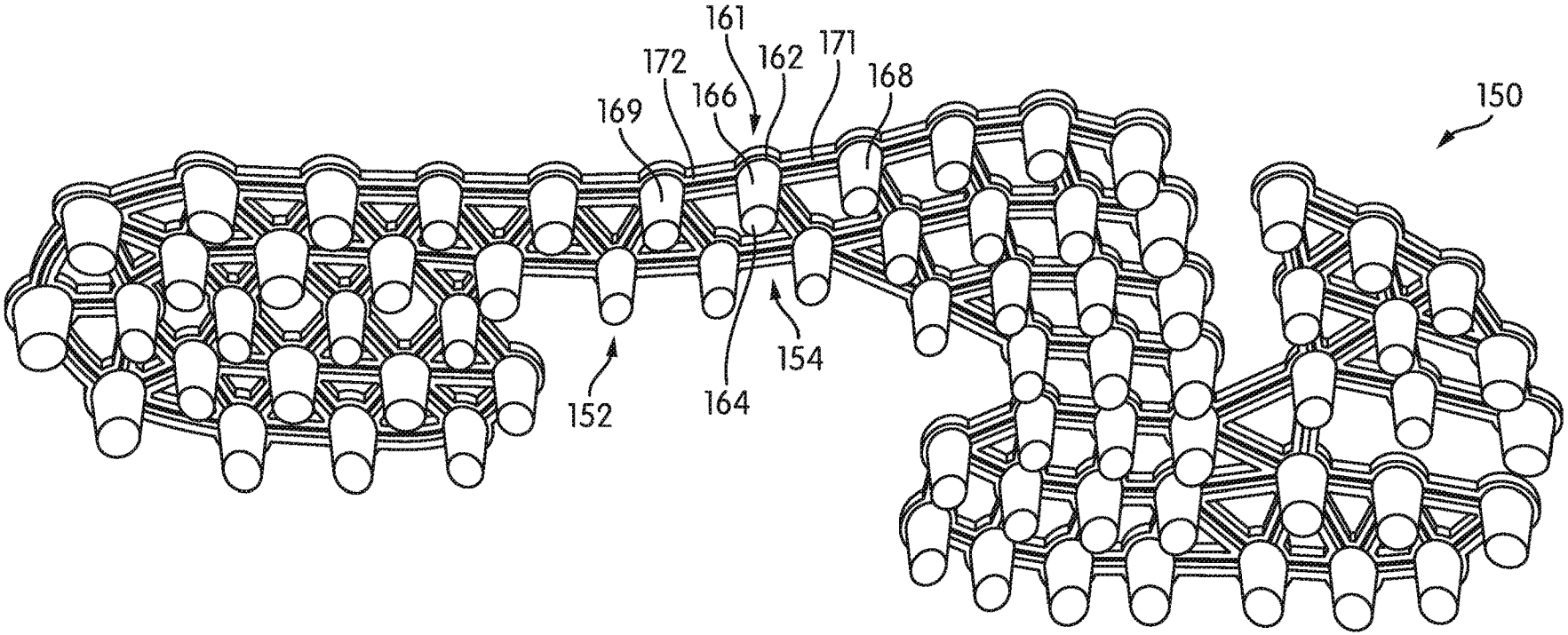
FIG. 5 is a bottom isometric view of an embodiment of a protruding member assembly.

Each protruding member may be characterized as having a first end portion (or proximal portion), a second end portion (or distal portion) and an intermediate portion. For example, as indicated in FIG. 5, a first protruding member 161 of plurality of protruding members 152 may have a proximal end portion 162, a distal end portion 164 and an intermediate portion 166 that is disposed between proximal end portion 162 and distal end portion 164. In some embodiments, a distal end portion of each protruding member may be configured to contact a ground surface. As an example, distal end portion 164 of first protruding member 161 may be configured to contact a ground surface. Thus, in some cases, distal end portion 164 may function as a cleat tip. In contrast, a proximal end portion of each protruding member can be in direct contact with a foot, or in indirect contact with a foot (e.g., via an inner member), thereby allowing the foot to interact with the protruding members in the manner discussed below. For example, in the exemplary embodiment, proximal end portion 162 of first protruding member 161 may be configured to interact with a foot.

In some embodiments, plurality of protruding members 152 may be connected to one another using plurality of connecting portions 154. More specifically, in some embodiments, protruding members that are directly adjacent may be connected by a connecting portion. For example, in the exemplary embodiment, first protruding member 161 and an adjacent second protruding member 168 are connected to one another by first connecting portion 171. Further, each protruding member of plurality of protruding members 152 may be connected to one or more protruding members that are directly adjacent to the protruding member. For example, first protruding member 161 is also connected to a third protruding member 169 by second connecting portion 172. This arrangement provides a matrix-like or web-like configuration for protruding member assembly 150.

Figure 6:
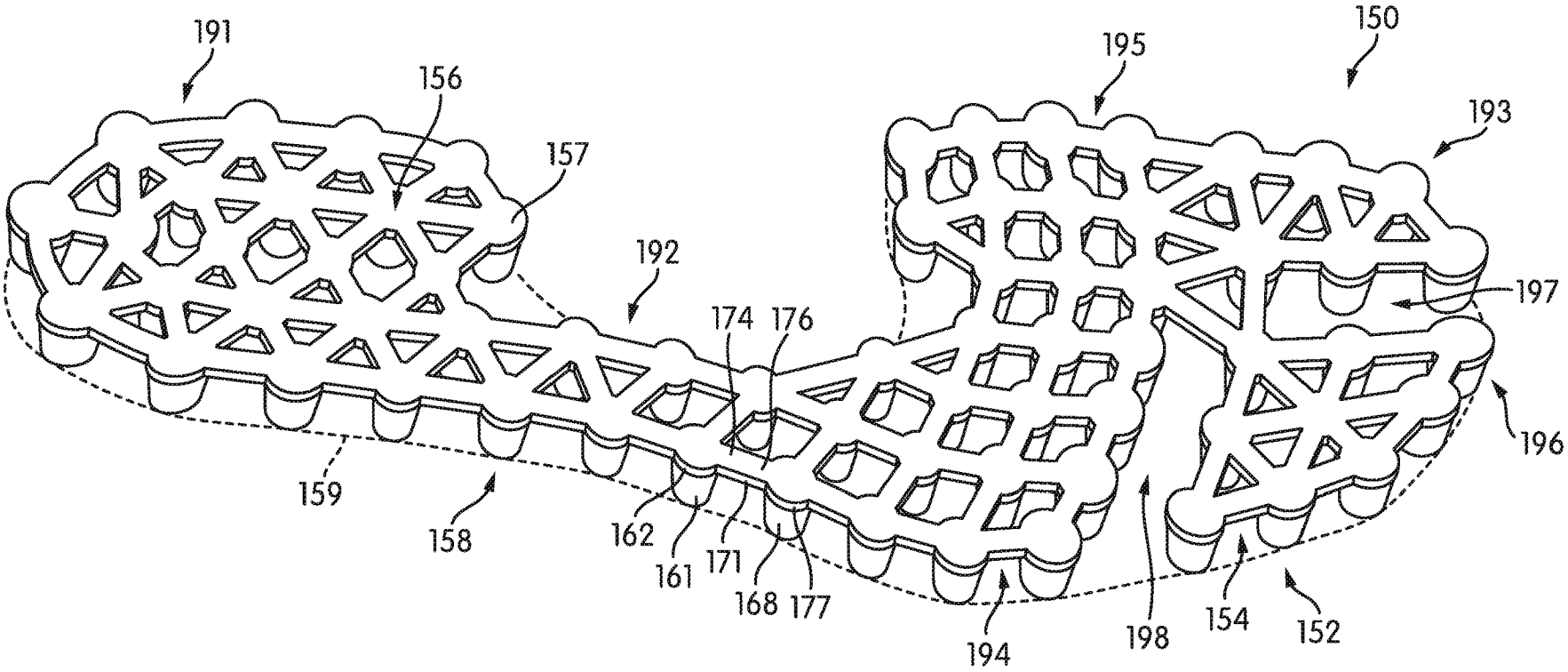
FIG. 6 is a top down isometric view of an embodiment of a protruding member assembly.

In some embodiments, plurality of connecting portions 154 may each include a first end portion and a second end portion. For example, as indicated in FIG. 6, first connecting portion 171 includes a first end portion 174 and a second end portion 176 that are connected to first protruding member 161 and second protruding member 168, respectively. In some embodiments, first end portion 174 and second end portion 176 connect to proximal end portion 162 of first protruding member 161 and proximal end portion 177 of second protruding member 168, respectively. Likewise, the remaining connecting portions of plurality of connecting portions 154 may also connect adjacent protruding members along their respective proximal end portions. In still other embodiments, however, adjacent protruding members could be connected to one another at their respective intermediate portions. Such a configuration is described below and shown in FIGS. 16-20. Of course, it is possible that in still other embodiments, adjacent protruding members could be connected to one another at their respective distal end portions. Moreover, it is also possible that in other embodiments protruding members could be connected at multiple portions simultaneously (e.g., connected along both the proximal portions and intermediate portions simultaneously).

Figure 4:
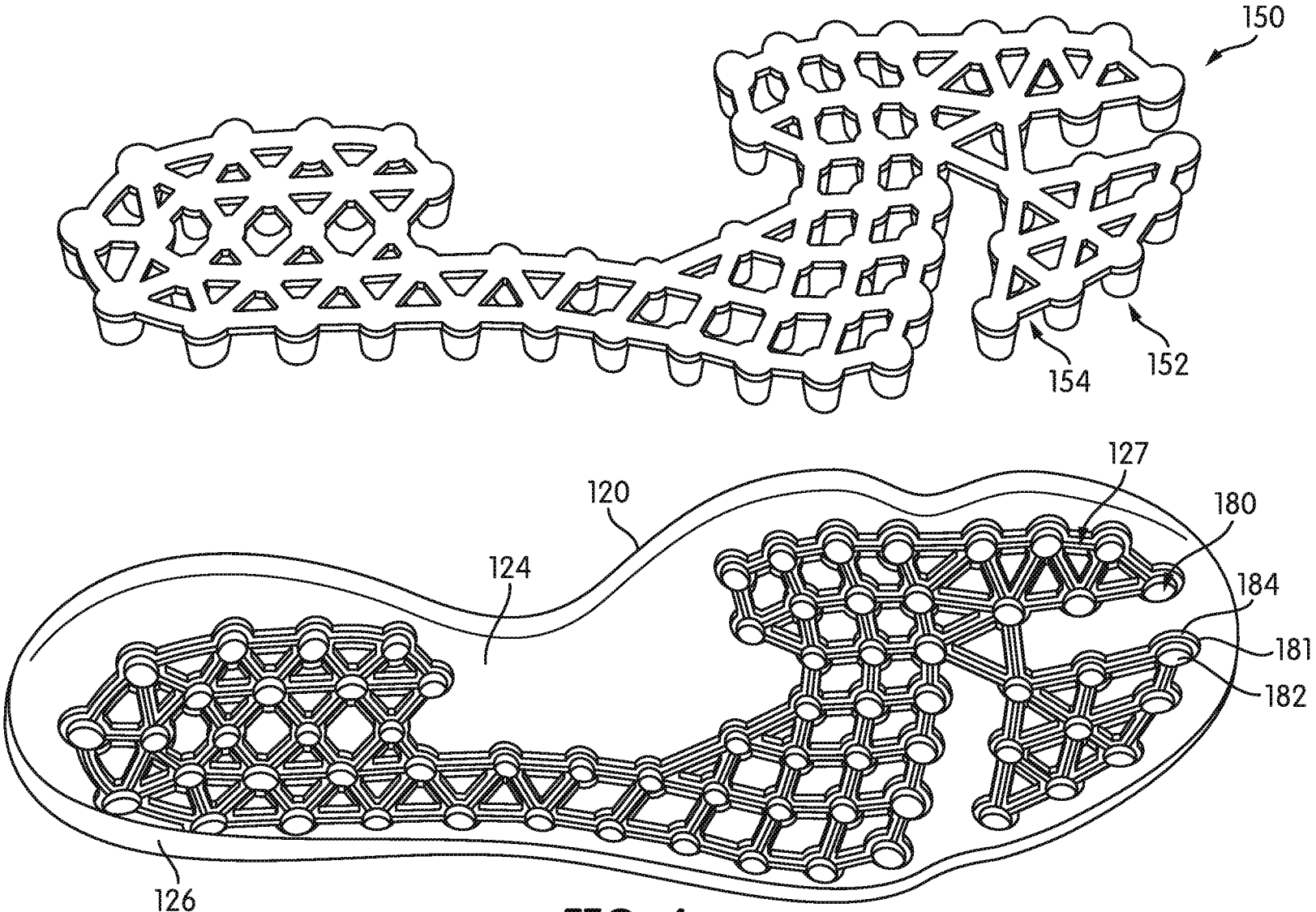
FIG. 4 is an isometric exploded view of an embodiment of a sole member and a corresponding protruding member assembly.

Referring now to FIG. 4, sole member 120 may include provisions to receive protruding member assembly 150. In some embodiments, sole member 120 includes a plurality of holes 180 that are configured to receive corresponding protruding members from plurality of protruding members 152. In some embodiments, plurality of holes 180 extend through the entire thickness of sole member 120. In other words, each hole of plurality of holes 180 extends from outwardly facing surface 122 to inwardly facing surface 124. As an example, a first hole 181 includes a first end 182 (see also FIG. 2) that is open on outwardly facing surface 122 and a second end 184 that is open on inwardly facing surface 124.

In order for protruding member assembly 150 to be assembled with sole member 120, plurality of holes 180 are arranged in a configuration on sole member 120 that corresponds to the arrangement of plurality of members 152 within protruding member assembly 150. In particular, plurality of holes 180 are in one-to-one correspondence with plurality of protruding members 152 so that each protruding member is received in a corresponding hole. Thus, the pattern or arrangement of plurality of holes 180 within sole member 120 is seen to match the pattern or arrangement of plurality of protruding members 152 within protruding member assembly 150.

In some embodiments, inwardly facing surface 124 may include provisions to receive one or more connecting portions. For example, in some embodiments, inwardly facing surface 124 includes a plurality of recesses 127 that are sized and oriented to fit corresponding connecting portions of plurality of connecting portions 154. As seen in FIG. 4, plurality of recesses 127 form a pattern on sole member 120 that matches the pattern of connecting portions 154 within protruding member assembly 150. In some embodiments, plurality of recesses 127 may be deep enough so that plurality of connecting portions 154 are flush with, or recessed within, inwardly facing surface 124. In other embodiments, plurality of recesses 126 may be shallow so that some portions of connecting portions 154 are raised above inwardly facing surface 124.

Using the exemplary configuration, protruding member assembly 150 may be assembled with sole member 120 so that plurality of protruding members 152 are inserted through plurality of holes 180. Further, in some cases, plurality of connecting portions 154 are received within plurality of recesses 127 of inwardly facing surface 124. With this configuration, plurality of connecting portions 154 may form a supporting structure along inwardly facing surface 124 from which plurality of protruding members 152 may be suspended. This arrangement facilitates the articulation of individual protruding members as discussed in further detail below.

Referring now to FIG. 6, for purposes of description, protruding member assembly 150 may be characterized by an inner portion 156 and an outer portion 158. Inner portion 156 includes all the proximal end portions of plurality of protruding members 152 as well as plurality of connecting portions 154. In other words, inner portion 156 may comprise the portion of protruding member assembly 150 that is disposed closest to a foot when article 100 is worn.

Outer portion 158 includes all the distal end portions of plurality of protruding members 152. In other words, outer portion 158 may comprise the portion of protruding member assembly 150 that confronts a ground surface during use. In some cases, inner portion 156 may be further associated with an inner surface 157 that is approximately parallel with the top surfaces of the proximal end portions of plurality of protruding members 152 and with the top surfaces of plurality of connecting portions 154. Likewise, in some cases, outer portion 158 may be further associated with an outer surface 159. Outer surface 159 may be a two-dimensional surface that is approximately parallel with the bottom surfaces of the distal end portions of plurality of protruding members 152. As seen in FIGS. 5 and 6, both inner surface 157 and outer surface 159 are discontinuous surfaces.

As seen in the figures, when protruding member assembly 150 is assembled with sole member 120, plurality of protruding members 152 extend through plurality of holes 180. Moreover, the distal end portions of each protruding member extend outwardly from outwardly facing surface 122 of sole member 120. For example, in the configuration shown in FIG. 3, a distal portion 185 of a protruding member 183 extends a distance D1 from outwardly facing surface 122. Similarly, each of the remaining protruding members may extend outwardly from outwardly facing surface 122. In some cases, each protruding member may extend a similar distance from outwardly facing surface 122. In other embodiments, however, two or more different protruding members can extend different distances from outwardly facing surface 122. Furthermore, as discussed in detail below, the extent to which each protruding member extends from a corresponding hole may vary as sole system 110 comes into contact with a ground surface.

In some embodiments, the proximal end portions of each protruding member of plurality of protruding members 152 could be flush with, or extend outwardly from, inwardly facing surface 124 of sole member 120. As best seen in FIG. 3, in the exemplary embodiment, each protruding member is approximately flush with inwardly facing surface 124. For example, an end portion 187 of protruding member 183 is approximately flush with inwardly facing surface 124. However, in other embodiments, at least some protruding members may extend outwardly from inwardly facing surface 124. In other words, in some embodiments, the proximal end portions of some protruding members of plurality of protruding members 152 could be raised with respect to inwardly facing surface 124. It is also contemplated that in some embodiments, the proximal end portions of some protruding members could be recessed with respect to inwardly facing surface 124. As discussed in further detail below, the relative distance of each proximal end portion of plurality of protruding members 152 from inwardly facing surface 124 may vary as sole system 110 comes into contact with a ground surface.

FIG. 3 further illustrates one possible arrangement for sole system 110, in which each protruding member may confront, or be disposed directly adjacent to, an interior surface of a corresponding hole. For example, in the current embodiment, protruding member 183 includes an exterior surface 186 that confronts an interior surface 188 of hole 181. Although this embodiment shows a relatively snug fit between protruding member 183 and hole 181, in other embodiments some or all of exterior surface 186 could be spaced apart from interior surface 188 of hole 181. Thus, in some other embodiments, protruding member 183 could "float" within a hole 181 and be suspended by adjacent connecting portions.

In different embodiments, the arrangements of protruding member assembly 150 through sole member 120 can vary. For example, in some embodiments, protruding member assembly 150 may extend through all portions of sole member 120 (e.g., forefoot portion 10, midfoot portion 12 and heel portion 14). In other embodiments, protruding member assembly 150 may extend through some portions of sole member 120, but not others. As an example, in some embodiments, protruding member assembly 150 could be associated with forefoot portion 10 and midfoot portion 12, but not heel portion 14. In still other embodiments, protruding member assembly 150 could extend through any other portions or combination of portions.

In different embodiments, the geometric pattern formed by plurality of protruding members 152 and connecting portions 154 could vary. For example, the relative spacing between adjacent protruding members, the number of connecting portions attached to each protruding member as well as other general geometric features of the arrangement could be varied. These geometric features could be selected to achieve desired levels of tactile sensation across different regions of the foot.

In an exemplary embodiment, protruding member assembly 150 extends through a majority of sole member 120, with some gaps in coverage. For example, as best seen in FIG. 6, protruding member assembly 150 includes a heel portion 191 and a forefoot portion 193. Heel portion 191 and forefoot portion 193 are connected by a lateral arch portion 192, and spaced apart on a medial side of sole member 120. Further, forefoot portion 193 includes a rear forefoot portion 194, a medial forefoot portion 195 and a lateral forefoot portion 196. A first gap 197 separates a portion of lateral forefoot portion 196 from medial forefoot portion 195. In addition, a second gap 198 separates a portion of lateral forefoot portion 196 from rear forefoot portion 194. This particular arrangement may be used to achieve tactile sensation in both the forefoot and heel. Additionally, gaps between adjacent portions of protruding member assembly 150 (such as gap 197 between medial forefoot portion 195 and lateral forefoot portion 196) may help a user to better distinguish between tactile stimulation in different parts of the foot.

Although the current embodiment illustrates a unitary protruding member assembly, other embodiments could comprise a protruding member assembly with disjoint sections, or multiple protruding member assemblies that are separated. Such an example is discussed below and illustrated in FIGS. 16-20.

Embodiments may incorporate protruding members of different shapes and/or sizes. In one exemplary embodiment, plurality of protruding members 152 each have a geometry that is approximated by a conical frustum (e.g., a truncated cone). In other words, the diameter of each protruding member of plurality of protruding members 152 may decrease towards the tips (i.e., in the distal direction). In another exemplary embodiment, discussed below, a plurality of protruding members may have a cylindrical geometry (i.e., constant diameter). Such an embodiment is described below and shown in FIGS. 16-20. Furthermore, other embodiments could incorporate protruding members having any other geometries and/or sizes, including a variety of geometries commonly associated with cleats and traction elements for footwear.

In different embodiments, the dimensions of each protruding member could vary. For example, in some embodiments the diameter of a protruding member could be substantially greater than a height of the protruding member. In other embodiments, the height of a protruding member could be substantially less than the height of the protruding member. It is contemplated that some embodiments could utilize protruding members having a pin-like geometry in which the length of the protruding member is much greater than the diameter. In other embodiments, the diameter and height of a protruding member could be substantially similar. The dimensions (e.g., diameter and/or height) could be selected according to factors including, but not limited to, materials used, desired tactile properties and user comfort.

In different embodiments, the geometry of one or more connecting portions could also vary. In the exemplary embodiment, each connecting portion has a strip-like or bar-like shape. In other embodiments, however, the geometry of each connecting portion could vary in any other manner. Other exemplary geometries could include straight geometries, curved geometries as well as regular and irregular geometries.

It will be understood that embodiments may utilize a variety of different geometries for one or more holes within sole member 120. Exemplary embodiments include hole geometries that correspond to the geometries of associated protruding members. For example, as seen in FIG. 3, hole 181 has a conical or tapered geometry to fit the matching geometry of protruding member 183. In some cases, the hole geometry could differ from the corresponding protruding member geometry. For example, some embodiments may utilize cylindrical holes with constant diameters for cleats having a conical frustum (or otherwise tapered) geometry. Furthermore, the size and geometry of a hole can be varied to achieved either a snug or loose fit with an associated protruding member.

In some embodiments, protruding member assembly 150 may be configured in a manner that allows the assembly to flex, bend, deflect, twist or otherwise undergo elastic deformation of some kind. This can be achieved through the use of connecting portions that are at least partially elastic and therefore allow for some relative movement between adjacent protruding members.

In embodiments where a large number of protruding members are connected via a matrix or webbing of connecting portions, even small local deformations of connecting portions can result in large global deformations for protruding member assembly 150. In embodiments where large deformations of connecting portions can occur, the resultant global deformations in protruding member assembly 150 can be large.

Figure 7:
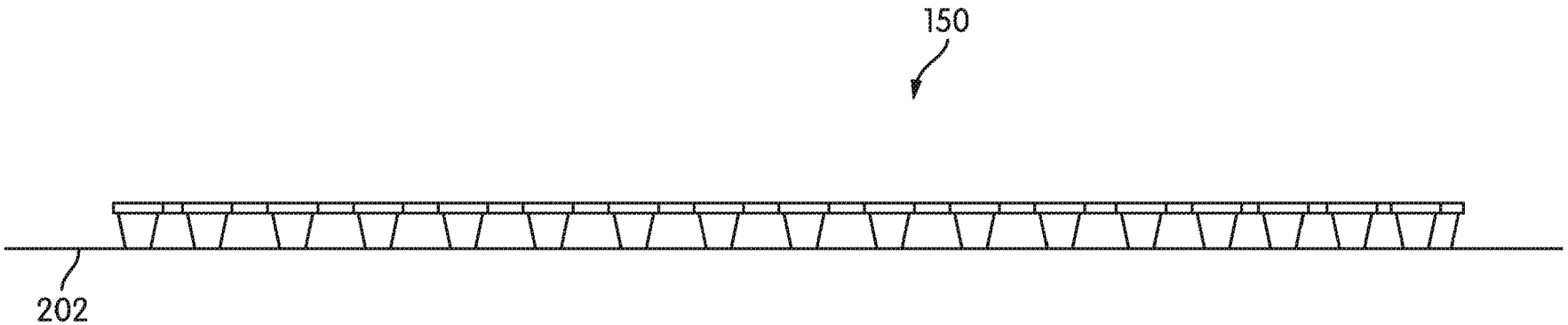
FIG. 7 is a side schematic view of an embodiment of a protruding member assembly in a flattened configuration.
Figure 8:
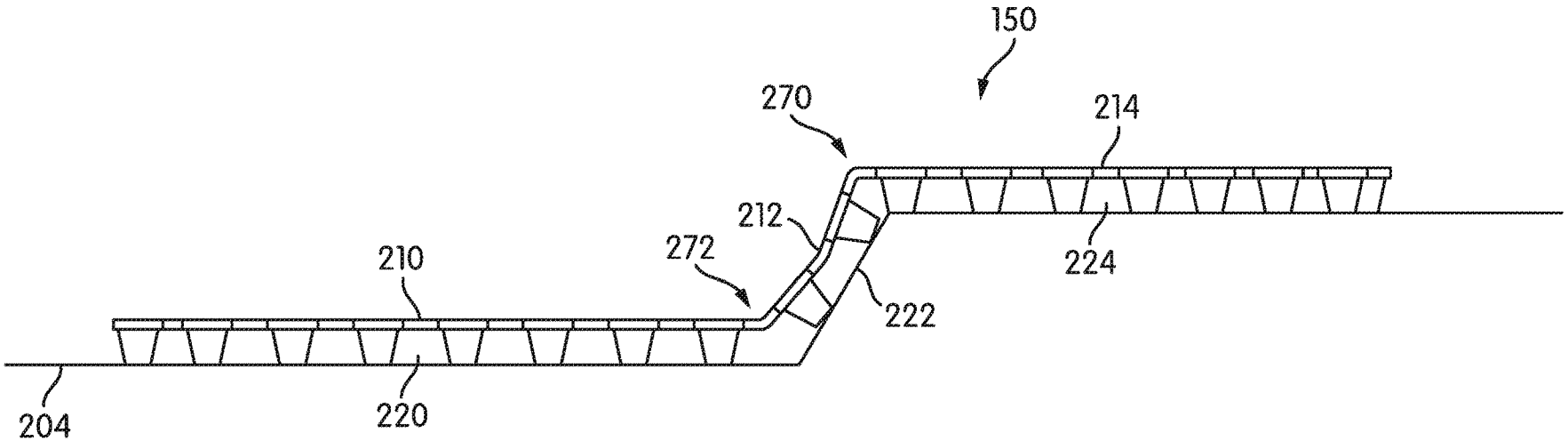
FIG. 8 is a side schematic view of an embodiment of a protruding member assembly bent in a manner to conform to a stepped surface.
Figure 9:
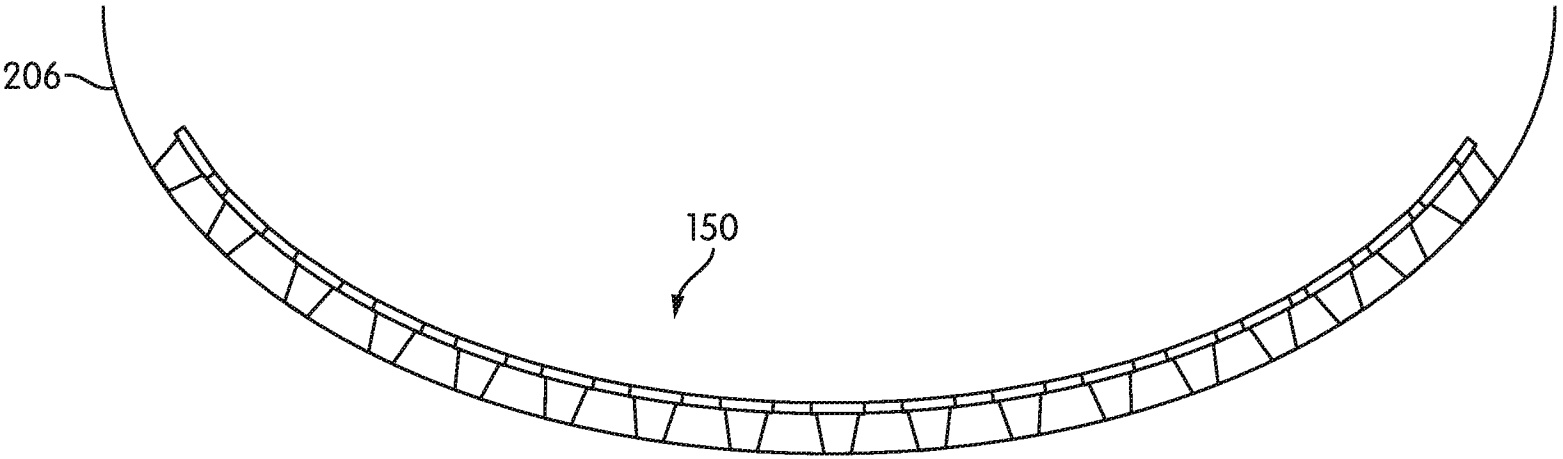
FIG. 9 is a side schematic view of an embodiment of a protruding member assembly flexing in a manner to conform to a concave surface.

FIG. 7 illustrates an embodiment of protruding member assembly 150 in a flattened state, while FIGS. 8 and 9 illustrate protruding member assembly 150 in different states of bending and flexing. For purposes of illustration, protruding member assembly 150 is shown schematically. Referring first to FIG. 7, when placed on a flat surface 202, protruding member assembly 150 takes on an approximately flat global geometry. However, as seen in FIGS. 8 and 9, when protruding member assembly 150 is placed on contoured or irregular surfaces, the geometry of protruding member assembly 150 changes to accommodate (or match) the geometry of the surface. Referring to FIG. 8, protruding member assembly 150 is seen to adapt to the geometry of stepped surface 204. Here, a first region 210 of protruding member assembly 150 is parallel with a lower step 220 of stepped surface 204. Likewise, a second region 212 of protruding member assembly 150 is parallel with a sloped portion 222 of stepped surface 204. Finally, a third region 214 of protruding member assembly 150 is parallel with an upper step 224 of stepped surface 204. This stepped geometry for protruding member assembly 150 is achieved via large elastic deformations of connecting portions at a first region 270 and a second region 272.

Referring now to FIG. 9, protruding member assembly 150 is seen to conform to the concave geometry of concave surface 206. In contrast to the previous configuration that included regions of large bending, the geometric configuration illustrated in FIG. 9 for protruding member assembly 150 is achieved as the combined result of many small deformations between adjacent protruding members.

Thus, it is clear that protruding member assembly 150 can be bent or flexed such that adjacent regions of protruding member assembly 150 are angled or non-parallel with each other. Likewise, protruding member assembly 150 can be elastically deformed into curved and/or non-linear geometries.

Figure 10:
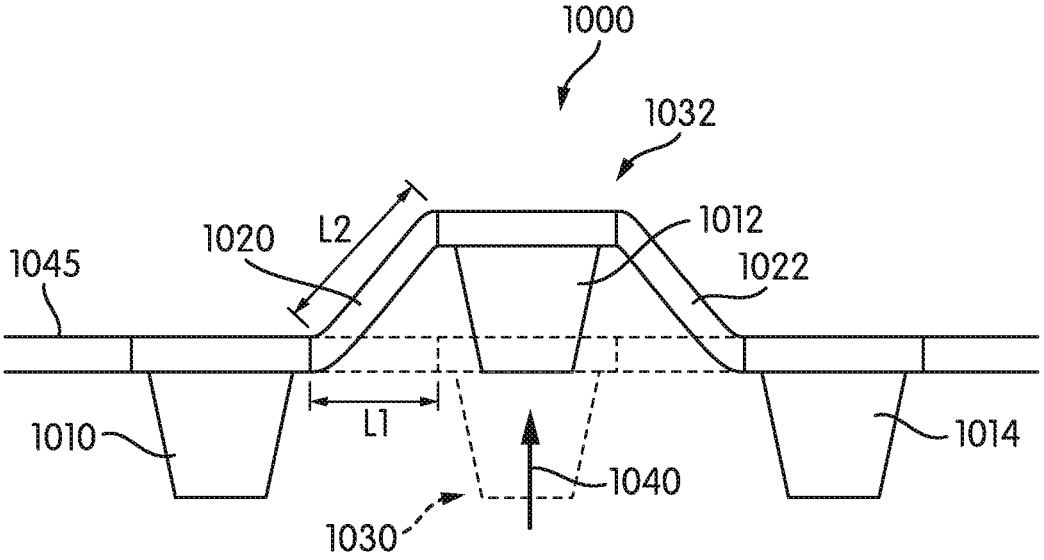
FIG. 10 is a side schematic view of an embodiment of a portion of a protruding member assembly in which a protruding member has been moved to an engaged position.

FIG. 10 is a schematic side view of an embodiment of a portion of a protruding member assembly 1000, which is intended to illustrate local flexing of protruding member assembly 1000. Referring to FIG. 10, first protruding member 1010 and second protruding member 1012 are connected by first connecting portion 1020. Likewise, second protruding member 1012 and third protruding member 1014 are separated by second connecting portion 1022. Here, second protruding member 1012 has been displaced from an initial position 1030 (shown in phantom) to a displaced position 1032 by a force 1040. Such a force could be, for example, a local surface feature of the ground that engages and pushes up against second protruding member 1012 but that does not contact and press on first protruding member 1010 or third protruding member 1014.

As seen here, the displacement of second protruding member 1012 is made possible by the elastic properties of first connecting portion 1020 and second connecting portion 1022, which may stretch or otherwise elastically deform in response to applied forces. For example, first connecting portion 1020 is seen to stretch from an initial length L1 to a final length L2. Second connecting portion 1022 may likewise undergo stretching as the position of second protruding member 1012 is changed.

Further, it can be seen that as second protruding member 1012 is displaced, the orientations of first connecting portion 1020 and second connecting portion 1022 change. In particular, first connecting portion 1020 and second connecting portion 1022 may be approximately flat or parallel with an inner surface 1045 of protruding member assembly 1000 while second protruding member 1012 is in the initial position 1030. However, as second protruding member 1012 is moved to the displaced position 1032, first connecting portion 1020 and second connecting portion 1022 become angled with respect to inner surface 1045.

While the exemplary embodiment of FIG. 10 shows a protruding member attached to only two connecting portions, the principles discussed here may also apply in cases where a protruding member is attached to three or more adjacent protruding members via three or more different connecting portions. In such cases, each of the three or more connecting portions may stretch to facilitate the displacement of a protruding member encountering an upward force.

Figure 11:
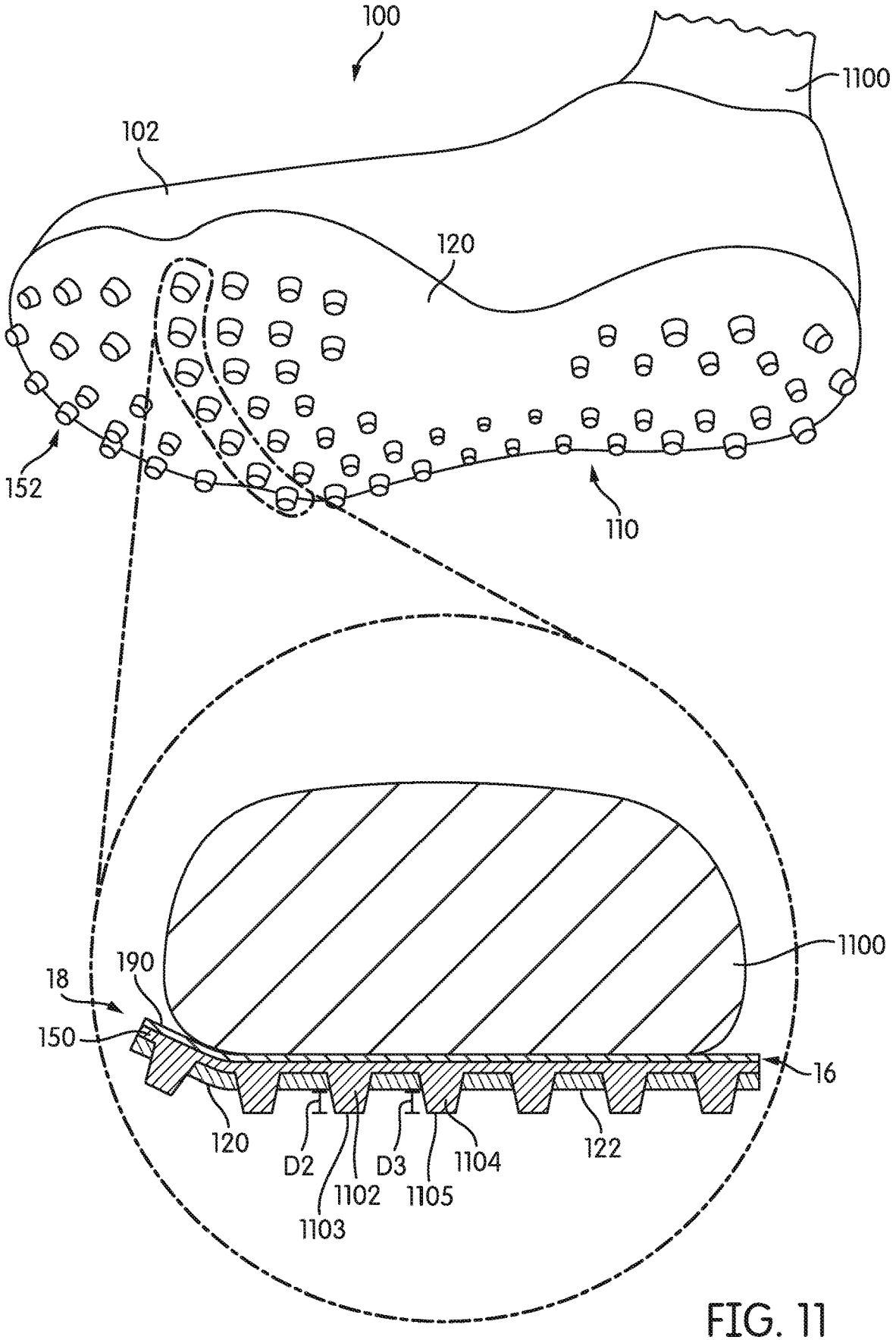
FIG. 11 is a schematic view of an embodiment of a sole system in a default configuration.
Figure 12:
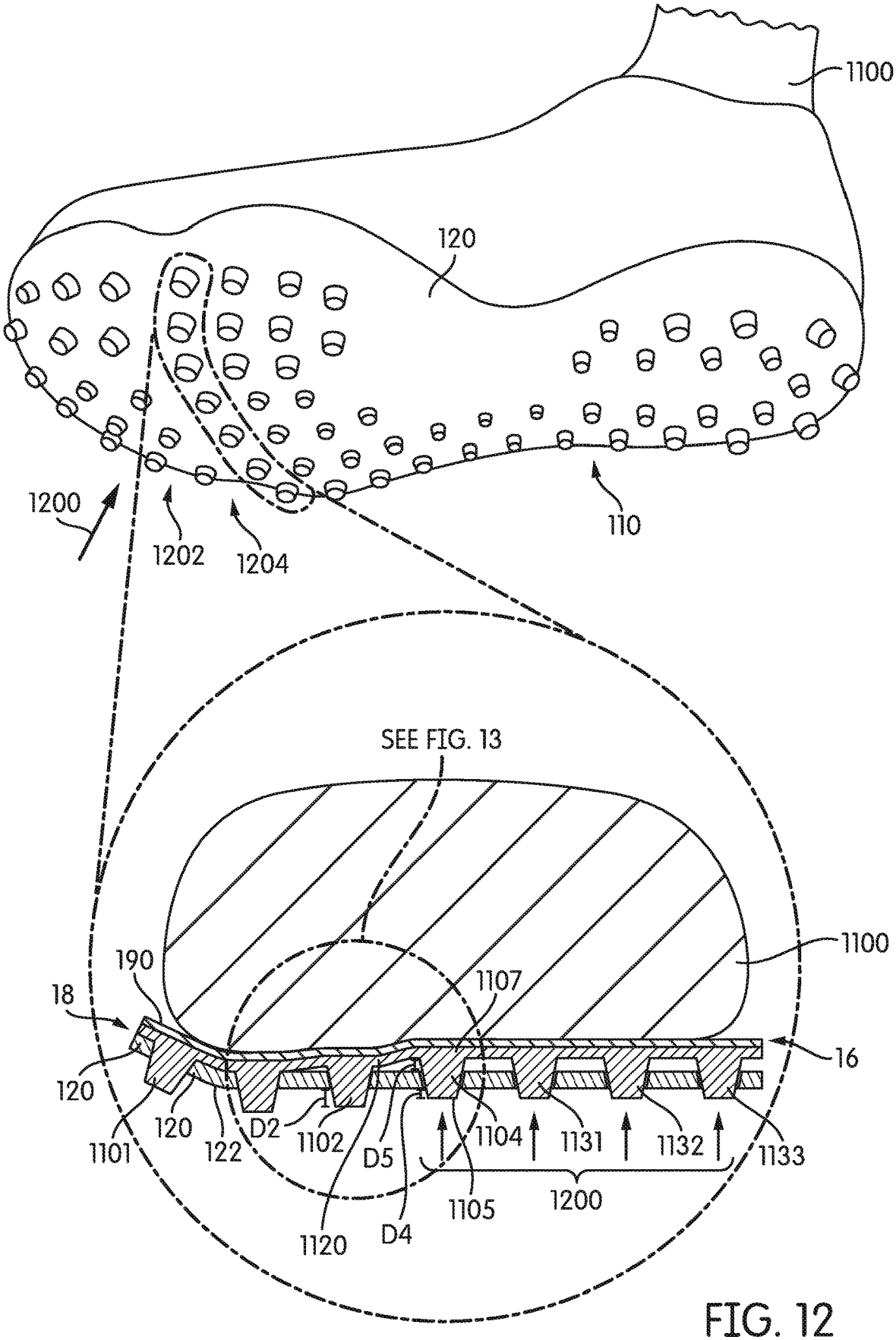
FIG. 12 is a schematic view of the sole system of FIG. 11 in an engaged configuration.

FIGS. 11 and 12 are schematic views of two configurations of sole system 110 that vary according to differences in applied forces. For purposes of illustration, each of FIGS. 11 and 12 shows an isometric bottom view of sole system 110 as well as an enlarged cross-sectional view of a portion of sole system 110. In each enlarged cross-section, portions of sole member 120, protruding member assembly 150 and inner member 190 are seen. Additionally, a foot 1100 is shown inserted within article 100.

As seen in FIG. 11, in which no forces are applied to the bottom of sole system 110, plurality of protruding members 152 are all fully extended from outwardly facing surface 122 of sole member 120. For example, a distal end portion 1103 of protruding member 1102 is extended a distance D2 from outwardly facing surface 122. Additionally, a distal end portion 1105 of protruding member 1104 is extended a distance D3 from outwardly facing surface 122. In this configuration, both protruding member 1102 and protruding member 1104 are seen to be fully extended. In this case, protruding member 1104 is disposed closer to medial side 18 of sole member 120 than protruding member 1102.

Referring next to FIG. 12, an exemplary force 1200 has been applied over a region 1202 of sole system 110, which is disposed on lateral side 16. Force 1200 acts to push a first group 1204 of protruding members into sole member 120. Specifically, as seen in FIG. 12, protruding member 1104 of first group 1204 is displaced so that distal end portion 1105 extends a distance D4 from outwardly facing surface 122. As seen by comparing FIG. 11 and FIG. 12, distance D4 may be substantially less than distance D3. Moreover, a proximal end portion 1107 of protruding member 1104 is raised above inwardly facing surface 124 by a distance D5 so that proximal end portion 1107 presses against inner member 190 and ultimately foot 1100. Likewise, protruding member 1131, protruding member 1132 and protruding member 1133 are seen to be similarly displaced in response to force 1200.

Because of the flexibility of protruding member assembly 150, movement of protruding members may primarily occur at localized regions where forces or pressures are directly applied. Thus, for example protruding member 1101, which is some distance away from region 1202 where force 1200 has been applied, does not move.

Figure 13:
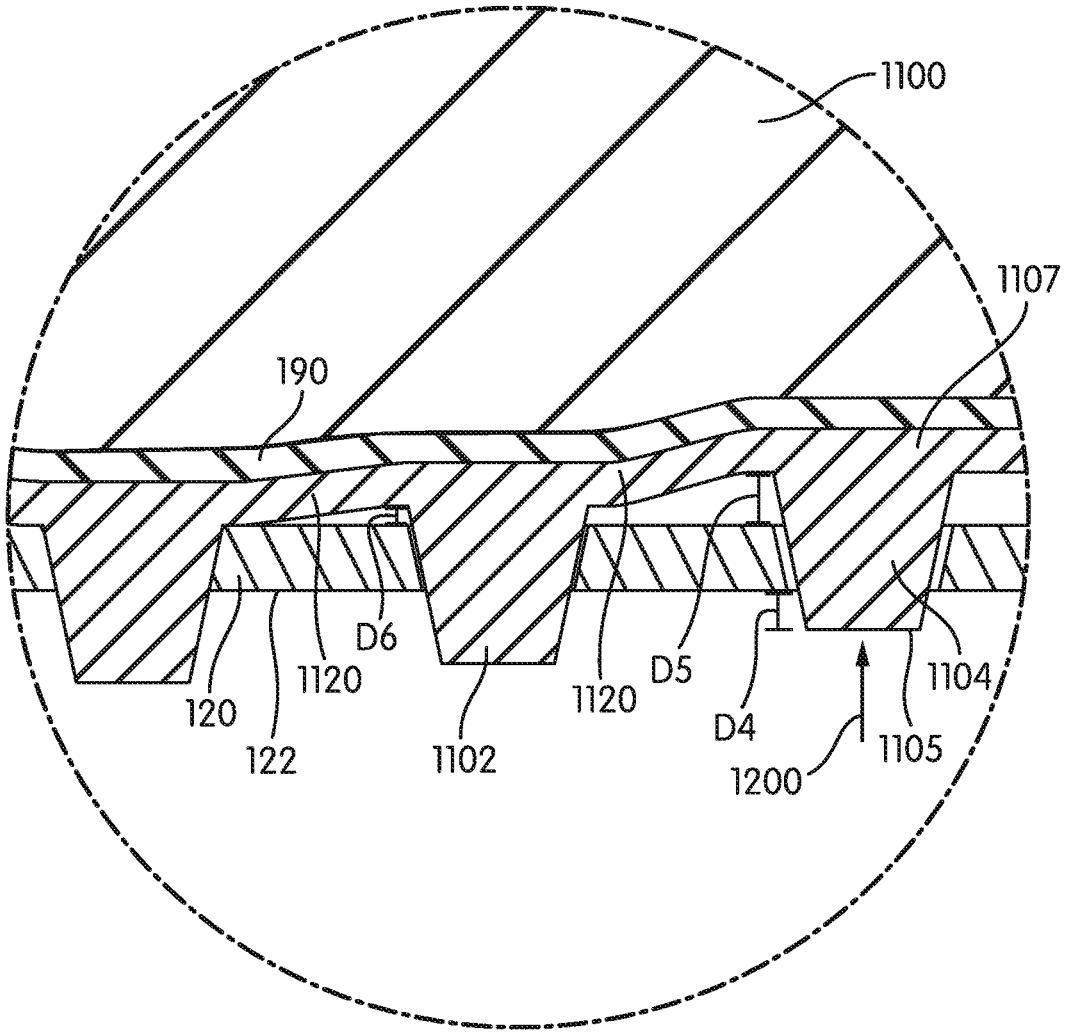
FIG. 13 is a schematic enlarged view of several protruding members of the sole system of FIG. 11 in an engaged configuration.

FIG. 13 shows a further enlarged view of protruding member 1102 and protruding member 1104. As previously discussed, protruding member 1104 and protruding member 1106 are displaced in the proximal direction by force 1200. In particular, protruding member 1104 is displaced a distance D5 from inwardly facing surface 124 of sole member 120. Although force 1200 is not directly applied to protruding member 1102, protruding member 1102 may still translate a small distance D6 due to tension from connecting portion 1120. However, because connecting portion 1120 is elastic and capable of stretching, protruding member 1102 is translated a lesser distance than protruding member 1104. In other words, distance D6 is substantially smaller than distance D5. The relative size of distance D5 and distance D6 could vary in different embodiments according to the material properties of connecting portion 1120. For example, in some cases, distance D6 may have a value be between 0 and 75 percent of the value of distance D5. In other embodiments, distance D6 could have a value greater than 75 percent of the value of distance D5.

The net effect of the change in configurations of protruding member assembly 150 shown in FIGS. 11-13 is that the protruding members within region 1202 where force 1200 has been applied, are translated in a proximal direction towards foot 1100. Thus, these protruding members, which include protruding member 1104, protruding member 1131, protruding member 1132 and protruding member 1133 provide tactile sensation to foot 1100 as they are displaced. This tactile sensation allows the user to sense the geometry of an underlying surface, in situations where the force is applied by a ground surface.

The local displacement of each protruding member in response to applied forces at their distal ends may result in a geometric configuration of protruding member assembly 150 that reflects the variation in applied forces. In particular, if sole system 110 is disposed on a contoured ground surface, the configuration of protruding member assembly 150 may be varied so that an inner surface of the protruding member assembly is provided with a contoured geometry that corresponds with the geometry of the contoured ground surface. With the foot in direct contact, or indirect contact, with the inner surface of protruding member assembly 150, the wearer of article 100 is able to sense the geometry of the underlying ground surface. In other words, sole system 110 creates a tactile sensation along the sole of the foot that provides the user with information about the ground surface.

Figure 14:
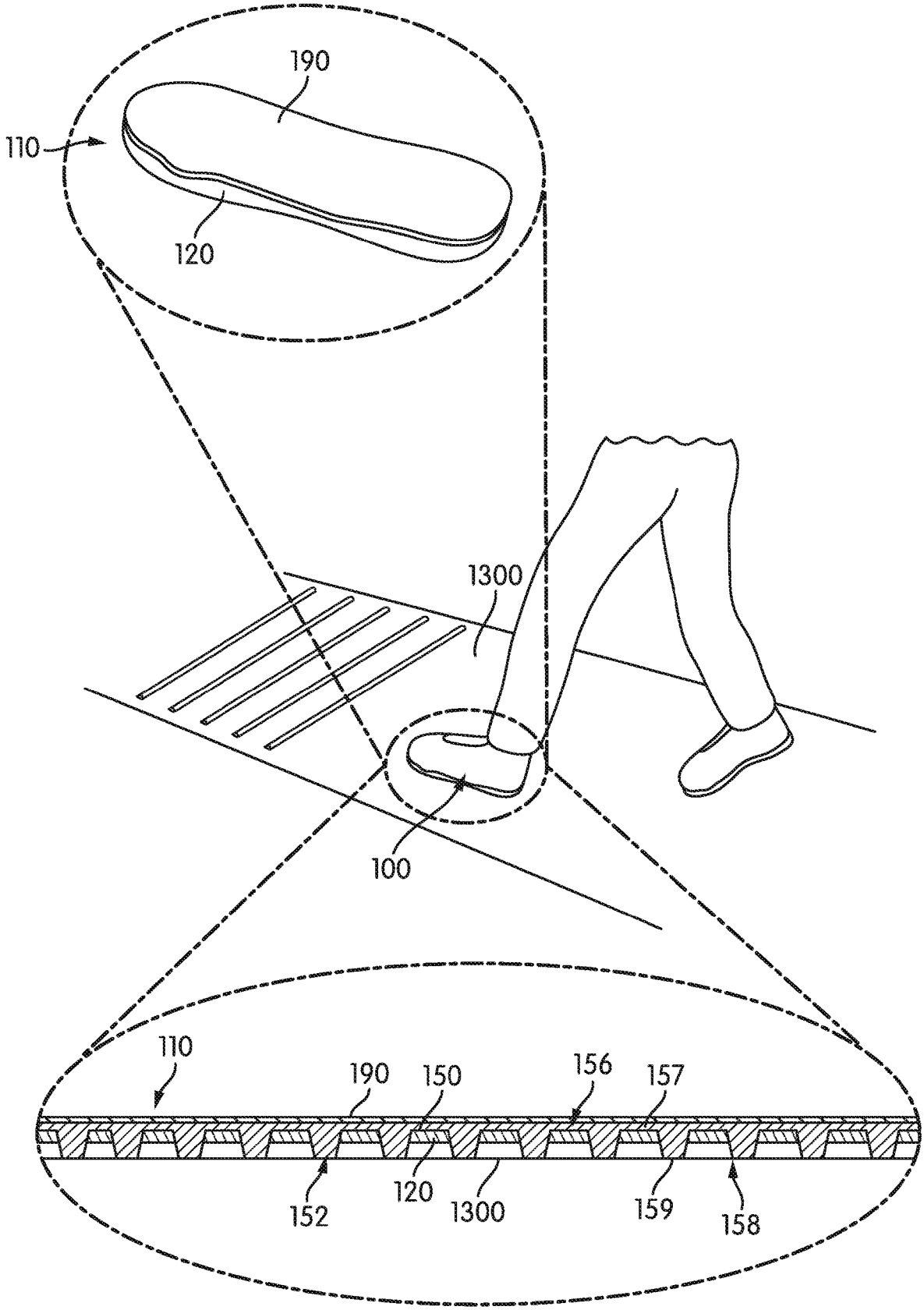
FIG. 14 is a schematic view of a sole system responding to a user walking on a substantially flat surface, according to an embodiment.
Figure 15:
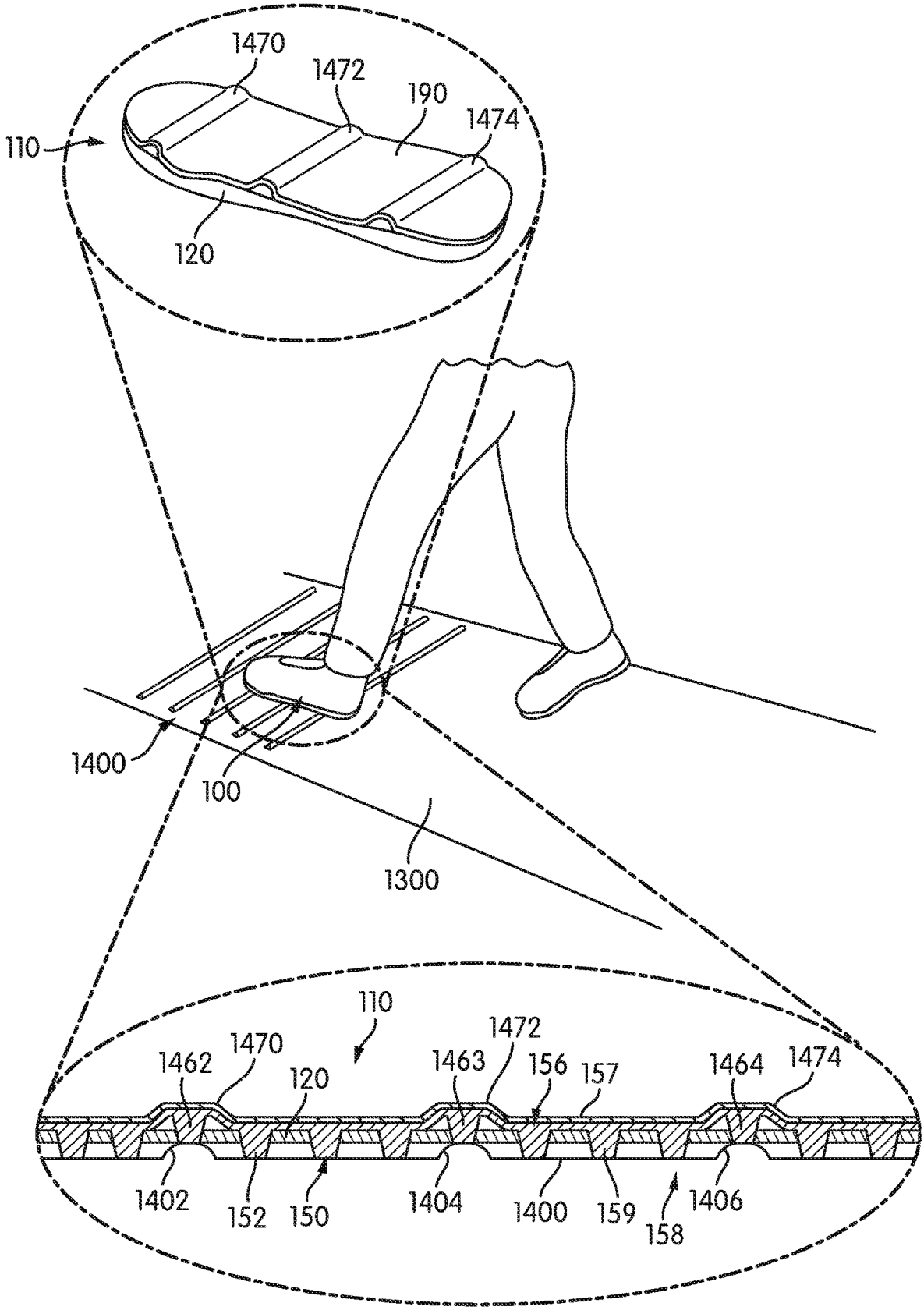
FIG. 15 is a schematic view of a sole system responding to a user walking on a contoured surface, according to an embodiment.
Figure 16:
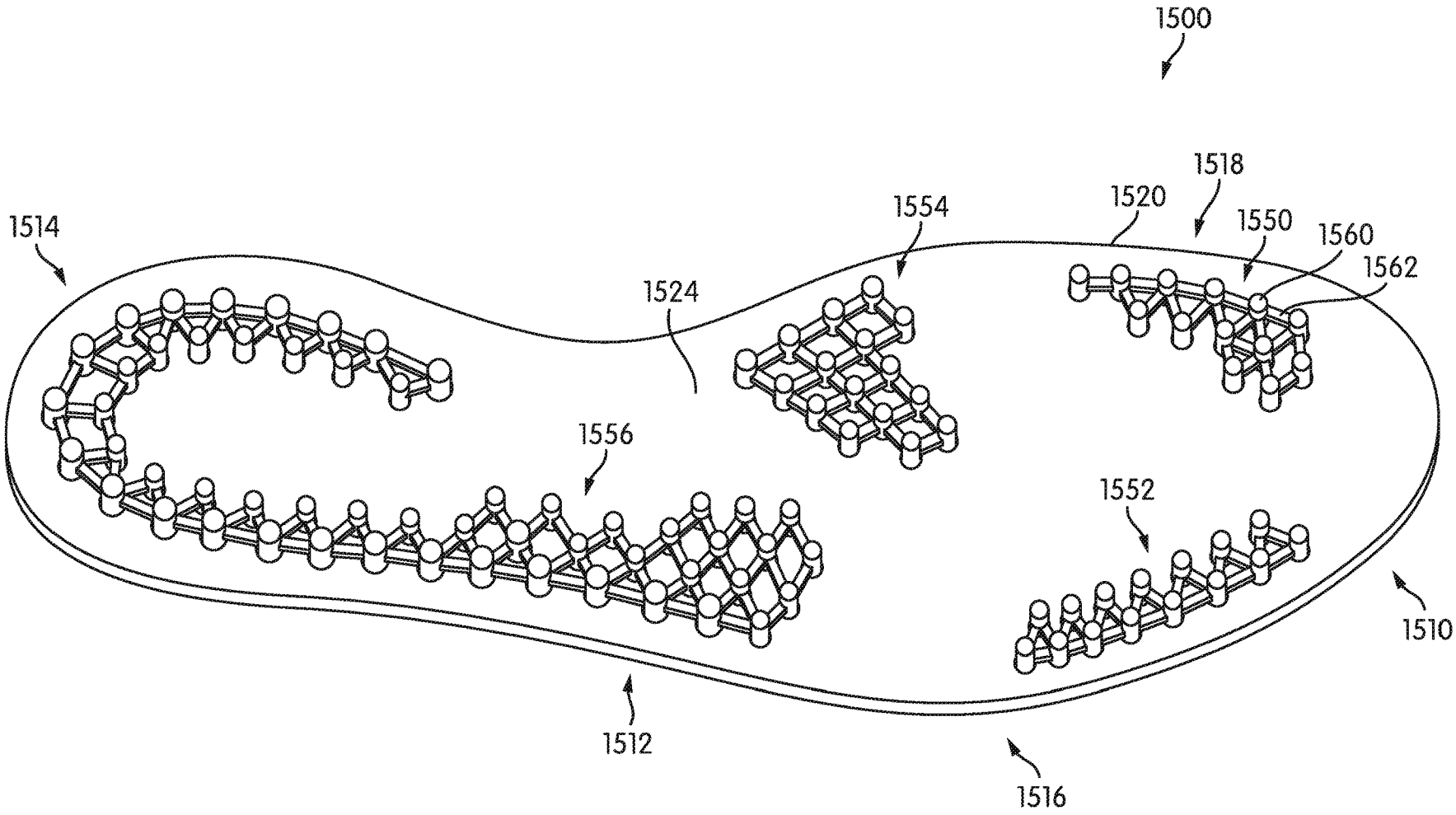
FIG. 16 is a schematic isometric view of another embodiment of a sole system, which includes multiple protruding member assemblies.
Figure 17:
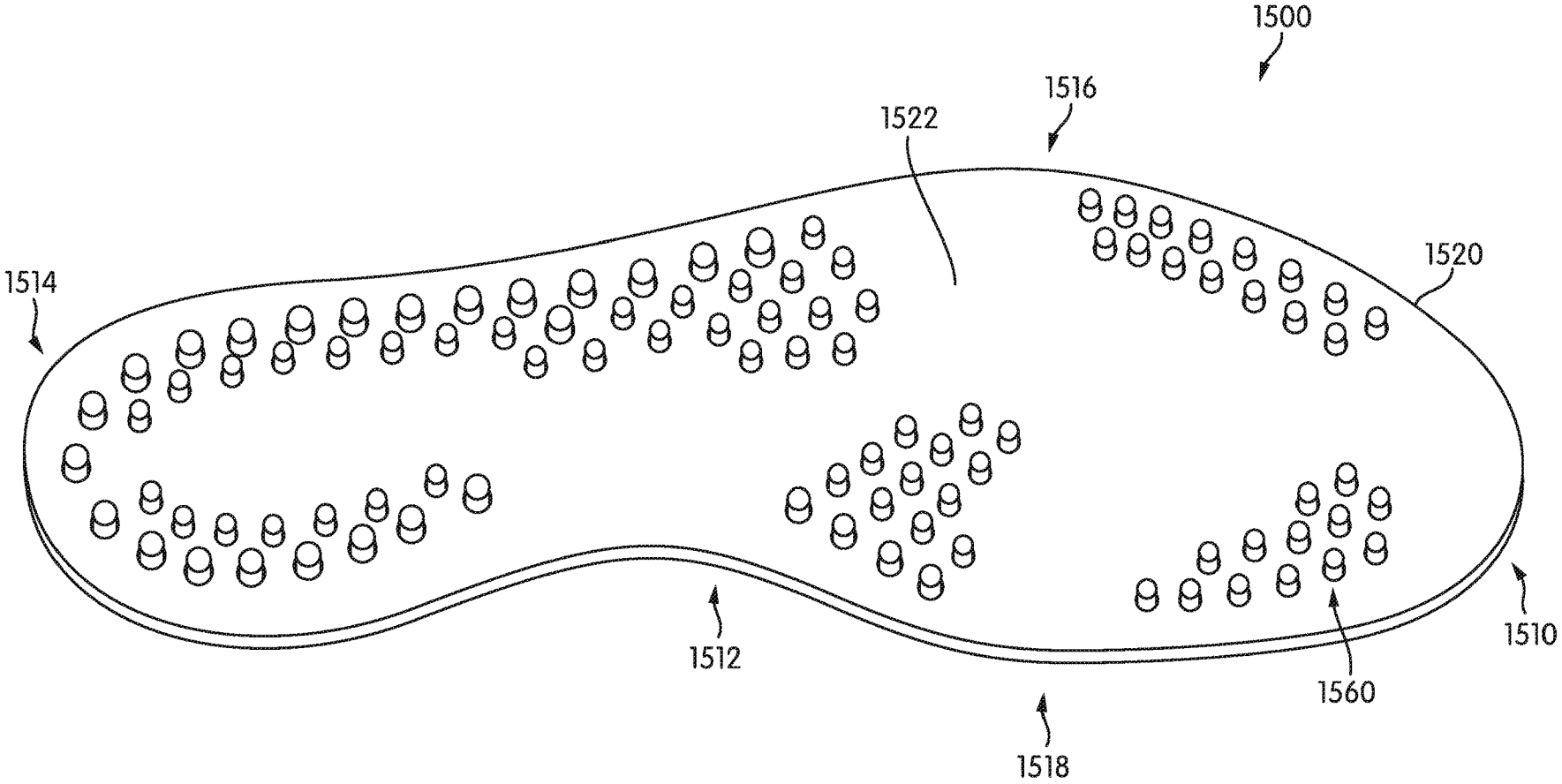
FIG. 17 is a schematic bottom isometric view of the sole system of FIG. 16.
Figure 18:
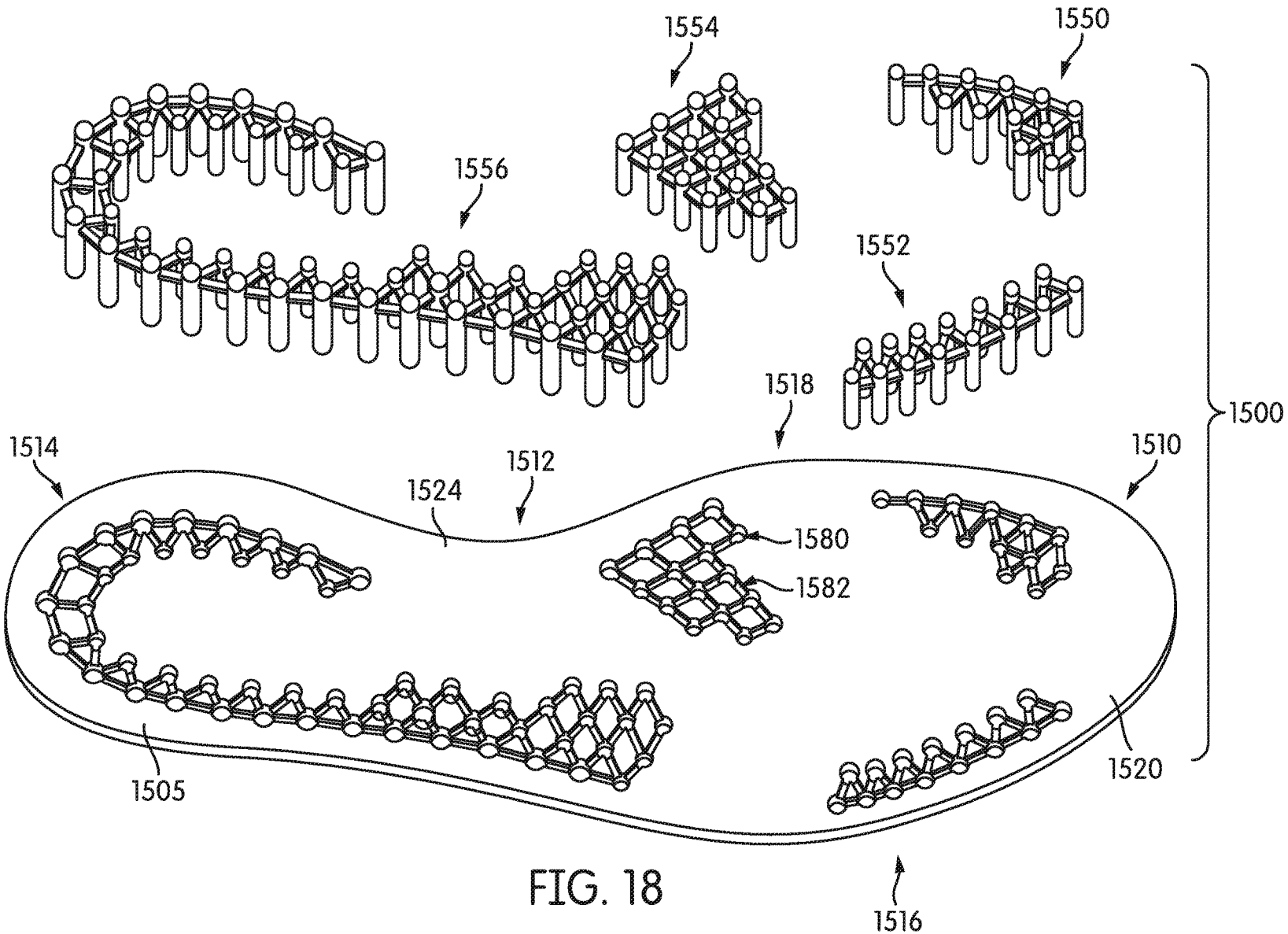
FIG. 18 is an exploded isometric view of the sole system of FIG. 16.

FIGS. 14 and 15 illustrate schematic views of an embodiment of article 100 in use. In particular, FIG. 14 illustrates a configuration where sole member 110 is engaged with a relatively flat surface, while FIG. 15 illustrates a configuration where sole member 110 is engaged with a contoured surface. As already mentioned, inner member 190, which is shown in FIGS. 14 and 15, is optional and may not be present in other embodiments.

Referring first to FIG. 14, article 100 is in contact with a relatively flat surface region 1300. In this configuration of sole system 110, plurality of protruding members 152 are all fully extended and in contact with flat surface region 1300. This results in a generally flattened outer surface 159 for outer portion 158 of protruding member assembly 150. Moreover, the flattened geometry of outer portion 158 results in a flattened inner surface 157 for inner portion 156 of protruding member assembly 150. Because inner member 190 is disposed over outer surface 157, inner member 190 is also seen to have an approximately flattened geometry. Thus, in this configuration a wearer's foot may rest on an approximately flat inner member 190, and/or directly on a flat outer portion 156 of protruding member assembly 150 (in cases where inner member 190 may not be used).

Referring now to FIG. 15, article 100 is in contact with a contoured surface region 1400. Specifically, contoured surface region 1400 includes a series of parallel ridge-like features, including first surface feature 1402, second surface feature 1404 and third surface feature 1406. As seen clearly in the enlarged cross-sectional view of sole system 110, sole system 110 engages the contoured surface and adapts accordingly. In particular, a first protruding member 1462, a second protruding member 1463 and a third protruding member 1464 are displaced by first surface feature 1402, second surface feature 1404 and third surface feature 1406, respectively. The remaining protruding members of plurality of protruding members 152 remain fully extended and in contact with flattened sections of contoured surface region 1400 that span between adjacent surface features. Thus, in this configuration of sole system 110, inner surface 157 of protruding member assembly 150 takes on a contoured geometry corresponding to the geometry of contoured surface region 1400. Moreover, as first protruding member 1460, second protruding member 1462 and third protruding member 1464 are retracted (or raised with respect to the other protruding members), inner surface 157 of protruding member assembly 150 also takes on a similar contoured geometry corresponding to the geometry of contoured surface region 1400. In embodiments where inner member 190 covers over protruding member assembly 150, the top surface of inner member 190 retains a similar geometry. Specifically, inner member 190 is provided with a contoured surface that includes a first surface feature 1470, a second surface feature 1472 and a third surface feature 1474.

As seen by comparing FIGS. 14 and 15, the geometry of sole member 120 may be substantially unchanged as protruding member assembly 150 undergoes elastic deformation. In an exemplary embodiment, sole member 120 comprises a member that is substantially more rigid than protruding member assembly 150. Sole member 120 may undergo little to no elastic deformation as sole system 110 comes into contact with a variety of different ground surfaces. In some embodiments, the rigidity of sole member 120 helps to provide consistent strength and support for the foot even as protruding member assembly 150 is elastically deformed in response to the underlying surface geometry.

Using the arrangement described above, a wearer of sole system 110 can sense surface features that might otherwise not be sensed using a traditional sole structure. Such an improvement in tactile sensation may enhance the wearer's balance, or could help the wearer to avoid undesirable ground conditions (e.g., bumpy surfaces or surfaces with divots).

FIGS. 16 through 20 illustrate various schematic views of another embodiment of components of a sole system 1500. Referring to FIGS. 16 through 20, sole system 1500 includes a sole member 1520. Sole member 1520 includes an outwardly facing surface 1522 and an inwardly facing surface 1524. Sole member 1520 may further include provisions for receiving protruding members and connecting portions. For example, sole member 1520 may include a plurality of holes 1580 for receiving protruding members as well as a plurality of recesses 1582 for receiving corresponding connecting portions (see FIG. 18).

As in a previous embodiment, sole system 1500 further includes protruding members connected by connecting portions. However, in contrast to the previous embodiments, the current embodiment may be characterized by the use of multiple different protruding member assemblies. For example, in the current embodiment, sole system 1500 incorporates a first protruding member assembly 1550, a second protruding member assembly 1552, a third protruding member assembly 1554 and a fourth protruding member assembly 1556.

Each protruding member assembly comprises a plurality of protruding members connected to one another by a plurality of connecting portions. For example, referring to FIG. 16, first protruding member assembly 1550 includes a first plurality of protruding members 1560 in which adjacent protruding members are connected by a first plurality of connecting portions 1562. Likewise, each of second protruding member assembly 1552, third protruding member assembly 1554 and fourth protruding member assembly 1556 are associated with protruding members attached via connecting portions.

The use of disjoint protruding member assemblies may allow for a variety of possible arrangements on sole member 1520. In the exemplary embodiment, first protruding member assembly 1550 and second protruding member assembly 1552 are associated with medial side 1518 and lateral side 1516 of forefoot portion 1510 of sole member 1520. Additionally, fourth protruding member assembly 1556 is associated with a rearward region of forefoot portion 1510, which is also on the medial side of sole member 1520. Finally, third protruding member assembly 1554 extends through heel portion 1514 of sole member 1520 as well as midfoot portion 1512 of sole member 1520. In some embodiments, third protruding member assembly 1554 is disposed along an outer peripheral portion 1505 of sole member 1520, and may not extend into a central portion 1506 of sole member 1520.

The exemplary configuration shown in FIGS. 16-20 provides a sole system where tactile sensation is provided at pre-determined regions. Such pre-determined regions could be selected to enhance tactile sensation at regions used in specific activities or motions. For example, first protruding member assembly 1550 and second protruding member assembly 1552 may be disposed on the medial and lateral edges of sole system 1500 so that a user may receive enhanced tactile sensations during lateral and medial cutting motions. Likewise, third protruding member assembly 1554 may be disposed in a region of sole member 1520 corresponding to the ball of the foot so that a user may receive enhanced tactile sensations during pivoting and/or turning motions. Finally, fourth protruding member assembly 1556 may be disposed in heel portion 1514 of sole member 1520 as well as on the lateral edge of the midfoot portion 1516 so that a user may receive enhanced tactile sensations while backpedaling.

Some embodiments may also include provisions to enhance the level of sensation provided by one or more protruding members to a foot. In some embodiments, for example, an end portion of a protruding member can extend above (or away from) an outward surface of a protruding member assembly. In the embodiment shown in FIGS. 16 through 20, connecting portions may be joined along the intermediate portions of the protruding members, which creates a protrusion that extends away from the connecting portions in the proximal and distal directions.

Figure 19:
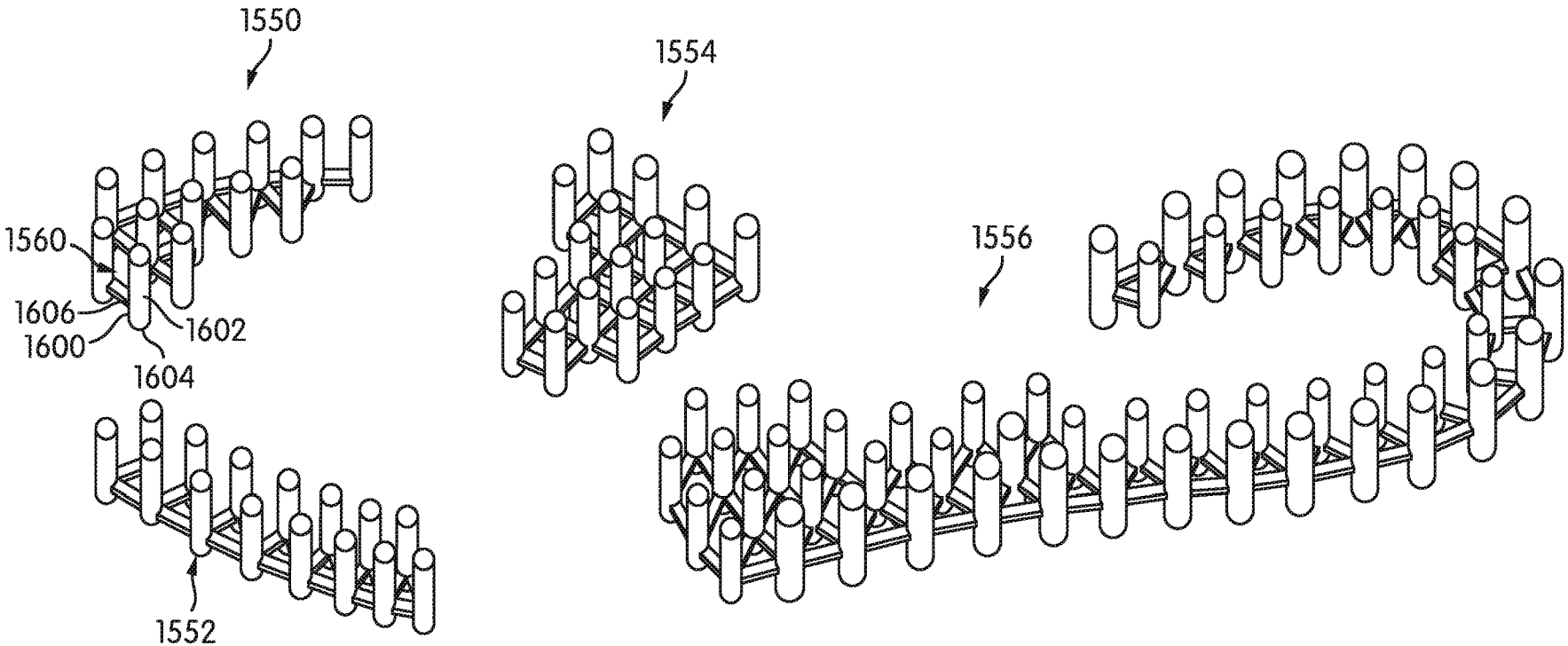
FIG. 19 is an isometric view of an outer side of the multiple protruding member assemblies of FIG. 16.
Figure 20:
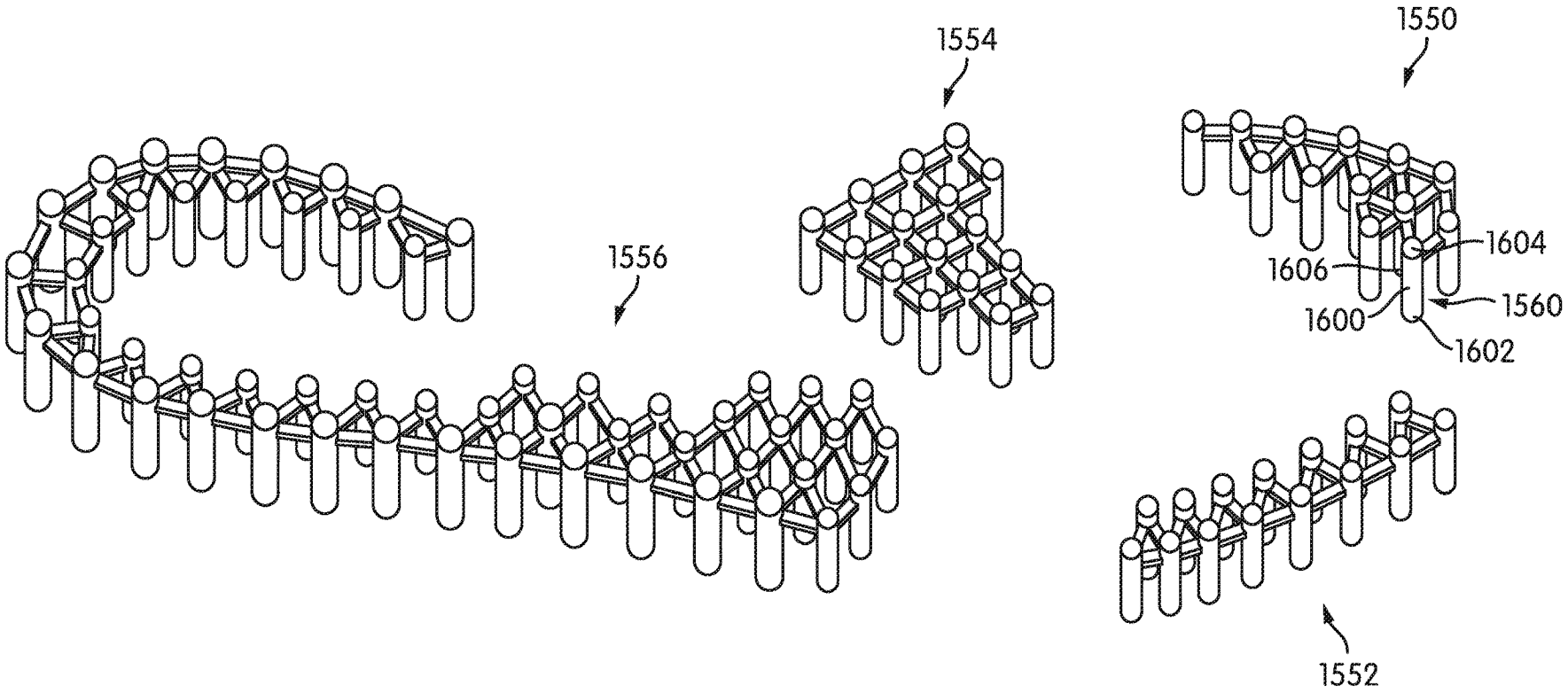
FIG. 20 is an isometric view of an inner side of the multiple protruding members assemblies of FIG. 16.

Referring now to FIGS. 19 and 20, in an exemplary embodiment, a protruding member 1600 of first protruding member assembly 1550 includes a distal protruding portion 1602 and a proximal protruding portion 1604, which are joined at an intermediate portion 1606 of protruding member 1600. In this case, intermediate portion 1606 is also where plurality of connecting portions 1560 are joined with protruding member 1600. Similarly, other protruding members of each protruding member assembly may include both distal and proximal protruding portions.

In different embodiments, the relative lengths of the proximal and distal protruding portions of a protruding member, as measured relative to the location where a connecting portion is joined to the protruding member, can vary. In some embodiments, for example, the distal protruding portion of a protruding member could be substantially longer than the proximal protruding portion. In other embodiments, the proximal protruding portion could be longer than the distal protruding portion. In still other embodiments, the proximal protruding portion could be substantially equal in length to the distal protruding portion. The relative length of the distal protruding portion and the proximal protruding portion could be varied to adjust characteristics of the sole system including the frequency and/or degree of tactile sensation provided by the sole system.

In contrast to the previous embodiments, the portion of a protruding member assembly engaging a foot is comprised mainly of proximal protruding portions of the protruding members. In other words, in this embodiment, plurality of connecting portions 1560 may not engage or otherwise contact a foot, or intermediate layer such as an inner member. Such a configuration for a protruding member assembly may change the amount of tactile sensation received at the foot, as the surface area of the contacting surface is less than in embodiments where connecting portions are also part of the contacting surface.

In some embodiments, a protruding member assembly may be formed as a substantially monolithic component. For example, in some embodiments, a protruding member assembly is a single molded construction comprising both connecting portions and protruding members. In other embodiments, however, a protruding member assembly could comprise protruding members that are pre-formed and then assembled together with connecting portions. In one embodiment, for example, a plurality of protruding members may be connected to one another by sections of elastic cable that are attached to the protruding members using an adhesive, a fastener or by tying the cables to the protruding members.

In some embodiments, protruding members and connecting portions could be made of substantially similar materials. For example, in embodiments where the protruding members and connecting portions comprise an integrally molded component, the protruding members and connecting portions could both be made of an elastically deformable material such as a plastic or rubber material. In other embodiments, protruding members and connecting portions could be made of substantially different materials. For example, in another embodiment, the protruding members could be constructed of a first material that is less elastic than a second material used to construct the connecting portions. Such a configuration would allow for increased flexibility of the connecting portions while limiting the elastic deformation undergone by the protruding members to maximize vertical force transfer. Moreover, the flexibility of the protruding members and the connecting portions could be varied to tune the protruding member assembly in order to achieve a desired level of tactile sensation during use.

In different embodiments, the materials used for a sole member could vary. In some embodiments, a sole member could be made of a rigid material that undergoes little deformation in response to ground contacting forces. For example, in some embodiments, a sole member could comprise a rigid plate. In other embodiments, the sole member could be somewhat flexible. For example, in another embodiment, a sole member could be made of a medium or hard foam that can deform somewhat in response to ground contacting forces. In an exemplary embodiment, the material used for the sole member may be more rigid and therefore undergo less bending, stretching, etc. than at least some components of the protruding member assembly.

Figure 21:
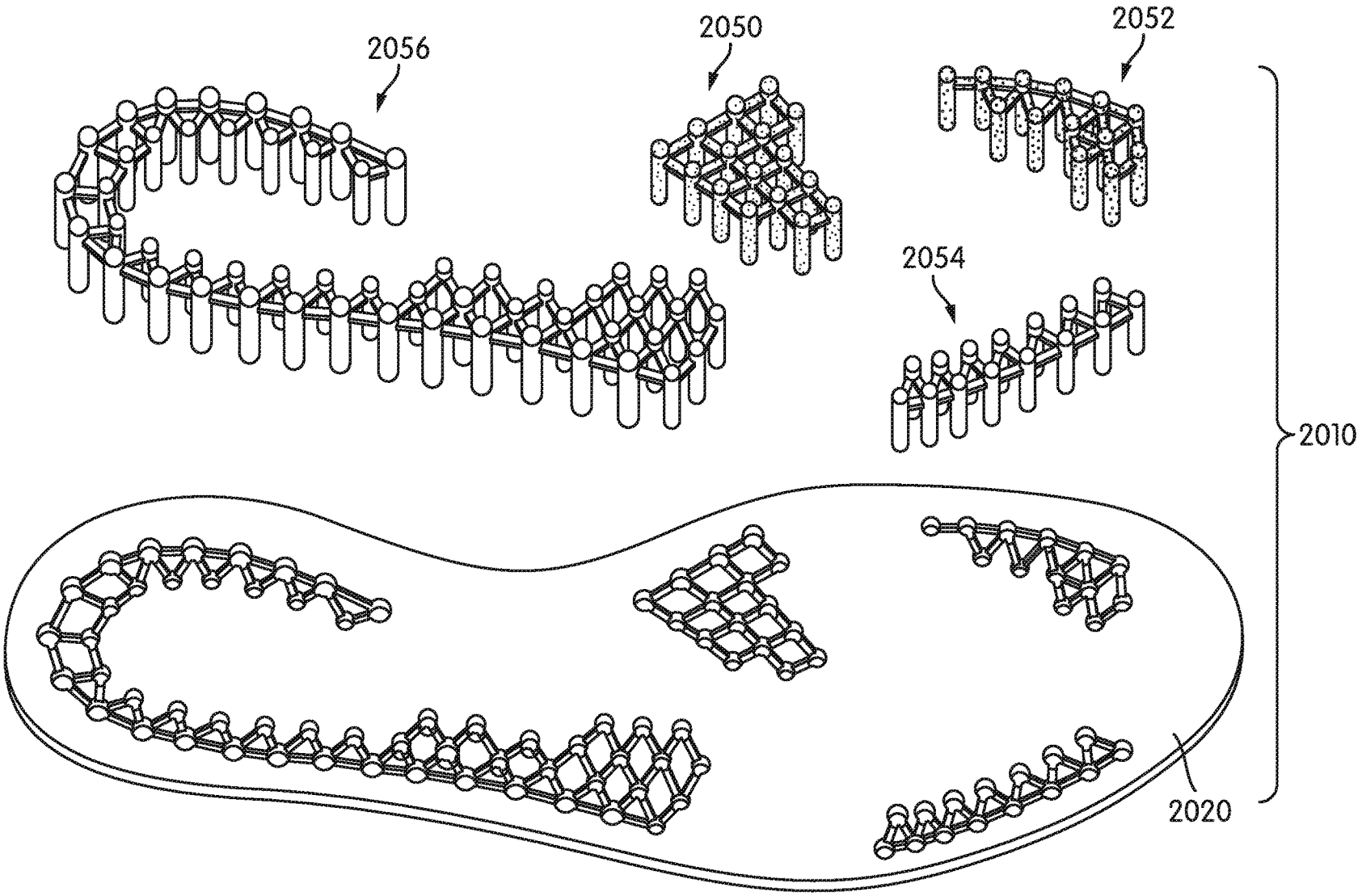
FIG. 21 is an isometric view of another embodiment of a sole system, in which different protruding member assemblies have different material properties.

FIG. 21 illustrates another embodiment of a sole system 2010. Sole system 2010 may be similar to the previous embodiment in some respects. For example, sole system 2010 includes a sole member 2020 and multiple protruding member assemblies. An optional inner member (not shown) could also be included in some embodiments.

In this embodiment, a first protruding member assembly 2050, a second protruding member assembly 2052, a third protruding member assembly 2054 and a fourth protruding member assembly 2056 may be provided to enhance tactile sensation in the manner described above. In some embodiments, the material construction of two or more protruding member assemblies could be different. For example, in this embodiment first protruding member assembly 2050 is made of a first material, second protruding member assembly 2052 is made of a second material, and both third protruding member assembly 2054 and fourth protruding member assembly 2056 are made of a third material. Here, the first material, the second material and the third material are all substantially different.

Each of the first material, the second material and the third material could vary in one or more material characteristics. For example, in some cases, the first material may be substantially more elastic than the second material. Likewise, the second material could be substantially more elastic than the third material. Thus, with this configuration, first protruding member assembly 2050 may more readily deform in response to ground forces than second protruding member assembly 2052. Likewise, both first protruding member assembly 2050 and second protruding member assembly 2052 may more readily deform in response to ground forces than either third protruding member assembly 2054 or fourth protruding member assembly 2056. Thus, sole system 2010 may be more responsive (i.e., may provide more tactile sensation) to motions such as pivoting and medial cutting, than lateral cutting or back pedaling.

Although the embodiment of FIG. 21 illustrates a sole system with disjoint (i.e., completely separated) protruding member assemblies made of different materials, in another embodiment a unitary protruding member assembly could comprise regions of different materials and/or material properties.

In some embodiments, the type and degree of tactile sensation experienced by a wearer may be a function of the density and size of the protruding members. As the size of the protruding members is decreased and their density increased, the resolution of tactile sensations is increased. In other words, with more protruding members that are more densely packed together, the protruding member assembly may be used to sense finer geometric structures in the underlying ground surface. Therefore, while the exemplary embodiments depict some possible combinations of protruding member size and spatial density, in other embodiments the protruding member size and spatial density could be adjusted to achieve a desired resolution in tactile sensation provided to the wearer.

FIGS. 22-29 depict various alternative embodiments of a sole system or components of a sole system. It should be understood that the various features described and shown in FIGS. 22-29 can be incorporated into any of the embodiments discussed herein.

FIG. 22 illustrates an exemplary embodiment of an article of footwear 2200 that may be similar in at least some respects to the embodiment discussed above and shown in FIG. 2. Referring to FIG. 22, article 2200 includes an upper 2202 and a sole system 2210. Sole system 2210 may be further comprised of a sole member 2220 and a protruding member assembly 2250.

However, in contrast to previous embodiments, the embodiment of FIG. 22 specifically depicts a configuration in which a foot 2290 comes into direct contact with a proximal surface 2230 of protruding member assembly 2250. In some embodiments, portions of foot 2290 may also directly contact sole system 2210. In other words, the embodiment of FIG. 22 lacks an insole, liner or other layer that separates foot 2290 and protruding member assembly 2250. Such a configuration may provide increased tactile sense along the bottom of the foot.

Figure 23:
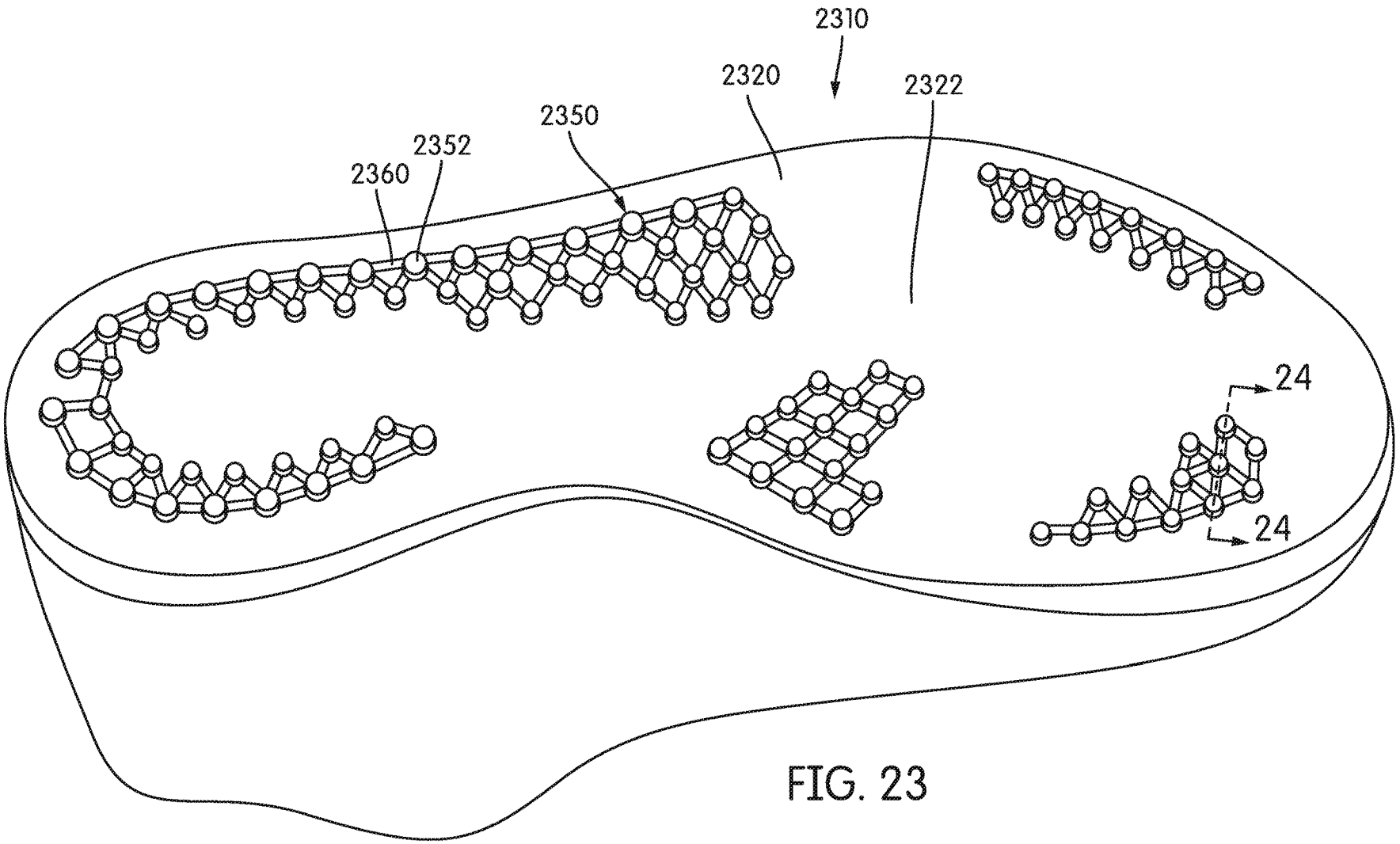
FIG. 23 is a bottom isometric view of an embodiment of a sole system, in which a protruding member assembly includes connecting portions disposed externally on the sole system.
Figure 24:
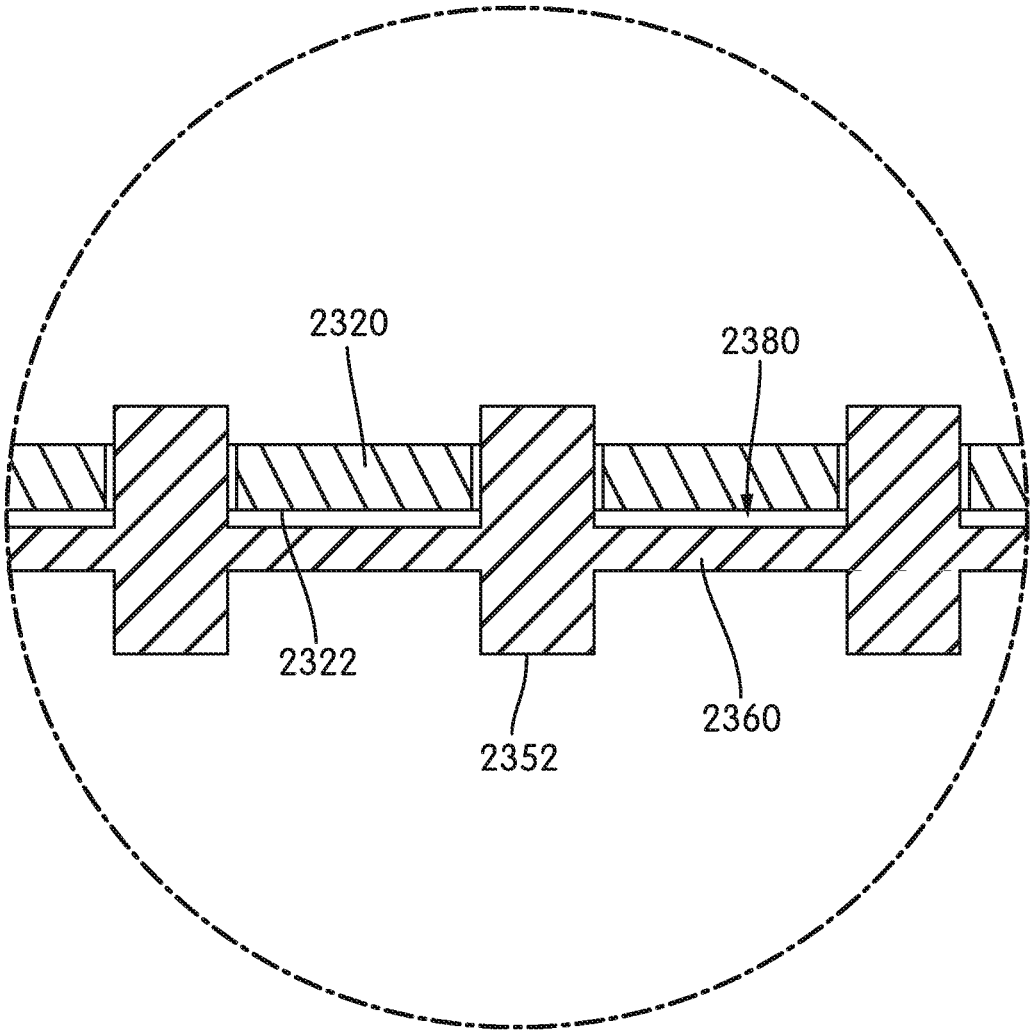
FIG. 24 is a schematic cross-sectional view of a portion of the sole system shown in FIG. 23.
Figure 25:
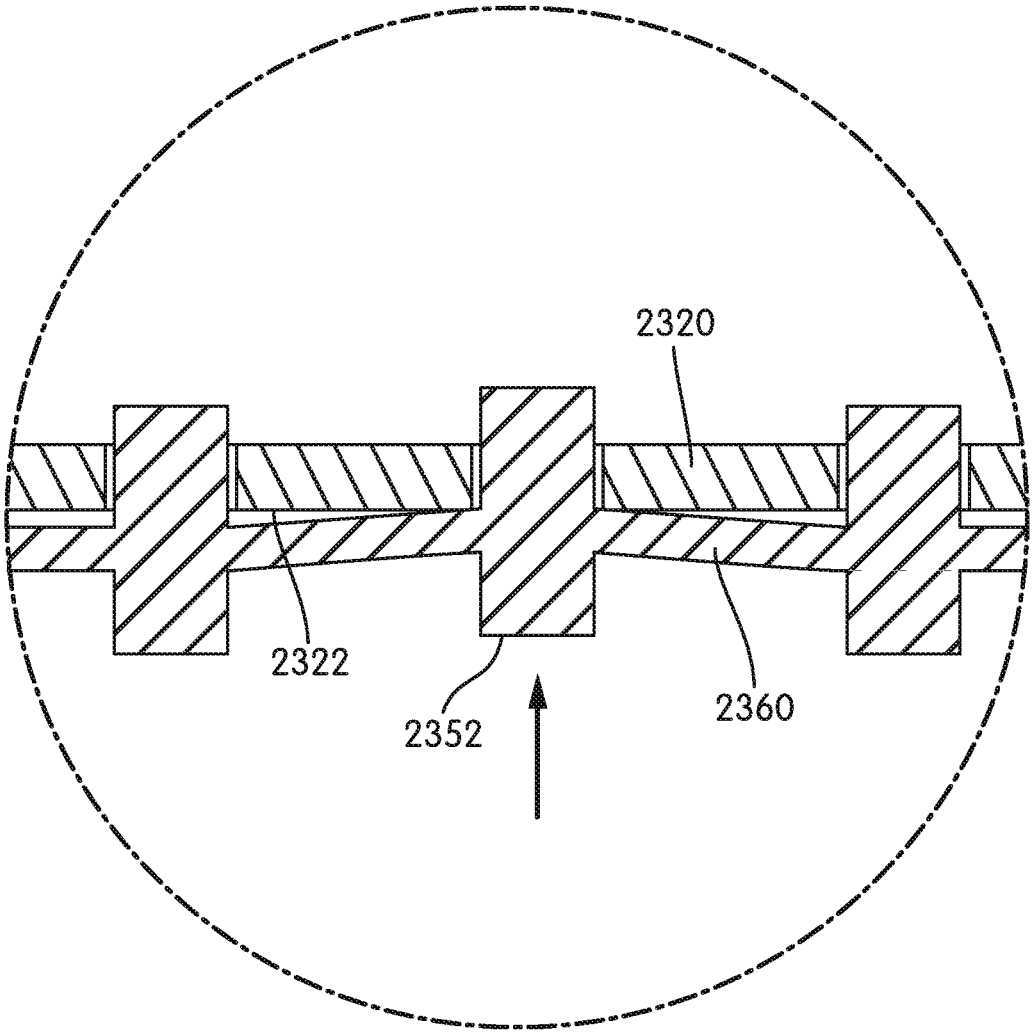
FIG. 25 is a schematic cross-sectional view of a portion of the sole system shown in FIG. 23, in which the protruding member assembly has been depressed.

FIGS. 23-25 illustrate another embodiment for a sole assembly with a protruding member assembly. Referring first to FIG. 23, a sole system 2310 is comprised of a sole member 2320 and a plurality of protruding member assemblies 2350. Moreover, in some embodiments, plurality of protruding member assemblies 2350 may be arranged so that plurality of connecting portions 2360 are disposed on a distal side 2322 of sole member 2320. In other words, plurality of connecting portions 2360 may be exposed on an outer surface of a sole system, rather than being disposed internally to the sole system.

FIGS. 24 and 25 depict a schematic side cross-sectional view of a portion of sole system 2310. As seen in FIGS. 24-25, forces applied to protruding members 2352 may cause at least some protruding members 2352 to be retracted within sole member 2320. In some embodiments, the amount that protruding members 2352 may retract into sole member 2320 may depend on the default (i.e., non-stressed) separation 2380 (see FIG. 24) between plurality of connecting portions 2360 and distal surface 2322 of sole member 2320. Additional factors that may affect the degree of retraction include, but are not limited to: the sizes of the holes, elasticity of connecting portions and/or protruding members as well as possibly other factors.

Figure 26:
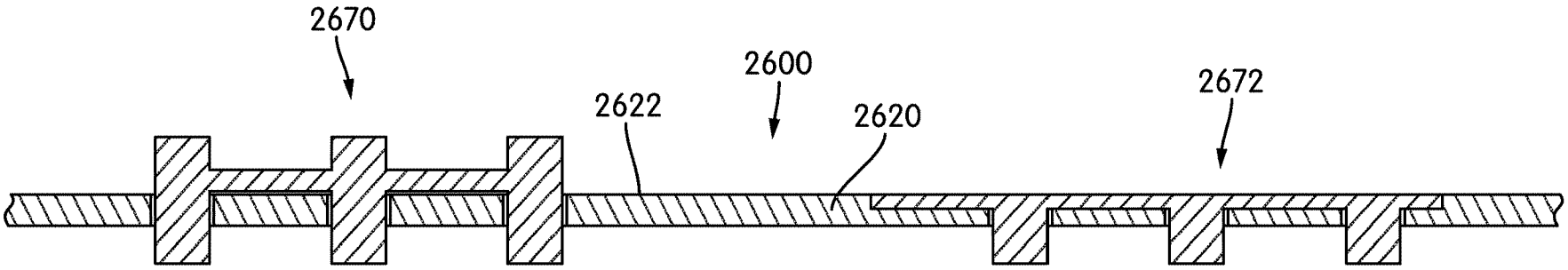
FIG. 26 is a schematic cross-sectional view of a portion of a sole system including a protruding member assembly that is flush with an inner sole surface, according to an embodiment.

In different embodiments, the degree to which portions of a protruding member assembly are raised above a proximal surface of a sole member can vary. FIG. 26 depicts a partial cross-sectional view of an embodiment of a sole system 2600 with various configurations for protruding member assemblies with respect to a proximal surface 2622 of a sole member 2620. In particular, first protruding member assembly 2670 is raised above proximal surface 2622. In contrast, second protruding member assembly 2672 is seen to be approximately flush with proximal surface 2622. In still other embodiments, some or all of a protruding member assembly could be recessed with respect to proximal surface 2622 (i.e., proximal surface 2622 could be closer to a foot than the protruding member assembly in a non-stressed configuration). By varying the degree to which various protruding member assemblies (or their components) are raised or recessed with respect to a proximal side of a sole member, an article can be tuned to accommodate the degree of pressure applied to different portions of a foot by protruding member assemblies. For example, in the example embodiment depicted in FIG. 26, first protruding member assembly 2670 applies pressure at a corresponding portion of a foot even without substantial forces applied by a ground surface. In contrast, the flush configuration for second protruding member assembly 2672 provides little pressure at a corresponding portion of the foot when sole system 2600 is not in contact with a ground surface. Thus, the degree of pressure applied by different protruding member assemblies at different locations of the foot can be tuned to achieve desirable tactile sensations.

As discussed above, protruding members in a protruding member assembly can be joined, or otherwise associated, with one another using a variety of structures. In some embodiments, protruding members may be integrally formed with connecting portions, which can be accomplished using various kinds of molded polymer materials. In other embodiments, however, connecting portions could comprise a variety of different materials as well as possibly different structures to achieve the desired degree of relative flexibility between protruding members.

Figure 27:
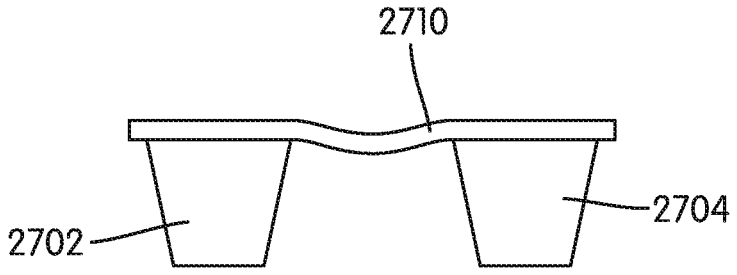
FIG. 27 is a side schematic view of an embodiment of two protruding members connected by a fabric connecting portion.

FIG. 27 is a schematic side view of an embodiment of several components that could comprise a portion of a larger protruding member assembly. Referring to FIG. 27, a first protruding member 2702 may be joined to a second protruding member 2704 by a connecting portion 2710. In this exemplary embodiment, connecting portion 2720 may comprise a textile material, for example: any kinds of woven or non-woven fabrics. In some embodiments, the textile material used for connecting portion 2720 may have some elasticity. However in other embodiments the material may not be substantially elastic.

Figure 28:
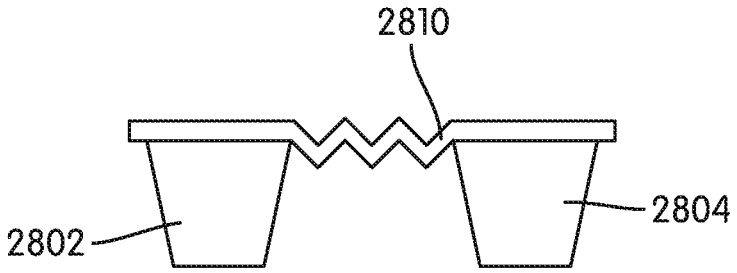
FIG. 28 is a side schematic view of an embodiment of two protruding members connected by a connecting portion with a bellowed geometry.
Figure 29:
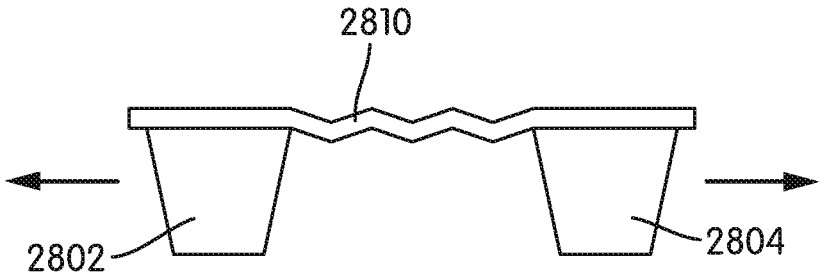
FIG. 29 is a side schematic view of the protruding members of FIG. 28, in which the protruding members are pulled apart by expanding the bellowed geometry of the connecting portion.

It is also contemplated that in some embodiments protruding members could be attached using structures that incorporate a living hinge and/or bellows structure. For example, FIGS. 28 and 29 depict default and stretched configurations, respectively, of components of a protruding member assembly. Referring to FIG. 28, first protruding member 2802 and second protruding member 2804 may be joined by bellowed connecting portion 2810. In particular, bellowed connecting portion 2810 has a bellowed geometry that allows first protruding member 2802 and second protruding member 2804 to separate by a predetermined amount, as shown in FIG. 29. In some embodiments, the bellowed geometry of one or more connecting portions can be selected to achieve a desired degree of stretching between adjacent protruding members under a predetermined force.

Figure 30:
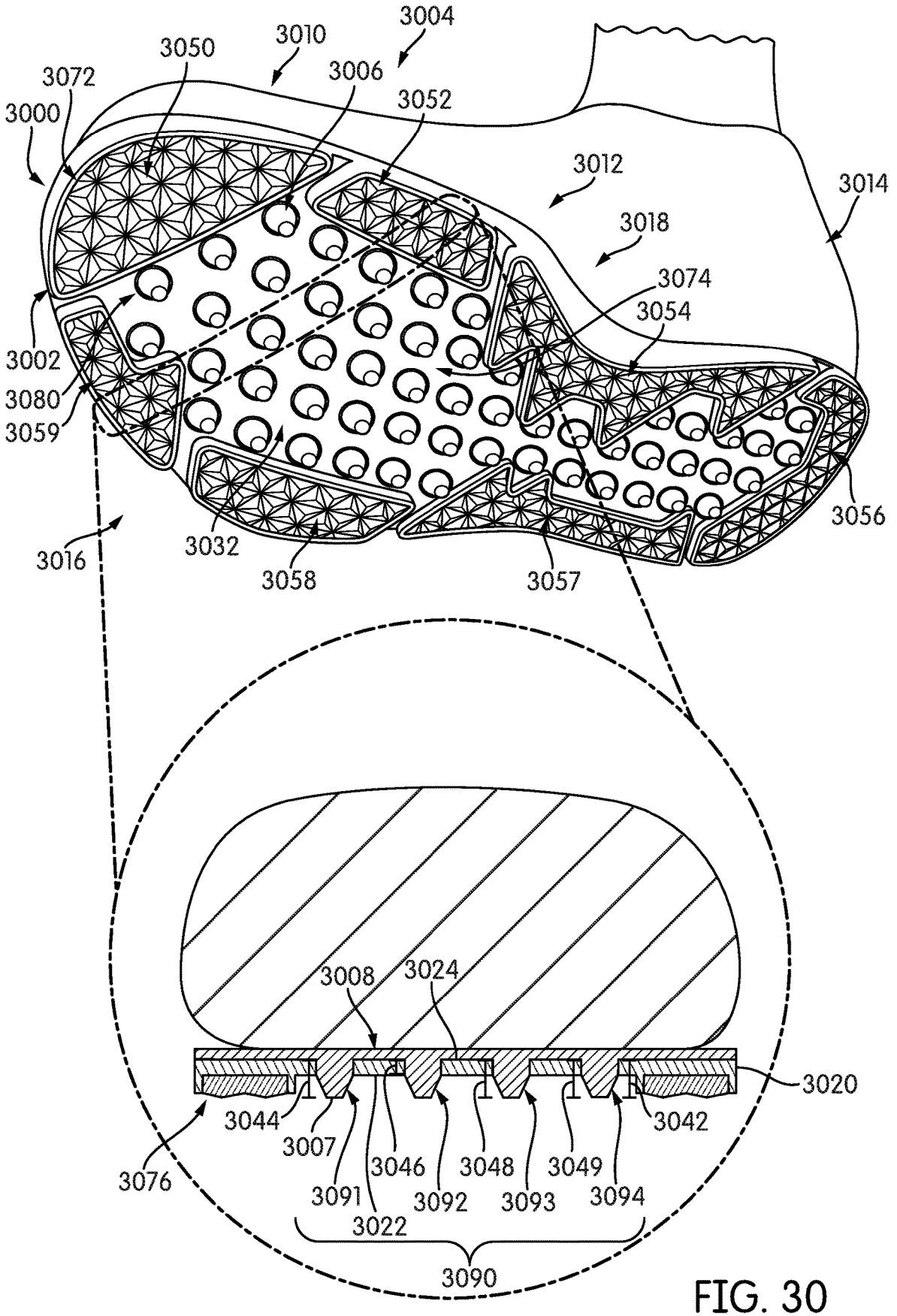
FIG. 30 is a bottom isometric view of an embodiment of a sole system in which the sole member includes a plurality of raised portions.

In different embodiments, other features may be included in a sole system. FIG. 30 illustrates an isometric bottom view of another embodiment of some components of a sole system 3000. Sole system 3000 includes a sole member 3020. Sole member 3020 includes an outwardly facing surface 3022 and an inwardly facing surface 3024. Sole member 3020 may further include provisions for receiving a plurality of protruding members 3006 and corresponding connecting portions 3008, as discussed earlier. For example, sole member 3020 may include a plurality of holes 3080 for receiving protruding members 3006. Other embodiments of sole member 3020 can also include a plurality of recesses for receiving connecting portions 3008 along inwardly facing surface 3024 (see for example FIG. 18).

Thus, as in previous embodiments, sole system 3000 includes protruding members 3006 connected by connecting portions 3008. Furthermore, in some embodiments, sole member 3020 may include multiple components or elements which may individually or collectively provide an article of footwear ("article") 3004 with a number of attributes, such as support, rigidity, stability, traction, grip, balance, comfort, or other attributes. In some embodiments, sole member 3020 may include structural features that facilitate a wearer's interactions with different types of ground surfaces.

For purposes of reference, in FIG. 30, outwardly facing surface 3022 of sole member 3020 comprises a base portion 3032 extending in a substantially continuous manner from a forefoot region 3010 to a heel region 3014. In addition, sole member 3020 can have one or more raised portions 3002 formed along outwardly facing surface 3022. Raised portions 3002 can comprise portions of material joined, attached, or integrally formed with sole member 3020. In some embodiments, raised portions 3002 can have a greater stiffness relative to base portion 3032. Raised portions 3002 can have various sizes (i.e., volume and/or surface area) and can have greater height(s) relative to base portion 3032. Each raised portion can provide specialized stability or support to different regions of sole member 3020. In some embodiments, base portion 3032 may correspond to regions of outwardly facing surface 3022 in which holes 3080 are formed, and in which no raised portions 3002 are located.

In some embodiments, there can be one or more raised portions 3002 positioned along outwardly facing surface 3022 of sole member 3020. Generally, sole member 3020 may comprise any number of raised portions 3002. In some cases, sole member 3020 can comprise two or more raised portions 3002. In other cases, sole member 3020 can comprise three to ten raised portions 3002. In still other embodiments, however, sole member 3020 may include a single, continuous raised portion that extends across multiple regions of sole member 3020. In one embodiment, as shown in FIG. 30, sole member 3020 includes a first raised portion 3050, a second raised portion 3052, a third raised portion 3054, a fourth raised portion 3056, a fifth raised portion 3057, a sixth raised portion 3058, and a seventh raised portion 3059. With this arrangement, sole member 3020 may provide varying degrees of interaction with a ground surface for different portions of sole member 3020. In other embodiments, however, one or more of raised portions 3002 may be omitted.

In some embodiments, the use of disjointed or disconnected raised portions 3002 may allow for a variety of possible arrangements on sole member 3020. In other words, raised portions 3002 may be disposed along different regions of sole member 3020 to configure a sole member for use in different activities or environments. In the embodiment of FIG. 30, first raised portion 3050 and fourth raised portion 3056 extend across both a medial side 3018 and a lateral side 3016 of sole member 3020. Thus, first raised portion 3050 is located in forefoot portion 3010 and extends from medial side 3018 to lateral side 3016. In addition, fourth raised portion 3056 is located in heel portion 3014 and extends from medial side 3018 to lateral side 3016. Furthermore, second raised portion 3052 and third raised portion 3054 are disposed along medial side 3018, while fifth raised portion 3057, sixth raised portion 3058, and seventh raised portion 3059 are disposed along lateral side 3016. Specifically, in one embodiment, second raised portion 3052 can extend between forefoot portion 3010 and midfoot portion 3012 along medial side 3018, while third raised portion 3054 can extend between midfoot portion 3012 and heel portion 3014 along medial side 3018. In addition, fifth raised portion 3057 extends between midfoot portion 3012 and heel portion 3014 along lateral side 3016, sixth raised portion 3058 extends from midfoot portion 3012 toward forefoot portion 3010 along lateral side 3016, and seventh raised portion 3059 extends through forefoot portion 3010 along lateral side 3016.

Furthermore, in some embodiments, raised portions 3002 can be disposed along an outer peripheral portion 3072 of sole member 3020, where outer peripheral portion 3072 is associated with the outer edge of the sole member. In other words, in one embodiment, each of plurality of raised portions 3002 are positioned adjacent to an outer edge of the sole member. Furthermore, in some embodiments, raised portions 3002 may not extend into a central portion 3074 of sole member 3020. This arrangement can allow sole system 3000 greater flexibility and cushioning in central portion 3072 relative to peripheral portion 3072 in some embodiments. However, in other embodiments, raised portions 3002 may extend across the lateral width of sole member 3020, from medial side 3018 to lateral side 3016, through central portion 3072.

Thus, in some embodiments, sole member 3020 may include elements that form regions of varying height, thickness, and width in sole system 3000. In different embodiments, the geometry of one raised portion can differ from another raised portion. For example, the size and dimensions of first raised portion 3050 and second raised portion 3052 can vary relative to one another. In some embodiments, a raised portion can have a regular or irregular horizontal cross-sectional shape (where the cross-section is taken along a plane substantially parallel to base portion 3032). In one embodiment, first raised portion 3050 has an approximately semi-circular or half-circle horizontal cross-sectional shape (where the cross-section is taken in a substantially horizontal plane over nearly the entire height of first raised portion 3050). In contrast, second raised portion 3052 has a substantially horizontal polygonal cross-sectional shape (where the cross-section is taken in a substantially horizontal plane over nearly the entire height of second raised portion 3052). However, in other embodiments, each raised portion can have any other three-dimensional geometry, including cuboid, conical, pyramidal, prism-shaped, or other regular or irregular three-dimensional shapes.

In some embodiments, the texture of the outer surfaces of each raised portion may be substantially smooth or generally untextured surfaces. However, in other embodiments, some outer surfaces of raised portions can exhibit textures or other surface characteristics, such as dimpling, protrusions, ribs, ridges, securing elements, nubs, or various patterns. In some embodiments, for example, first raised portion 3050 may comprise a pattern of undulations or bumps, or other types of texturing. In some cases there may be traction enhancing elements disposed or formed along an outer surface of first raised portion 3050, for example. In FIG. 30, a first series of traction elements ("first traction elements") 3080 are form portions of a distal surface 3076 of each of raised portions 3002, where the distal surface provides the ground-contacting surface of raised portions 3002. In some cases, first traction elements 3080 can improve stability or grip on a ground surface. In FIG. 30, first traction elements 3080 have a texture formed from tessellated triangles or pyramids. In other embodiments, however, first traction elements 3080 formed on a raised portion can have any of a variety of textures, formed from either regular geometric shapes or shapes that are irregular. In some embodiments, one or more portions of distal surface 3076 of a raised portion may not include first traction elements 3080 and can be substantially smooth or flat.

Referring to the cross-sectional view of article 3004 included in FIG. 30, second raised portion 3052 has a distal surface that extends downward a first distance 3042 from inwardly facing surface 3024 of sole member 3020, and seventh raised portion 3059 has a distal surface that extends downward a second distance 3044 from inwardly facing surface 3024 of sole member 3020. First distance 3042 and second distance 3044 may be substantially similar in some embodiments, or can differ in other embodiments. In FIG. 30, it can be seen that first distance 3042 is substantially similar to second distance 3044. However, in other embodiments, first distance 3042 can be greater than or less than second distance 3044.

In addition, base portion 3032 extends downward a third distance 3046 from inwardly facing surface 3024 of sole member 3020. In some embodiments, third distance 3046 can differ relative to first distance 3042 or second distance 3044. In FIG. 30, it can be seen that first distance 3042 is substantially greater than third distance 3046, and second distance 3044 is substantially greater than third distance 3046.

Furthermore, the cross-sectional view of article 3004 also depicts a group of protruding members ("protruding members group") 3090. Protruding members group 3090 is located between the two raised portions in the cross-section of FIG. 30, and includes a first protruding member 3091, a second protruding member 3092, a third protruding member 3093, and a fourth protruding member 3094. A distal end of each protruding member of protruding members group 3090 extends downward (or distally) relative to sole member 3020. In one embodiment a distal end 3007 of first protruding member 3091 extends downward a fourth distance 3048 from inwardly facing surface 3024 of sole member 3020. In some embodiments, fourth distance 3048 can differ relative to third distance 3046. In FIG. 30, it can be seen that fourth distance 3048 is substantially greater than third distance 3046. Additionally, in some embodiments, fourth distance 3048 can be substantially similar to or differ relative to first distance 3042 or second distance 3044. In one embodiment, fourth distance 3048 is at least as great as first distance 3042 or second distance 3044. In FIG. 30, it can be seen that fourth distance 3048 is substantially similar to both first distance 3042 and second distance 3044.

Moreover, in various embodiments, second raised portion 3052, seventh raised portion 3059, or other raised portions can include a thickness and comprise a substantially continuous material. However, it should be understood that in other embodiments, raised portions 3002 may be substantially or entirely hollow, or include hollowed compartments. This may decrease the weight of sole system 3000 in some embodiments. In addition, raised portions 3002 can comprise a separate portion or segment of material that is inserted into different regions of sole member 3020 in some embodiments. In one embodiment, sole member 3020 can include recesses or regions bounded by raised sidewalls that are configured to receive raised portions 3002.

Furthermore, in some embodiments, the thickness of a raised portion can be generally consistent over the height of the raised portion, as shown in the cross-sectional view of article 3004 included in FIG. 30. For example, while there are some variations or small undulations as a result of the first traction elements 3080, the thickness of second raised portion 3052 is substantially constant. However, in other embodiments, raised portions 3002 can include regions of lesser thickness or greater thickness. In addition, the size of the outer surface area of each distal surface 3076 of a raised portion can differ. In some embodiments, the distal surface of first raised portion 3050 can be substantially similar in area to the distal surface of second raised portion 3052, for example. However, in other embodiments, as shown in FIG. 30, the area of the distal surface of first raised portion 3050 is greater than the area of the distal surface of second raised portion 3052. In addition, in some embodiments, the volume of first raised portion 3050 can be larger than that of second raised portion 3052.

In some embodiments, the area of the distal surface of a raised portion may be greater than the surface area associated with a distal end of a protruding member. In some embodiments, the distal surface of the raised portion may have an area that is ten times greater than the surface area associated with the distal end of the protruding member. In other embodiments, the distal surface of the raised portion may have an area that is greater than the surface area associated with the distal end of the protruding member by a factor of twenty, fifty, one hundred, or more. In other words, as shown in FIG. 30, a surface area of the distal surface of first raised portion 3050 can be much greater than the surface area of distal end 3007 of first protruding member 3091.

In addition, as shown in previous embodiments, one or more protruding members can have a tapered shape, where the protruding member is wider toward the proximal ends and increasingly narrow toward the distal ends. Referring to the magnified cross-section of FIG. 31, for example, in one embodiment, protruding member 3183 has a first horizontal cross-sectional area associated with a proximal end portion 3187 of protruding member 3183 that is greater than a second horizontal cross-sectional area of a distal end portion 3185 of protruding member 3183, where distal end portion 3185 is positioned outward from proximal end portion 3187. In contrast, a raised portion can have a substantially uniform horizontal cross-sectional area, as shown in FIG. 30.

Figure 31:
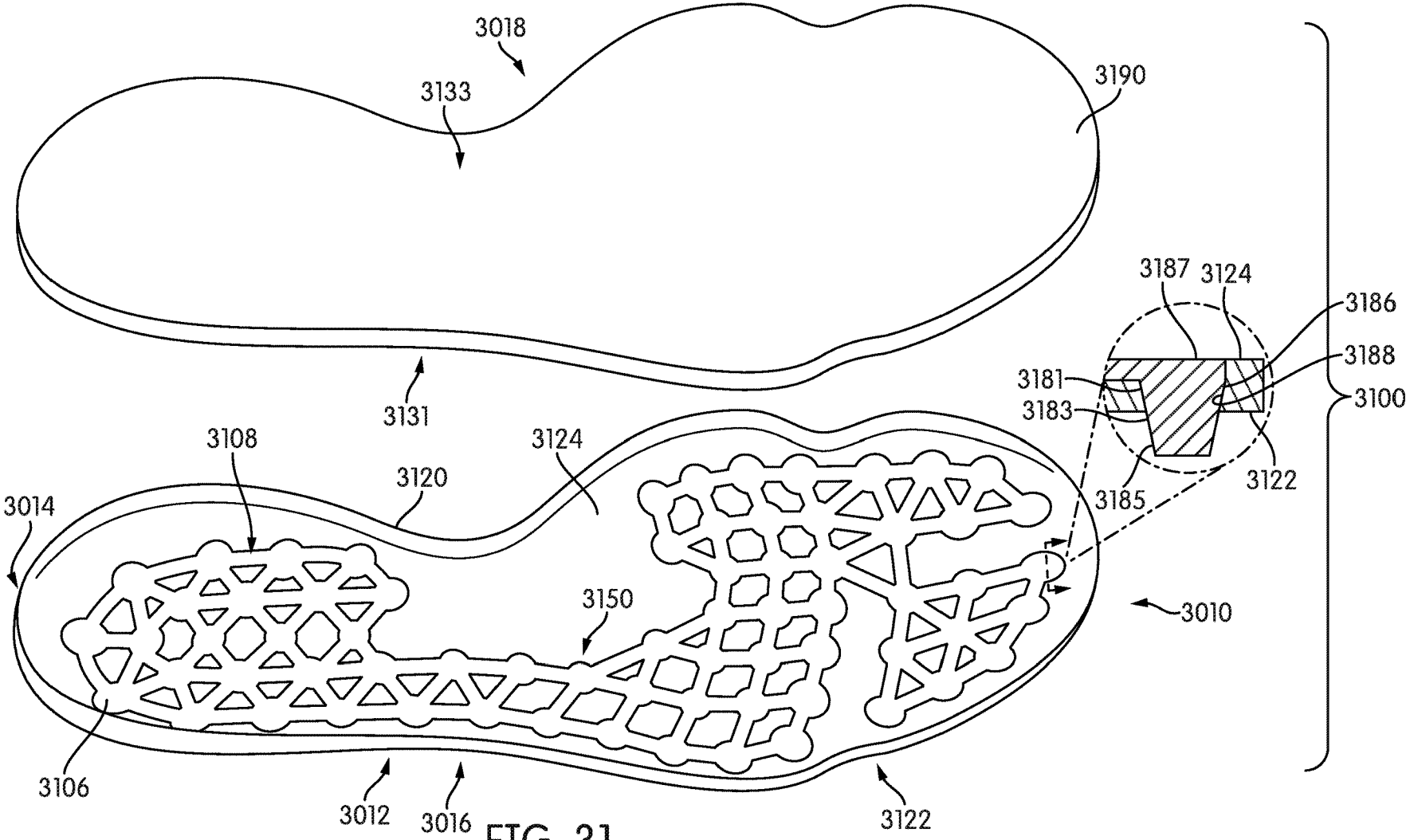
FIG. 31 is an isometric view of an embodiment of a sole member and an inner member.
Figure 32:
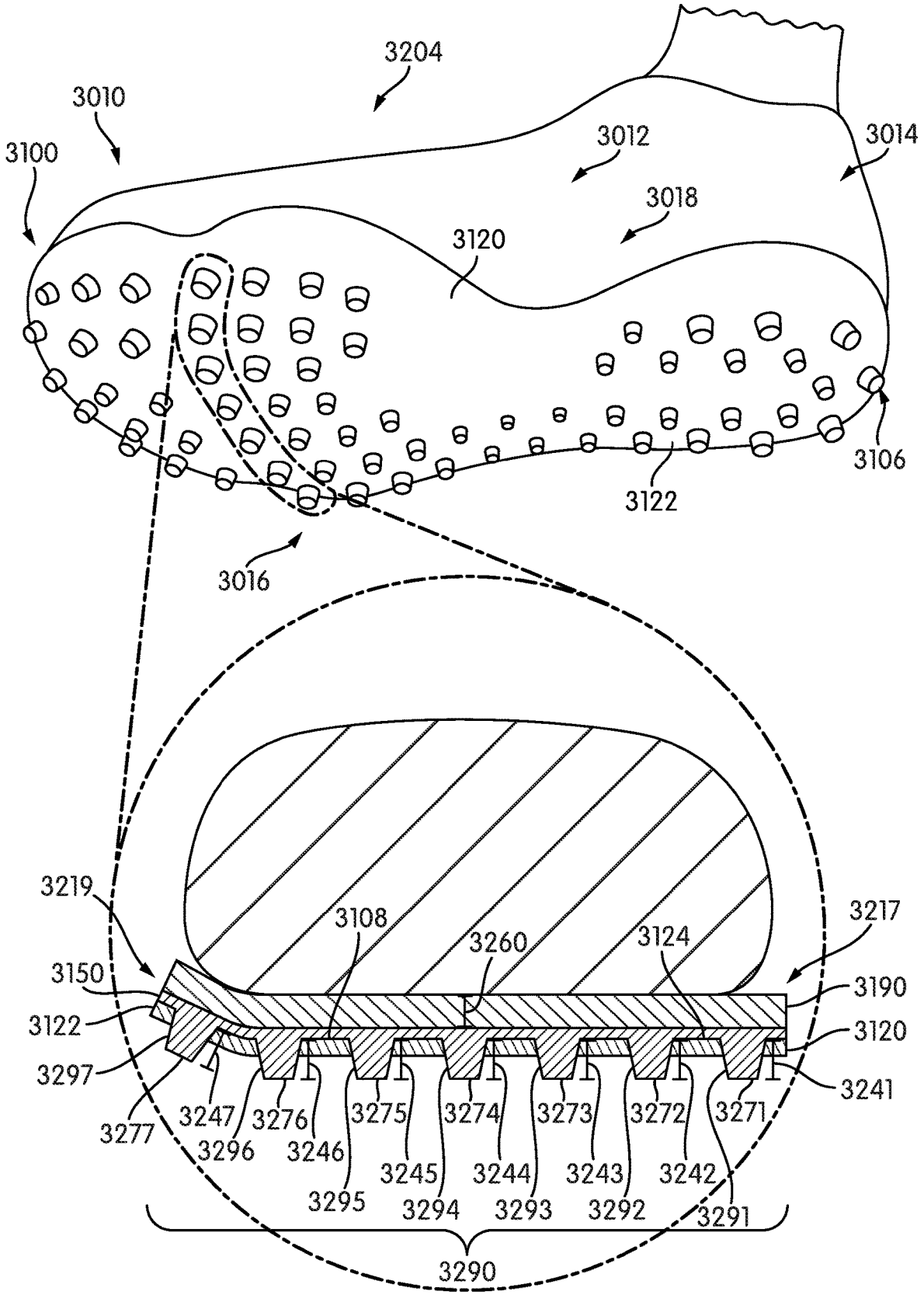
FIG. 32 is a bottom isometric view of an embodiment of a sole system.
Figure 33:
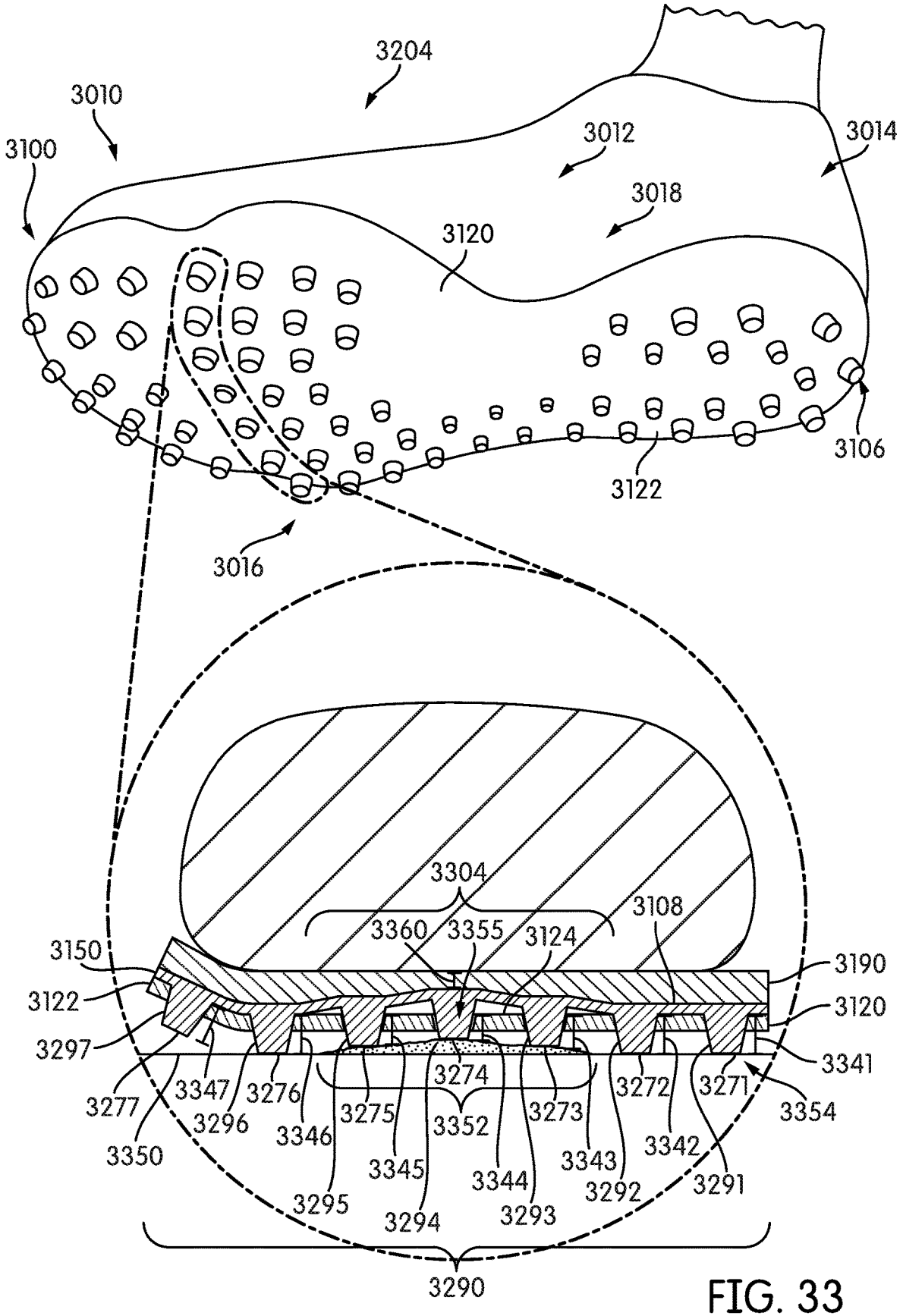
FIG. 33 is a bottom isometric view of an embodiment of a sole system experiencing compression.

In different embodiments, other features may be included in a sole system. FIGS. 31-33 illustrate another possible embodiment of a sole system 3100. Sole system 3100 includes a sole member 3120. Sole member 3120 includes an outwardly facing surface 3122 and an inwardly facing surface 3124. Sole member 3120 may further include provisions for receiving a plurality of protruding members 3106 and corresponding connecting portions 3108, as discussed earlier. For example, sole member 3120 may include a plurality of holes 3181 for receiving protruding members 3106.

Thus, as in previous embodiments, sole system 3100 includes protruding members 3106 connected by connecting portions 3108. FIG. 31 illustrates one possible arrangement for the embodiment of sole system 3100, in which each protruding member may confront, or be disposed directly adjacent to, an interior surface of a corresponding hole. In addition, FIG. 31 depicts a protruding member assembly 3150 that comprises plurality of protruding members 3106 that are connected to one another by a plurality of connecting portions 3108. In the current embodiment, a protruding member 3183 includes an exterior surface 3186 that confronts an interior surface 3188 of a hole 3181 (referred to herein as an intermediate portion). Although this embodiment shows a relatively snug fit between protruding member 3183 and hole 3181, in other embodiments some or all of exterior surface 3186 could be spaced apart from interior surface 3188 of hole 3181. Thus, in some other embodiments, protruding member 3183 could "float" within hole 3181 and be suspended by adjacent connecting portions.

Furthermore, as noted previously, a sole system may include an inner member in some embodiments. In FIGS. 31-33, an inner member 3190 is shown. In different embodiments, inner member 3190 could be configured as a variety of different footwear components including, but not limited to: an insole or a sockliner. Thus, inner member 3190 may be configured to provide enhanced support for a foot as well as increased cushioning and comfort. In some embodiments, inner member 3190 may be primarily associated with sole system 3100 (e.g., inner member 3190 may be a midsole or an insole). In other embodiments, inner member 3190 may be primarily associated with an upper for an article of footwear (e.g., inner member 3190 may be a part of a sockliner). In some embodiments, inner member 3190 could comprise all or part of a slip last or strobel.

In some embodiments, inner member 3190 may be a full length member, which extends from forefoot portion 3010 to heel portion 3014 of sole system 3100, as shown in FIG. 31. In other embodiments, however, inner member 3190 could be a partial length member that extends through some portions of sole system 3100, but not others. As one example, in one embodiment, inner member 3190 could extend through only forefoot portion 3010. In another embodiment, inner member 3190 could extend through only heel portion 3014.

When used in an article of footwear, inner member 3190 may be disposed between a foot and other components of sole system 3100, including both sole member 3120 and protruding member assembly 3150. In some embodiments, protruding member assembly 3150 is positioned between sole member 3120 and inner member 3190. A distal side 3131 of inner member 3190 can confront, be disposed adjacent to, or otherwise face toward sole member 3120 as well as protruding member assembly 3150. In addition, a proximal side 3133 of inner member 3190 can face towards a foot and/or additional layers such as a strobel or other liner. In other words, distal side 3131 of inner member 3190 is disposed nearer to protruding member assembly 3150 than proximal side 3133 of inner member 3190. In some cases, proximal surface 3133 may directly contact a foot during use.

Furthermore, when assembled, plurality of connecting portions 3108 can be disposed between distal side 3131 of sole member 3120 and inwardly facing surface 3124 of sole member 3120. In addition, in one embodiment, the proximal end portions ("proximal ends") of plurality of protruding members 3106 can be configured to contact distal side 3131 of inner member 3190 when sole system 3100 is assembled.

As noted previously, in some embodiments, protruding member assembly 3150 may be configured in a manner that allows the assembly to flex, bend, deflect, twist or otherwise undergo an elastic deformation. In some embodiments, this can be achieved through the use of an inner member that is readily deformable when a pressure or force is applied to nearby protruding members. Thus, in some embodiments, inner member 3190 can be configured to facilitate relative movements between adjacent protruding members.

FIG. 32 illustrates an isometric bottom view of an article of footwear ("article") 3204 with sole system 3100, as well as a magnified cross-section of a portion of article 3204. The cross-section depicts an embodiment of protruding member assembly 3150 in a first state, where the first state is an initial or neutral state in which a (minimal) first degree of compressive force is applied to the distal ends of each the protruding members. When article 3204 is placed on a substantially flat or smooth surface, or when article 3204 is not in contact with a ground surface, protruding member assembly 3150 may comprise an approximately flat configuration, where the protruding members extend an initial distance relative to inwardly facing surface 3124 of sole member 3120.

In FIG. 32, the cross-sectional view of article 3204 depicts a group of protruding members ("protruding members group") 3290. Protruding members group 3290 is disposed between a medial peripheral edge 3219 and a lateral peripheral edge 3217 of sole member 3220, and includes a first protruding member 3291, a second protruding member 3292, a third protruding member 3293, a fourth protruding member 3294, a fifth protruding member 3295, a sixth protruding member 3296, and a seventh protruding member 3297. A distal end of each protruding member of protruding members group 3290 extends downward (distally) relative to sole member 3120.

As seen in FIG. 32, in which the first degree compression is applied uniformly to the bottom of sole system 3100, plurality of protruding members 3106 are all fully extended from outwardly facing surface 3122 of sole member 3120. In one embodiment, and relative to outwardly facing surface 3122 of sole member 3120, a first distal end 3271 of first protruding member 3291 extends downward a first distance 3241, a second distal end 3272 of second protruding member 3292 extends downward a second distance 3242, a third distal end 3273 of third protruding member 3293 extends downward a third distance 3243, a fourth distal end 3274 of fourth protruding member 3294 extends downward a fourth distance 3244, a fifth distal end 3275 of fifth protruding member 3295 extends downward a fifth distance 3245, and a sixth distal end 3276 of sixth protruding member 3296 extends downward a sixth distance 3246. In contrast, a seventh distal end 3277 of a seventh protruding member 3297 extends generally diagonally, downward and outward toward lateral side 3016, a seventh distance 3247 from outwardly facing surface 3122 of sole member 3120.

In FIG. 32, it can be seen that in the initial (first) state, each of first distance 3241, second distance 3242, third distance 3243, fourth distance 3244, fifth distance 3245, sixth distance 3246, and seventh distance 3247 are substantially similar. However, it should be understood that depending on the configuration of protruding member assembly 3150 and the dimensions of various protruding members, where some may be longer than others for example, the distances may differ from one another in other embodiments.

FIG. 33 illustrates sole system 3100 and protruding member assembly 3150 in a second state, where the second state is an at least partially compressed or responsive state in which the distal end of one or more protruding members experience a second degree of compression that is greater than the first degree of compression of FIG. 32. As seen in FIG. 33, when protruding member assembly 3150 is placed on contoured or irregular surfaces, the geometry of protruding member assembly 3150 can change to accommodate (or match) the geometry of the surface in some cases. In one embodiment, and relative to outwardly facing surface 3122 of sole member 3120, first distal end 3171 of first protruding member 3091 extends downward an eighth distance 3341, second distal end 3172 of second protruding member 3092 extends downward an ninth distance 3342, third distal end 3173 of third protruding member 3093 extends downward a tenth distance 3343, fourth distal end 3174 of fourth protruding member 3094 extends downward an eleventh distance 3344, fifth distal end 3175 of fifth protruding member 3095 extends downward a twelfth distance 3345, sixth distal end 3176 of sixth protruding member 3096 extends downward a thirteenth distance 3346, and seventh distal end 3177 of seventh protruding member 3097 extends downward and outward a fourteenth distance 3347. In FIG. 33, it can be seen that in the second (responsive) state, each of eighth distance 3341, ninth distance 3342, tenth distance 3343, eleventh distance 3344, twelfth distance 3345, thirteenth distance 3346, and fourteenth distance 3347 can differ from one another. Furthermore, one or more of the distances may differ from their value in the first state depicted in FIG. 32.

Thus, as the protruding members contact an uneven ground surface, one or more the protruding members may move relative to sole member 3120. In other words, one or more protruding members can be displaced from their configuration in the first state to their configuration in the second state. As shown in FIG. 33, the distal ends of third protruding member 3293, fourth protruding member 3294, and fifth protruding member 3295 are in contact with a bumpy region 3352 of a ground surface, while first protruding member 3291, second protruding member 3292, sixth protruding member 3296, and seventh protruding member 3297 are either in contact with other, generally uniform (i.e., level or even) regions 3354 of the ground surface, or do not contact the ground surface.

In some embodiments, bumpy region 3352 can provide a compressive force to sole system 3100. In the current embodiment, the distances of downward extension associated with protruding members that contact bumpy region 3352 can be less than the distances of downward extension associated with protruding members that do not contact bumpy region 3352. Because of the flexibility of protruding member assembly 3150, the upward displacement or movement of protruding members may primarily occur at localized regions where forces or pressures are directly applied (e.g., along the protruding members that contact bumpy region 3352). Thus, for example, first protruding member 3291, which is some distance away from bump region 3352 when the force of second degree compression is applied, is not displaced.

In some embodiments, the varying compressive forces associated with the pressure exerted through contact with bumpy region 3352 can help push a first set 3304 of protruding members comprising of third protruding member 3293, fourth protruding member 3294, and fifth protruding member 3295, upward and into sole member 3120. As seen by comparing FIG. 32 and FIG. 33, third distance 3243 may be greater than tenth distance 3343, fourth distance 3244 may be substantially greater than eleventh distance 3344, and fifth distance 3245 may be greater than twelfth distance 3345. The decrease in distances from the first state to the second state may be proportional to the magnitude of the compressive force applied to the individual protruding member. For example, in FIG. 33, the highest point (i.e., a peak 3355) of bumpy region 3350 contacts fourth protruding member 3294, which provides the highest magnitude of compressive force. It can be seen that ninth distance 3343 of downward extension is smallest relative to the distances of downward extension of the other protruding members of first set 3304 as a result of the greater force that is applied to fourth protruding member 3294.

As noted previously, inner member 3190 can be configured to accommodate the changes or movement of different protruding members. Thus, in one embodiment, the compressibility and/or deformability of inner member 3190 may facilitate the movement of protruding members. In other words, in some embodiments, inner member 3190 may receive a portion or all of a proximal end of a protruding member as the protruding member experiences a compressive force at its distal end. In FIG. 33, for example, the protruding members of first set 3304 are compressed and pushed upward. This displacement is permitted at least in part by the compressibility of inner member 3190, which deforms and accommodates the protruding members as they move upward. When distal side 3131 of inner member 3190 is pressed by a proximal end of a protruding member, it can deform inward (i.e., in the direction toward a foot). For example, as fourth protruding member 3194 is pushed upward, a corresponding proximal end of fourth protruding member 3194 presses against distal side 3131 of inner member 3190. It can be seen that relative to a resting or first thickness 3260 of inner member 3190 nearest fourth protruding member 3194 in FIG. 32, a second thickness 3360 of inner member 3190 is decreased as the compressive force is applied. However, in regions of inner member 3190 where the force is not applied, the thickness of inner member 3190 may not decrease in some embodiments. Thus, while deformation occurs in a first segment 3390 of inner member 3190 associated with first set 3304, little or no deformation may occur in the remainder of inner member 3190 that does not experience similar compressive forces. In some embodiments, only distal side 3131 of the inner member 3190 may be configured to deform in the second state. However, in other embodiments, substantially the entire thickness of inner member 3190 (from distal side 3131 to proximal side 3133) may be configured to undergo deformation. In some embodiments, inner member 3190 may be formed from a polymer foam material, or may be formed to include a polymer foam material.

Figure 34:
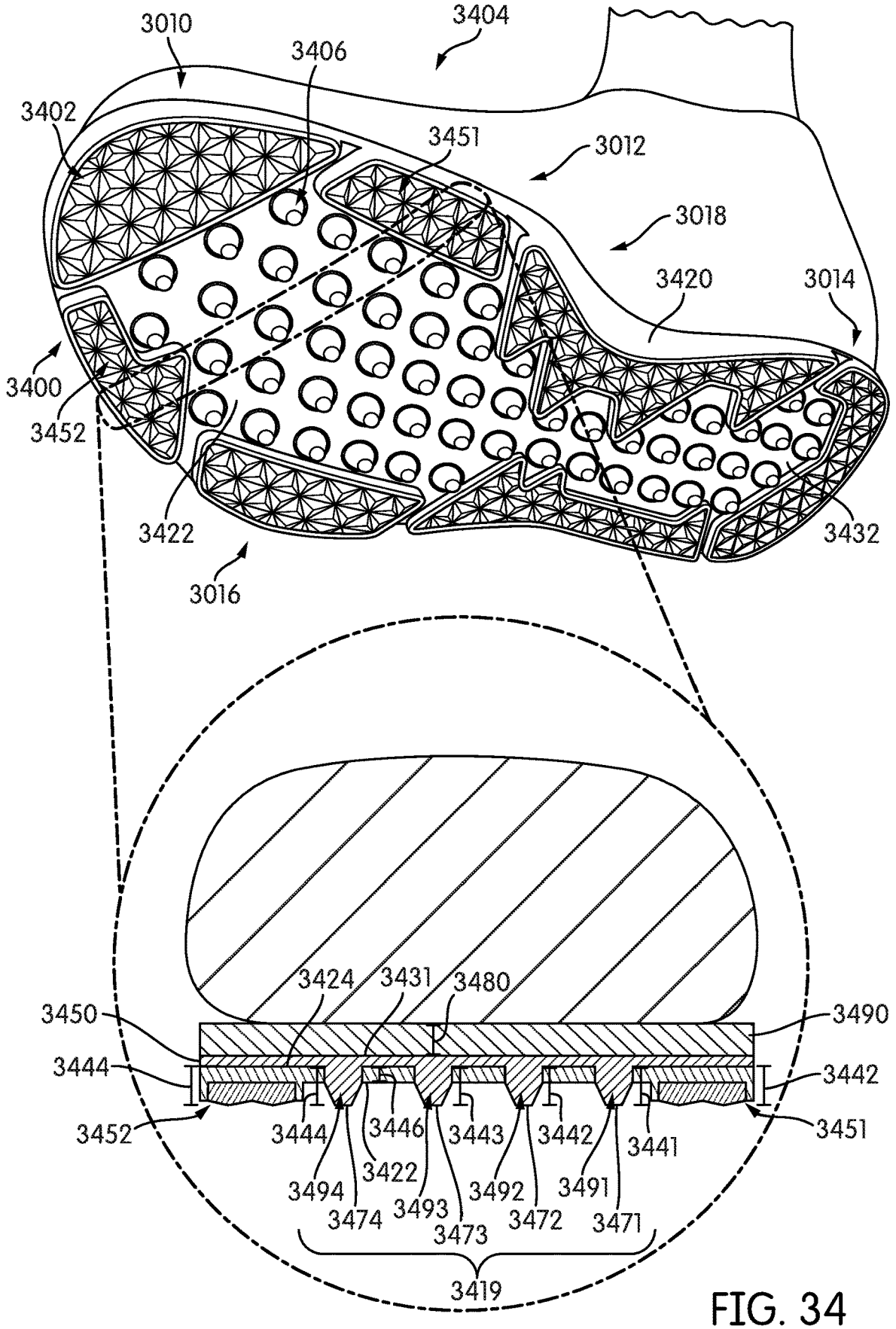
FIG. 34 is a bottom isometric view of an embodiment of a sole system in which the sole member includes a plurality of raised portions.
Figure 35:
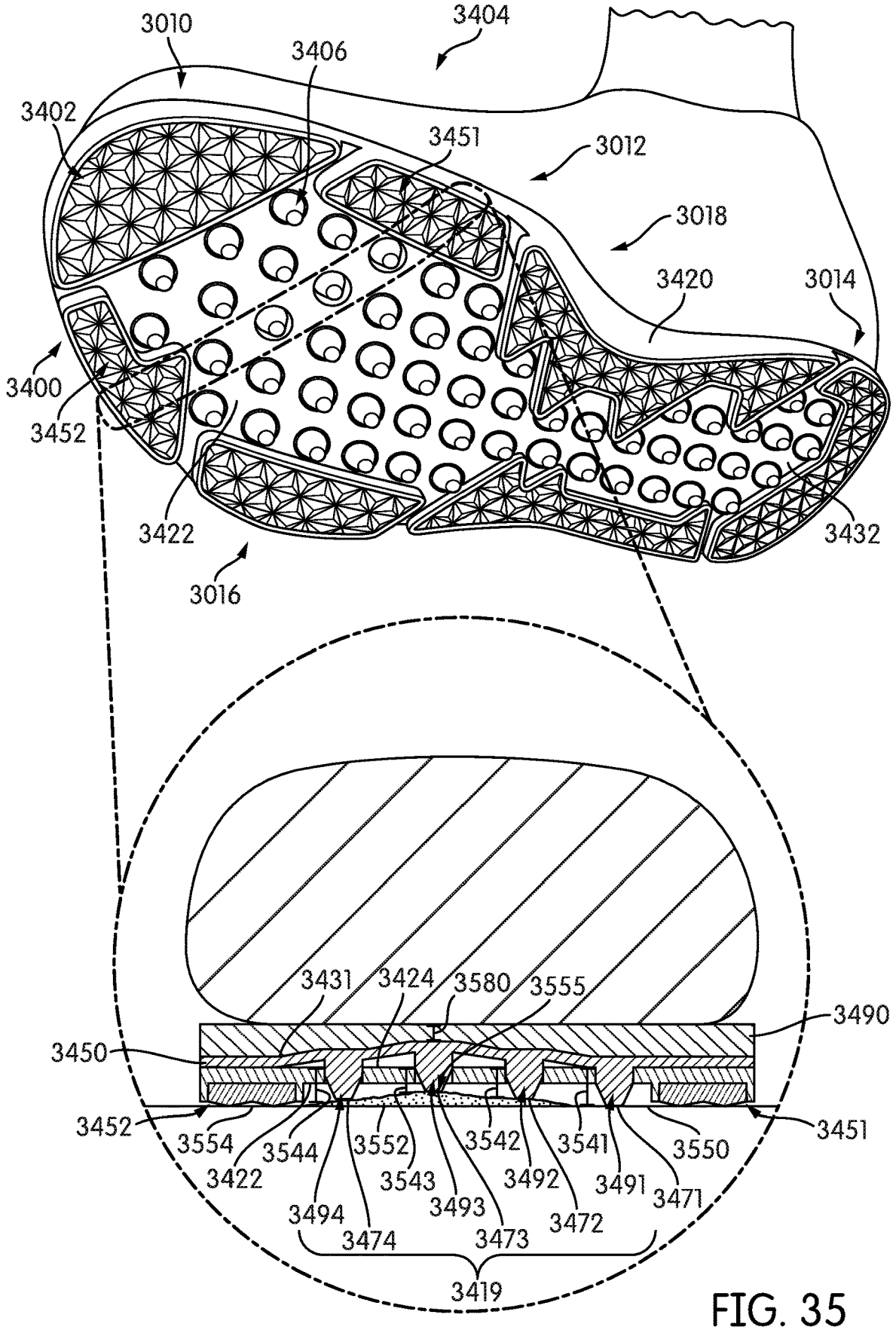
FIG. 35 is a bottom isometric view of an embodiment of a sole system in which the sole member includes a plurality of raised portions and is experiencing compression.
Figure 36:
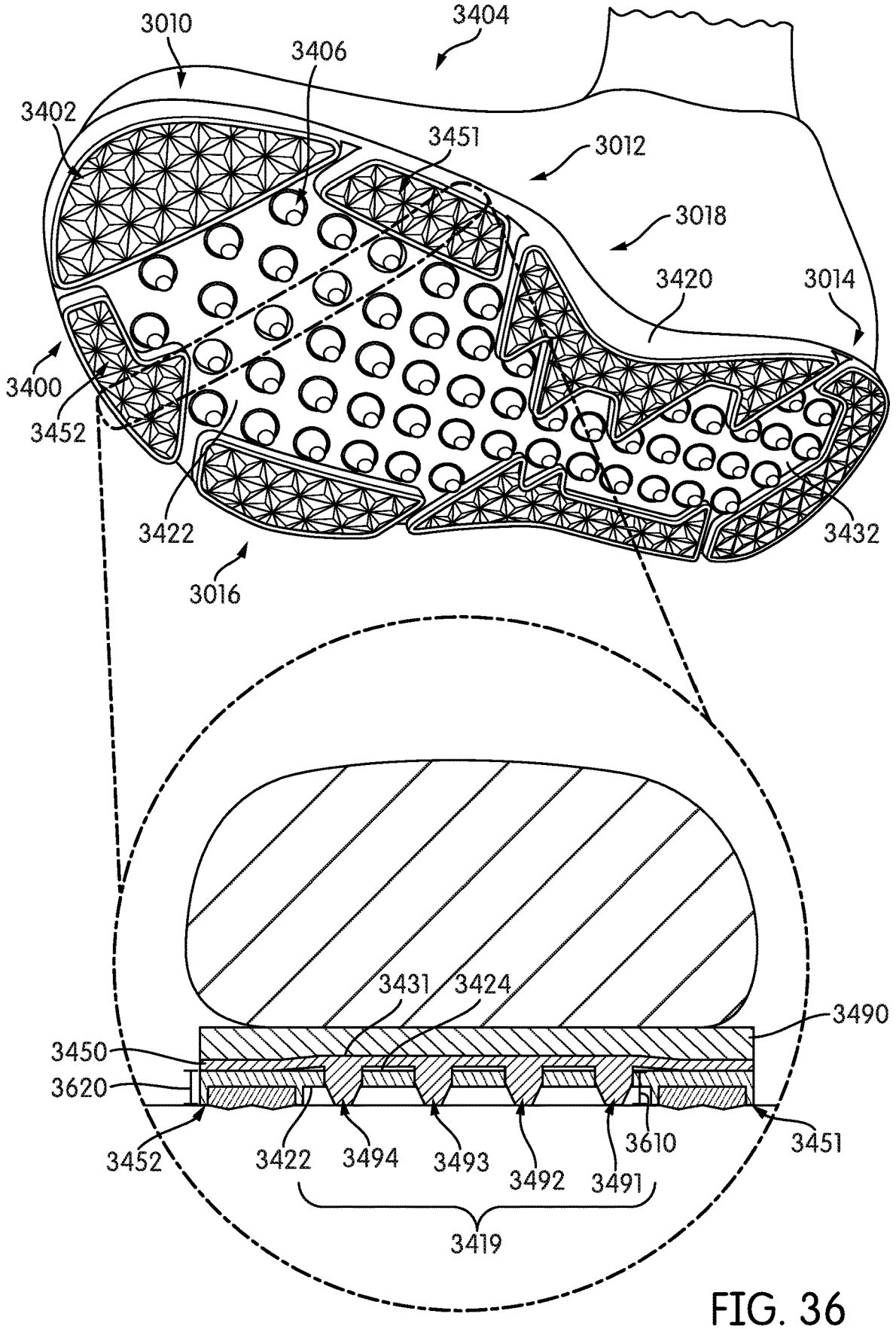
FIG. 36 is a bottom isometric view of an embodiment of a sole system in which the sole member includes a plurality of raised portions and is experiencing compression.

Referring now to FIGS. 34-36, it should be understood that in some embodiments a sole system may include both raised portions (as described with respect to FIG. 30) and a compressible inner member (as described with respect to FIGS. 31-33). In FIG. 34, an embodiment of a sole system 3400 is depicted in a first (neutral) state, where a plurality of raised portions 3402 are disposed along the bottom of an article of footwear 3404 adjacent to a plurality of protruding members 3406. In some embodiments, the arrangement of raised portions 3402 may be similar to that of FIG. 30; however, it should be understood that the arrangement of raised portions 3402 can vary from what is depicted for various embodiments herein.

For purposes of reference, in FIG. 34, outwardly facing surface 3422 of sole member 3420 comprises a base portion 3432 extending in a substantially continuous manner from forefoot region 3010 to heel region 3014. As shown in the cross-sectional view of FIG. 34, a sole member 3420 includes a first raised portion 3451 disposed adjacent to base portion 3432 and along medial side 3018, and a second raised portion 3452 disposed adjacent to base portion 3432 along lateral side 3016. First raised portion 3451 has a distal surface that extends downward a first distance 3442 from an inwardly facing surface 3424 of sole member 3420, and second raised portion 3452 has a distal surface that extends downward a second distance 3444 from inwardly facing surface 3424 of sole member 3420. First distance 3442 and second distance 3444 may be substantially similar in some embodiments, or can differ in other embodiments. In FIG. 34, it can be seen that first distance 3442 is substantially similar to second distance 3444. However, in other embodiments, first distance 3442 can be greater than or less than second distance 3444. Furthermore, base portion 3432 extends a third distance 3446 from inwardly facing surface 3424 of sole member 3420, where third distance 3446 is less than either first distance 3442 or second distance 3444.

In addition, sole system 3400 has an inner member 3490 that has a first thickness 3480 in the first state. While inner member 3490 is depicted with a substantially uniform thickness in FIG. 34, it should be understood that in other embodiments, inner member 3490 can include contours, bumps, or various regions of lesser or greater thickness while in the first state. A protruding member assembly 3450 is disposed between a distal side 3431 of inner member 3490 and inwardly facing surface 3424 of sole member 3420. The cross-section depicts a group of protruding members ("protruding members group") 3419. Protruding members group 3419 is located between first raised portion 3451 and second raised portion 3452 in FIG. 34, and includes a first protruding member 3491, a second protruding member 3492, a third protruding member 3493, and a fourth protruding member 3494. A distal end of each protruding member of protruding members group 3419 extends downward relative to sole member 3420.

As seen in FIG. 34, in which no forces are applied to the bottom of sole system 3400, plurality of protruding members 3406 are all fully extended from an outwardly facing surface 3422 of sole member 3420. Relative to the outwardly facing surface 3422 of sole member 3420, a first distal end 3471 of first protruding member 3491 extends downward a first distance 3441, a second distal end 3472 of second protruding member 3492 extends downward a second distance 3442, a third distal end 3473 of third protruding member 3493 extends downward a third distance 3443, and a fourth distal end 3474 of fourth protruding member 3494 extends downward a fourth distance 3444.

In FIG. 34, it can be seen that in the initial (first) state, each of first distance 3441, second distance 3442, third distance 3443, and fourth distance 3444 are substantially similar. However, depending on the configuration of protruding member assembly 3450 and the dimensions of various protruding members, the distances may differ from one another in other embodiments.

FIGS. 35 and 36 illustrate protruding member assembly 3450 in different states of bending and flexing. FIG. 35 illustrates sole system 3400 and protruding member assembly 3450 in a second state, where the second state is an at least partially compressed or responsive state as article 3404 contacts a relatively soft ground surface (relative to FIG. 36) such as natural grass or dirt paths. In the second state, the distal end of one or more protruding members can be impacted or experience a force, such as a compressive force, similar to that described with respect to FIG. 33.

As seen in FIG. 35, when protruding member assembly 3450 is placed on contoured or irregular surfaces, the geometry of protruding member assembly 3450 can change to accommodate (or match) the geometry of the surface in some cases. Relative to outwardly facing surface 3422 of sole member 3420, first distal end 3471 of first protruding member 3491 extends downward a fifth distance 3541, second distal end 3472 of second protruding member 3492 extends downward a sixth distance 3542, third distal end 3473 of third protruding member 3493 extends downward a seventh distance 3543, and fourth distal end 3474 of fourth protruding member 3494 extends downward an eighth distance 3544. In FIG. 35, it can be seen that in the second (responsive) state, each of fifth distance 3541, sixth distance 3542, seventh distance 3543, and eighth distance 3544 can differ from one another. Furthermore, one or more of the distances may differ from their value in the first state depicted in FIG. 34.

Thus, as the protruding members contact an uneven first ground surface 3550, one or more the protruding members can be configured to move relative to sole member 3420 in some embodiments. In other words, one or more protruding members in the second state can be displaced from their configuration in the first state to their configuration in the second state. As shown in FIG. 35, the distal ends of second protruding member 3492, third protruding member 3493, and fourth protruding member 3494 are in contact with a bumpy region 3552 of first ground surface 3550, while first protruding member 3491 is in contact with other, generally uniform (i.e., level or even) regions 3554 of first ground surface 3550. Bumpy region 3552 can provide a compressive force to sole system 3400. In the current embodiment, the distances of downward extension associated with protruding members contacting bumpy region 3552 can be less than the distances of downward extension associated with protruding members that do not contact bumpy region 3552. Because of the flexibility of protruding member assembly 3450, movement of protruding members may primarily occur at localized regions where forces or pressures are directly applied (e.g., along the protruding members that contact bumpy region 3552).

As seen by comparing FIG. 34 and FIG. 35, second distance 3442 may be greater than sixth distance 3542, third distance 3443 may be substantially greater than seventh distance 3543, and fourth distance 3444 may be greater than eighth distance 3544. In some embodiments, the decrease in distance of downward extension from the first state to the second state is proportional to the magnitude of the compressive force applied to the protruding member. For example, in FIG. 35, the highest point (i.e., a peak 3555) of bumpy region 3552 contacts third protruding member 3493, and it can be seen that the sixth distance 3542 is smaller relative to fifth distance 3541 and eighth distance 3544 of the remaining protruding members in protruding members group 3419.

As noted previously, inner member 3490 can be configured to accommodate the changes or movement of different protruding members. Thus, in one embodiment, the compressibility and/or deformability of inner member 3490 may facilitate the movement of protruding members. In other words, in some embodiments, inner member 3490 may receive a portion or all of a proximal end of a protruding member as it experiences a compressive force at its distal end. In FIG. 35, for example, some of the protruding members of protruding members group 3419 are compressed and pushed upward. This displacement is permitted at least in part by the compressibility of inner member 3490, which accommodates the protruding members as they move upward. When distal side 3431 of inner member 3490 is pressed by a proximal end of a protruding member, inner member 3490 can deform inward (i.e., in the direction toward a foot). For example, when second protruding member 3492 is pushed upward, a corresponding second proximal end portion (disposed between distal side 3431 of inner member 3490 and inwardly facing surface 3424 of sole member 3420) presses against distal side 3431 of inner member 3490. It can be seen that relative to a resting or first thickness 3480 of inner member 3490 nearest third protruding member 3493 (shown in FIG. 34), the thickness of inner member 3490 is decreased to a second thickness 3580 as the compressive force is applied. However, in regions of inner member 3490 where the force is not applied, the thickness of inner member 3490 may not decrease in some embodiments. Thus, while deformation occurs along a first segment of inner member 3490 associated with second protruding member 3492, third protruding member 3493, and fourth protruding member 3494, little or no deformation may occur in the remainder of inner member 3490 that does not experience the compressive force.

Thus, inner member 3490 can be configured to allow one or more protruding members to transition from a first position to a second position. In some embodiments, the transition can occur in response to a force applied at a distal end portion of the protruding member(s).

In different embodiments, sole system 3400 can also be utilized effectively with ground surfaces that are relatively harder than first ground surface 3550. FIG. 36 illustrates sole system 3400 and protruding member assembly 3450 in a third state, where the third state is an at least partially compressed or responsive state as article 3404 contacts a relatively stiff or hard ground surface (relative to FIG. 36). In the third state, the distal surface of one or more raised portions experience a force, such as a compressive force.

As seen in FIG. 36, when protruding member assembly 3450 is placed on a hard ground surface, raised portions 3402 can provide enhanced support and grip. In one embodiment, raised portions 3402 extend downward from sole member 3420 to a distance at least as great as the furthest distance associated with a protruding member in the first state. In some embodiments, relative to outwardly facing surface 3422 of sole member 3420, first raised portion 3451 and/or second raised portion 3452 can extend downward a greater distance than any protruding members. For example, in FIG. 36, first raised portion 3451 extends downward a ninth distance 3610 and second raised portion 3452 extends downward a tenth distance 3620. In different embodiments, ninth distance 3610 and tenth distance 3620 may be substantially similar (as shown in the current embodiment) or they may differ from one another. Furthermore, each of ninth distance 3610 and tenth distance 3620 may be substantially similar to first distance 3441 in FIG. 34. However, in other embodiments, ninth distance 3610 and tenth distance 3620 can be greater than first distance 3441, second distance 3442, third distance 3443, and fourth distance 3444. It should be understood for purposes of this description that the distances identified with respect to a raised portion includes the additional height resulting from any optional traction elements that may be disposed along a distal surface of a raised portion. In other embodiments where a raised portion does not include any traction elements, the distance is understood to represent the distance from outwardly facing surface 3422 of sole member 3420 to the distal surface of the raised portion.

In FIG. 36, it can be seen that in the third (responsive) state, while the raised portions do not necessarily deform or change in height or thickness, the neighboring protruding members remain in a generally neutral or uncompressed state, in contrast with FIG. 35. Thus, in some embodiments, raised portions 3402 can improve performance along more rigid ground surfaces such as hard grass or artificial turf in some embodiments. In different embodiments, the inclusion of both raised portions and the compressible inner member in sole system 3400 can facilitate the use of article 3404 in different environments and activities. In some embodiments, the plurality of raised portions may be configured to provide traction on a first (softer) surface, while the plurality of protruding members may be configured to provide traction on a second (harder) surface.

Figure 37:
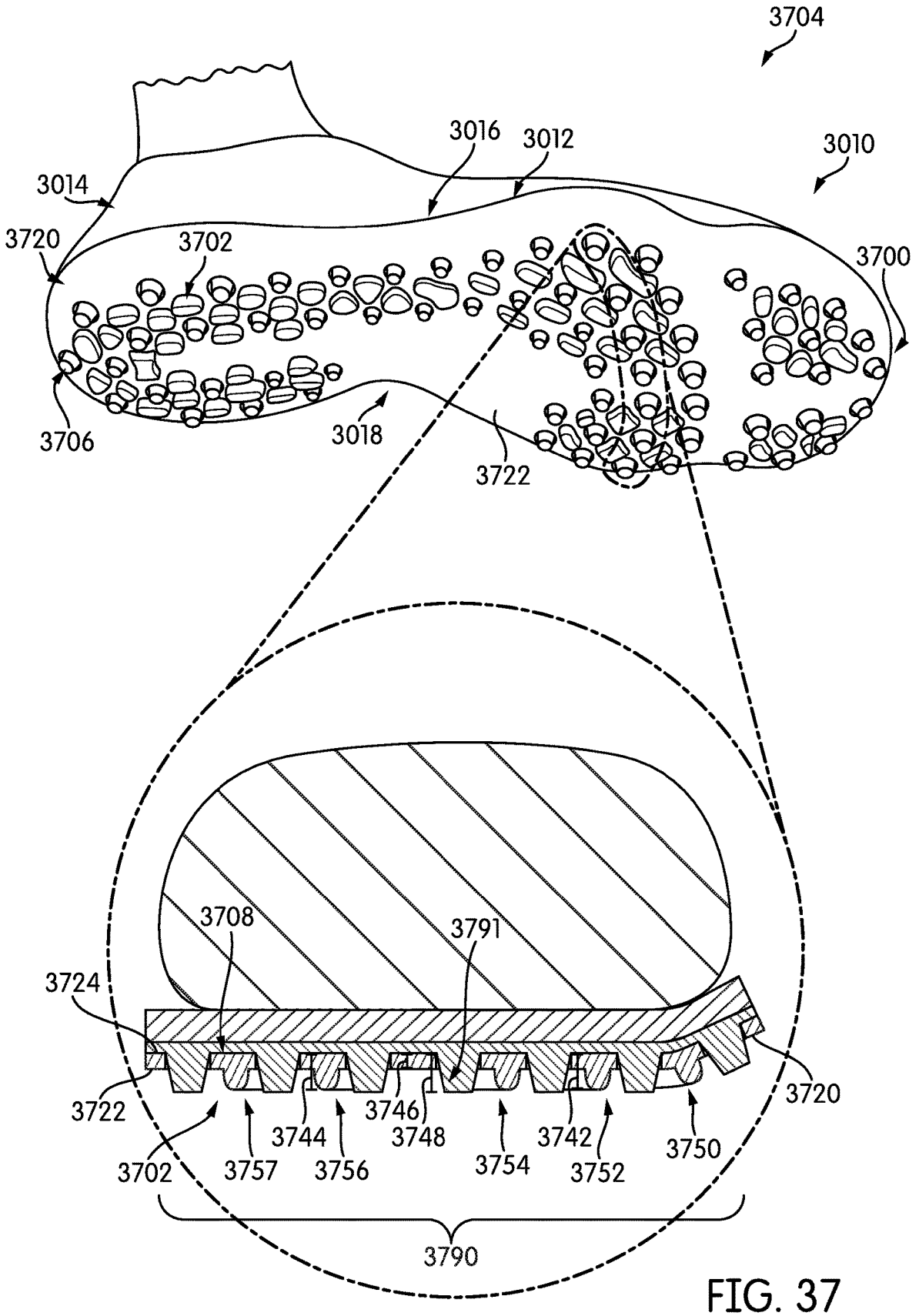
FIG. 37 is a bottom isometric view of an embodiment of a sole system in which the sole member includes a plurality of protruding members and nub portion.

In different embodiments, other features may be included in a sole system. Some embodiments of a sole system can include provisions for improving traction along uneven, soft, slippery or wet surfaces, for example. FIG. 37 illustrates an isometric bottom view of another embodiment of some components of a sole system 3700. Sole system 3700 includes a sole member 3720. Sole member 3720 includes an outwardly facing surface 3722 and an inwardly facing surface 3724. Sole member 3720 may further include provisions for receiving a plurality of protruding members 3706 and corresponding connecting portions 3708, as discussed earlier. For example, sole member 3720 may include a plurality of holes for receiving protruding members 3706.

Thus, as in previous embodiments, sole system 3700 includes protruding members 3706 connected by connecting portions 3708. Furthermore, in some embodiments, sole member 3720 may include multiple structural formations which may individually or collectively provide an article of footwear ("article") 3704 with a number of attributes, such as support, rigidity, stability, traction, grip, balance, comfort, or other attributes. In some embodiments, sole member 3720 may include structural features that improve a wearer's interactions with different types of ground surfaces.

For purposes of reference, in FIG. 37, outwardly facing surface 3722 of sole member 3720 comprises a base portion extending in a substantially continuous manner from forefoot region 3010 to heel region 3014. In different embodiments, sole member 3720 can have one or more protuberances or nub portions 3702 formed along outwardly facing surface 3722. Nub portions 3702 can comprise portions of material attached or integrally formed with sole member 3720 that extend further outward (distally) relative to the base portion. In some embodiments, nub portions 3702 can have a greater or lesser stiffness relative to the base portion. Nub portions 3702 can have various sizes (i.e., volume and/or surface area) and can have a greater height relative to the base portion. Each nub portion can provide specialized traction or grip to different regions of sole member 3720.

In one embodiment, one or more nub portions 3702 are positioned along outwardly facing surface 3722 of sole member 3720. Generally, sole member 3720 may comprise any number of nub portions 3702. In some cases, sole member 3720 can comprise ten or more nub portions 3702. In other cases, sole member 3720 can comprise from 20 to 100 nub portions 3702. In the cross-sectional view of FIG. 37, a first nub portion 3750, a second nub portion 3752, a third nub portion 3754, a fourth nub portion 3756, and a fifth nub portion 3757 are depicted, arranged in a manner extending from medial side 3018 to lateral side 3016. In other embodiments, however, one or more of these nub portions 3702 may be omitted, or there may be additional nub portions 3702. Furthermore, it should be understood that there may be substantial areas of outwardly facing surface 3722 in which no nub portions are formed.

Thus, in some embodiments, sole member 3720 may include protuberances of varying height, thickness, and width in sole system 3700. For example, the surface area and the volume associated with first nub portion 3750 (as bounded by the outer surface of first nub portion 3750) may be substantially larger than the surface area and the volume associated with fourth nub portion 3756. In addition, in different embodiments, the geometry of one nub portion can differ from another nub portion. For example, the size and dimensions of first nub portion 3750 and fourth nub portion 3756 can vary relative to one another. In FIG. 37, first nub portion 3750 has a generally oblong or elongated rectangular geometry, with substantially rounded edges, while fourth nub portion 3756 has a generally cuboid geometry, with substantially rounded edges. In some embodiments, a nub portion can have a regular or irregular horizontal cross-sectional shape (where the cross-section is taken along a plane substantially parallel to the base portion). In one embodiment, first nub portion 3750 has an approximately rounded rectangular horizontal cross-sectional shape (where the cross-section is taken in a substantially horizontal plane over nearly the entire height of first nub portion 3750)

In contrast, fourth nub portion 3756 has a substantially rounded square horizontal cross-sectional shape (where the cross-section is taken in a substantially horizontal plane over nearly the entire height of fourth nub portion 3756). However, in various embodiments, each nub portion can have any three-dimensional geometry, including cuboid, conical, pyramidal, prism-shaped, or other regular or irregular three-dimensional shapes.

Referring to the cross-sectional view of article 3704 included in FIG. 37, relative to inwardly facing surface 3724 of sole member 3720, second nub portion 3752 has a distal surface that extends downward a first distance 3742, and fourth nub portion 3756 has a distal surface that extends downward a second distance 3744. First distance 3742 and second distance 3744 may be substantially similar in some embodiments, or can differ in other embodiments. In FIG. 37, it can be seen that first distance 3742 is substantially similar to second distance 3744. However, in other embodiments, first distance 3742 can be greater than or less than second distance 3744. The distance that each nub portion extends can be configured to provide specialized traction for various ground surfaces in some embodiments. Thus, as one example, nub portions 3702 disposed along midfoot portion 3012 may be smaller (or extend distally outward to a lesser extent) relative to nub portions 3702 in heel portion 3014.

In addition, the base portion of sole member 3720 extends downward a third distance 3746 from inwardly facing surface 3724 of sole member 3720. In some embodiments, third distance 3746 can differ relative to first distance 3742 or second distance 3744. In FIG. 37, it can be seen that first distance 3742 and second distance 3744 are substantially greater than third distance 3746.

Furthermore, the cross-sectional view of article 3704 depicts a group of protruding members ("protruding members group") 3790. Protruding members group 3790 is located adjacent to nub portions 3702 in the cross-section of FIG. 37, and includes seven protruding members in this embodiment. A distal end of each protruding member of protruding members group 3790 extends downward relative to sole member 3720. Relative to inwardly facing surface 3724 of sole member 3720, a distal end of a first protruding member 3791 extends downward a fourth distance 3748. In some embodiments, fourth distance 3748 can differ relative to third distance 3746. In FIG. 37, it can be seen that fourth distance 3748 is substantially greater than third distance 3746. Additionally, in some embodiments, fourth distance 3748 can be substantially similar to or differ relative to first distance 3742 or second distance 3744. In one embodiment, fourth distance 3748 is at least as great as first distance 3742 or second distance 3744.

Moreover, in different embodiments, nub portions 3702 have thickness and comprise a substantially continuous material. However, it should be understood that in other embodiments, nub portions 3702 may be substantially or entirely hollow, or include hollowed compartments. This may decrease the weight or sole system 3700 in some embodiments. In addition, nub portions 3702 can comprise a separate portion or segment of material that is inserted into different regions of sole member 3720 in some embodiments. In one embodiment, sole member 3720 can include recesses or regions bounded by raised sidewalls that are configured to receive nub portions 3702.

Furthermore, in some embodiments, the thickness of a nub portion can be generally consistent over the height of the nub portion, as shown in the cross-sectional view of article 3704 included in FIG. 37. However, in other embodiments, nub portions 3702 can include regions of lesser thickness or greater thickness. In addition, in some embodiments, the size of the area of the distal surface of a nub portion can be substantially greater than the size of the surface area associated with a distal end of a protruding member in sole system 3700. In other words, as shown in FIG. 37, a surface area size of the distal surface of first nub portion 3750 is substantially greater than the surface area size of the distal end of first protruding member 3791.

Furthermore, in some embodiments, there may be at least one nub portion for every hole that is formed in sole member 3720. In other words, each of plurality of holes 3780 can be disposed adjacent at least one nub portion in some embodiments. In other embodiments, a hole (with a corresponding protruding member) can be formed adjacent to two or more nub portions.

Figure 38:
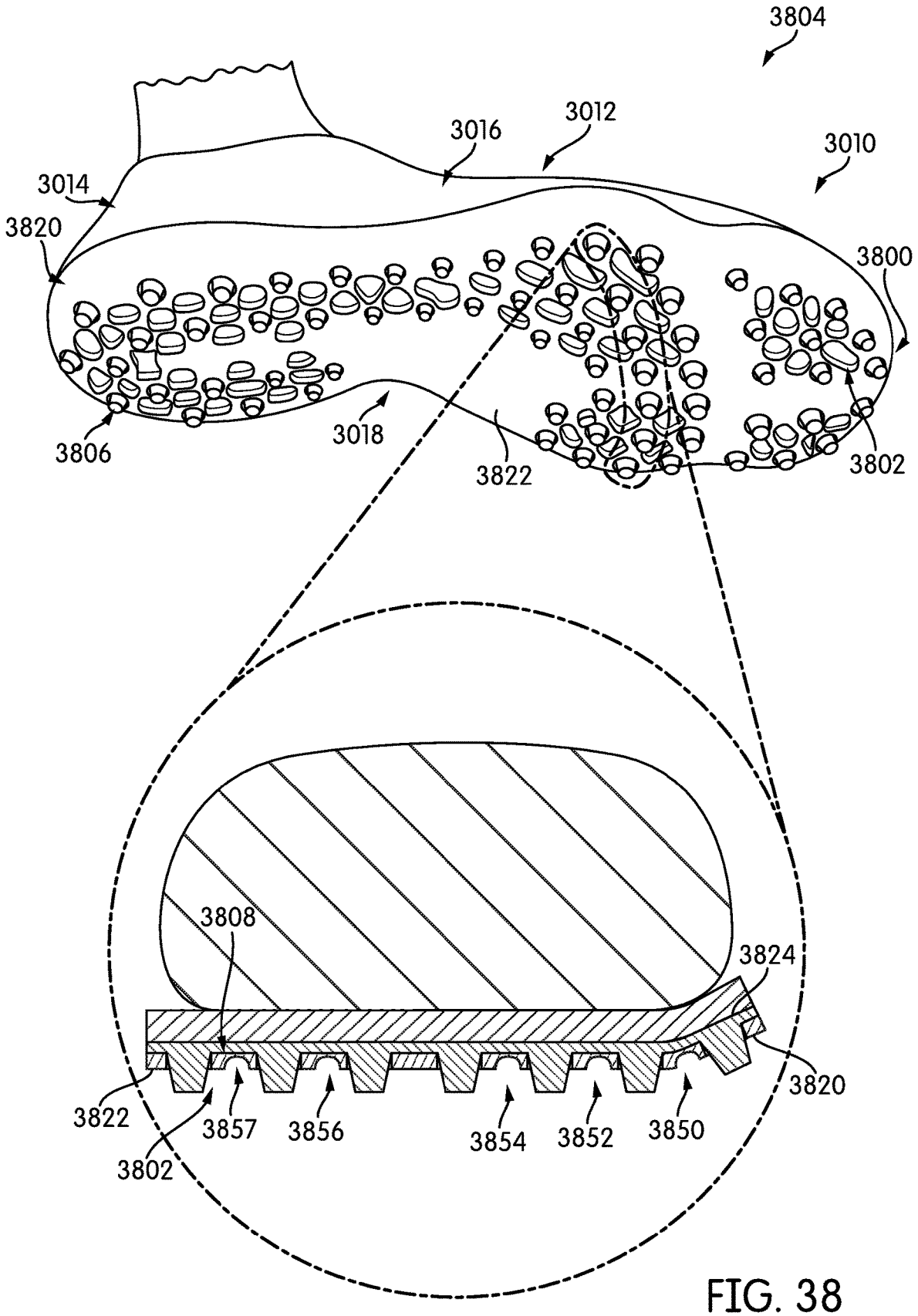
FIG. 38 is a bottom isometric view of an embodiment of a sole system in which the sole member includes a plurality of protruding members and recessed portions.

Another embodiment of a sole system that can include provisions for improving traction along uneven, soft, slippery, or wet surfaces is depicted in FIG. 38. FIG. 38 illustrates an isometric bottom view of an embodiment of some components of a sole system 3800. Sole system 3800 includes a sole member 3820. Sole member 3820 includes an outwardly facing surface 3822 and an inwardly facing surface 3824. Sole member 3820 may further include provisions for receiving a plurality of protruding members 3806 and corresponding connecting portions 3808, as discussed earlier. For example, sole member 3820 may include a plurality of holes for receiving protruding members 3806.

Thus, as in previous embodiments, sole system 3800 includes protruding members 3806 connected by connecting portions 3808. Furthermore, in some embodiments, sole member 3820 may include multiple structural formations which may individually or collectively provide an article of footwear ("article") 3804 with a number of attributes, such as support, rigidity, stability, traction, grip, balance, comfort, or other attributes. In some embodiments, sole member 3820 may include structural features that facilitate a wearer's interactions with different types of ground surfaces.

For purposes of reference, in FIG. 38, outwardly facing surface 3822 of sole member 3820 comprises a base portion extending in a substantially continuous manner from forefoot region 3010 to heel region 3014. In different embodiments, sole member 3820 can have one or more dimples or recessed portions 3802 formed in outwardly facing surface 3822. Recessed portions 3802 can comprise of portions of sole member 3820 that extend further inward (proximally) relative to the base portion. Recessed portions 3802 can have various sizes (i.e., volume and/or surface area) and have a greater depth relative to the base portion. Each recessed portion can provide specialized traction or grip to different regions of sole member 3820.

In one embodiment, one or more recessed portions 3802 are formed along outwardly facing surface 3822 of sole member 3820. Generally, sole member 3820 may comprise any number of recessed portions 3802. In some cases, sole member 3820 can comprise ten or more recessed portions 3802. In other cases, sole member 3820 can comprise from 20 to 100 recessed portions 3802. In the cross-sectional view of FIG. 38, a first recessed portion 3850, a second recessed portion 3852, a third recessed portion 3854, a fourth recessed portion 3856, and a fifth recessed portion 3857 are depicted, arranged in a manner extending from medial side 3018 to lateral side 3016. In other embodiments, however, one or more of these recessed portions 3802 may be omitted, or there may be additional recessed portions 3802. Furthermore, it should be understood that there may be substantial areas of outwardly facing surface 3822 in which no recessed portions are formed.

Thus, in some embodiments, sole member 3820 may include dimples of varying depth, thickness, and width in sole system 3800. In addition, in different embodiments, the geometry of one recessed portion can differ from another recessed portion. For example, the size and dimensions of first recessed portion 3850 and fourth recessed portion 3856 can vary relative to one another. In FIG. 38, first recessed portion 3850 has a generally oblong or elongated rectangular geometry, with substantially rounded edges, while fourth recessed portion 3856 has a generally elongated cuboid geometry, with substantially rounded edges. In some embodiments, a recessed portion can have a regular or irregular horizontal cross-sectional shape (where the cross-section is taken along a plane substantially parallel to the base portion). In one embodiment, first recessed portion 3850 has an approximately rounded rectangular horizontal cross-sectional shape (where the cross-section is taken in a substantially horizontal plane over nearly the entire height of first recessed portion 3850). In contrast, fourth recessed portion 3856 has a substantially rounded square horizontal cross-sectional shape (where the cross-section is taken in a substantially horizontal plane over nearly the entire height of fourth recessed portion 3856). However, in other embodiments, each recessed portion can have any other three-dimensional geometry, including cuboid, conical, pyramidal, prism-shaped, or other regular or irregular three-dimensional shapes.

Furthermore, as noted above, the depths associated with a recessed portion can vary. The depth of each recessed portion extends can be configured to provide specialized traction for various ground surfaces in some embodiments. As one example, recessed portions 3802 disposed along midfoot portion 3012 are more shallow relative to recessed portions 3802 in heel portion 3014.

Furthermore, in some embodiments, there may be at least one recessed portion for every hole that is formed in sole member 3820. In other words, each of plurality of holes 3880 can be disposed adjacent to at least one recessed portion in some embodiments. In other embodiments, a hole (with a corresponding protruding member) can be formed adjacent to two or more recessed portions.

In different embodiments, these types of secondary tread elements (such as nub portions 3702 in FIG. 37 or recessed portions 3802 in FIG. 38) may be strategically positioned with protruding members on the surface of the sole member to maximize the zonal traction that is created by a wearer exerting forces on different areas of the sole member. For example, in one embodiment, the protruding members protrude alongside a tread pattern comprising of nub portions 3702 formed at regular intervals around the holes formed in the sole member. These secondary tread elements can be configured to improve the ability of a sole system to provide traction, and help to accommodate the pressure experienced by individual protruding members in some embodiments. An advantage of such configurations is that nub portions 3702 and recessed portions 3802 may reduce a likelihood mud or portions of turf will adhere to a bottom surface of the footwear.

Figure 39:
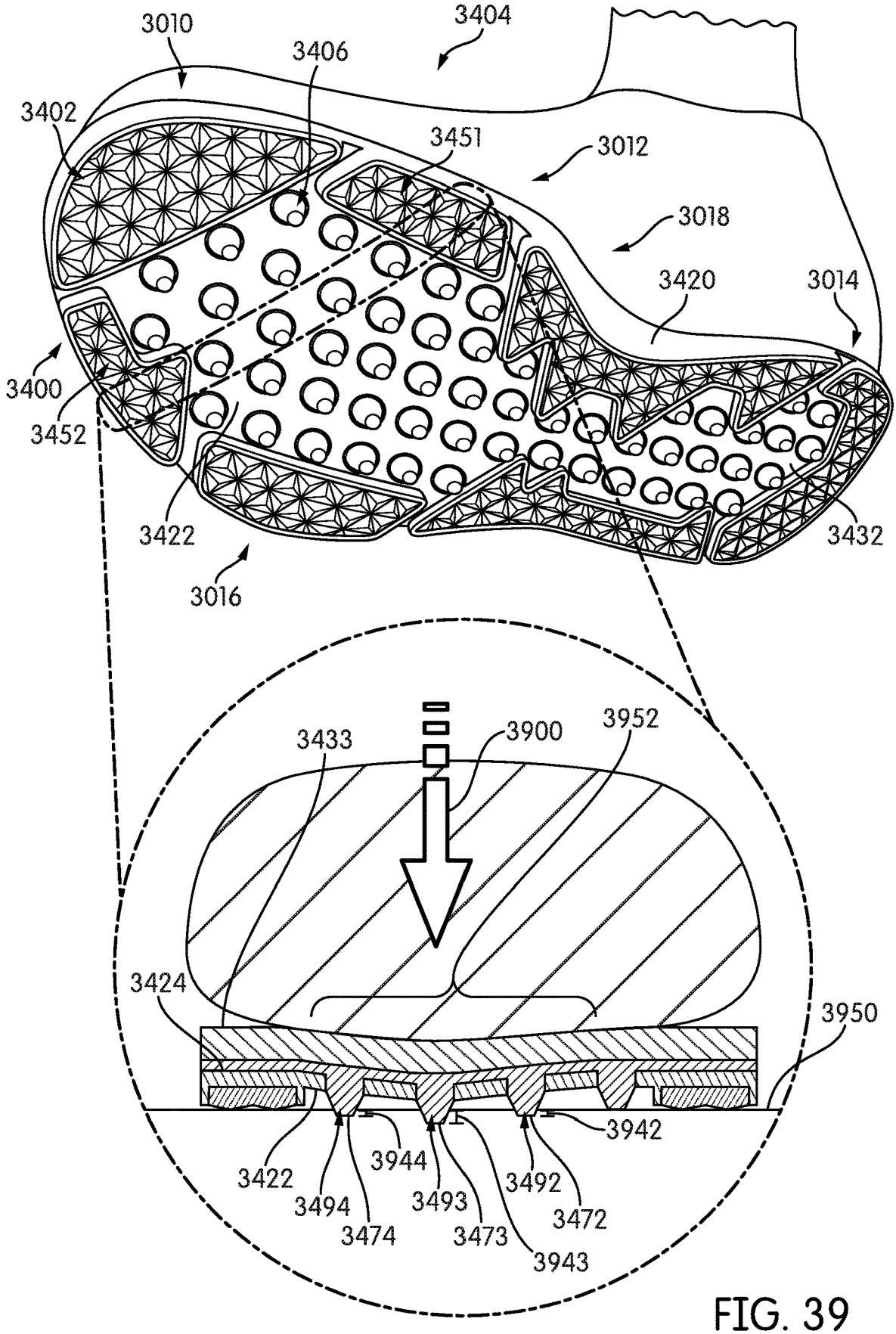
FIG. 39 is a bottom isometric view of an embodiment of a sole system in which the sole member includes a plurality of raised portions and is experiencing compression.

Furthermore, in some embodiments, sole system 3400 can be configured for use on softer or yielding surfaces, including natural grass and field turf. In some cases, protruding member assembly 3450 can extend and penetrate into soft surfaces when compressed by an wearer's force and weight. Referring now to FIG. 39, in some embodiments a sole system may include both raised portions (as described with respect to FIG. 30) and a compressible inner member (as described with respect to FIGS. 31-33). In FIG. 39, an embodiment of sole system 3400 is depicted in a third (compressed) state, where sole system 3400 is engaged with a soft or wet surface.

As noted in FIG. 34, in which no forces are applied to the bottom of sole system 3400, plurality of protruding members 3406 are all fully extended from an outwardly facing surface 3422 of sole member 3420 in a generally consistent and uniform fashion. In FIG. 34, it can be seen that in the initial (first) state, each of first distance 3441, second distance 3442, third distance 3443, and fourth distance 3444 of plurality of protruding members 3406 are substantially similar.

FIG. 39 illustrates protruding member assembly 3450 in a different state of bending and flexing. FIG. 39 illustrates sole system 3400 and protruding member assembly 3450 in the third state, where the third state is an at least partially compressed or responsive state as article 3404 contacts a relatively soft, pliant ground surface (relative to FIG. 36) such as natural grass or dirt paths. In the second state, the distal end of one or more protruding members can be impacted or experience a force, such as a compressive force, similar to that described with respect to FIG. 33.

As seen in FIG. 39, when protruding member assembly 3450 is interacts with a softer or wet surface, the geometry of protruding member assembly 3450 can change to accommodate (or match) the surface in some cases. As a wearer exerts a force 3900 within article of footwear 3404 during some activity (e.g., locomotion) and presses down in forefoot region 3010, one or more protruding members near that region can be compressed. In some embodiments, force 3900 may push protruding members downward, such that they "bulge" or extend further distally outward relative to raised portions 3402.

Thus, as shown in FIG. 39, as force 3900 is applied, second distal end 3472 of second protruding member 3492 extends downward an eleventh distance 3942, third distal end 3473 of third protruding member 3493 extends downward a twelfth distance 3943, and fourth distal end 3474 of fourth protruding member 3494 extends downward an thirteenth distance 3944. In FIG. 35, it can be seen that in the third (compressed) state, each of eleventh distance 3942, twelfth distance 3943, and thirteenth distance 3944 can differ from one another. Furthermore, one or more of the distances may differ from their value in the first state depicted in FIG. 34.

Thus, as the protruding members contact a soft and/or yielding third ground surface 3950, one or more the protruding members can be configured to move relative to raised portions 3402 in some embodiments. In other words, one or more protruding members can be displaced from their configuration in the first state to their configuration in the third state in response to a force. As shown in FIG. 39, the distal ends of second protruding member 3492, third protruding member 3493, and fourth protruding member 3494 are experiencing force 3900 as they contact a yielding region of third ground surface 3950, while first protruding member 3491 remains generally outside the application of force 3900 and does not extend further distally outward. However, it should be understood that in other embodiments, depending on the type of ground surface and the force, there can be any pattern of extension or distortion of the protruding members and protruding member assembly 3450.

In the current embodiment, one or more protruding members 3406 may extend downward into and be received by third ground surface 3950. Because of the flexibility of protruding member assembly 3450, movement of protruding members may primarily occur at localized regions where forces or pressures are directly applied (e.g., the protruding members that are pressed downward by force 3900).

As seen by comparing FIG. 34 and FIG. 39, sole system 3400 (and, in particular, protruding member assembly 3450) may have a deformed contoured region 3952 associated with the region that experiences force 3900 in some embodiments. Deformed contoured region 3952 may generally correspond to the magnitude of force being exerted on sole system 3400 in different embodiments. In some embodiments, eleventh distance 3942, twelfth distance 3943, and thirteenth distance 3944 may extend further distally outward relative to raised portions 3402 and/or any adjacent protruding members that are not deformed. In some embodiments, the change in distance of downward extension into third ground surface 3950 from the first state to the third state is proportional to the magnitude of the compressive force applied to the protruding member. For example, in FIG. 39, the peak of force 3900 is associated with third protruding member 3493, and it can be seen that the twelfth distance 3942 is greatest relative to eleventh distance 3941 and thirteenth distance 3944.

As noted previously, inner member 3490 can be configured to accommodate the changes or movement of different protruding members. Thus, in one embodiment, the compressibility and/or deformability of inner member 3490 may facilitate the movement of protruding members. In other words, in some embodiments, inner member 3490 may facilitate the transfer of force 3900 to protruding member assembly 3450. In FIG. 39, for example, some of the protruding members are compressed and pushed downward.

This displacement is permitted at least in part by the compressibility of inner member 3490, which is compressed by force 3900 and readily deforms and transfers the force to the protruding members. When distal side 3433 of inner member 3490 is pressed by force 3900, inner member 3490 can deform outward (i.e., in the direction toward the ground). However, in regions of inner member 3490 where the force 3900 is not applied, inner member 3490 may not be deformed in some embodiments. Thus, while deformation occurs along a deformed contoured region 3952, little or no deformation may occur in the remainder of inner member 3490 that does not experience the compressive force. In other words, inner member 3490 can be configured to allow one or more protruding members to transition from a first position to a third position. In some embodiments, the transition can occur in response to a force applied at a proximal end portion of the protruding member(s).

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

We claim:

1. An article of footwear, comprising:

a sole member having an outwardly facing surface and an inwardly facing surface disposed opposite the outwardly facing surface, the outwardly facing surface including a base portion extending from a heel region to a forefoot region of the article of footwear;

the outwardly facing surface of the sole member including a plurality of recessed portions, wherein the outwardly facing surface associated with each of the plurality of recessed portions is disposed closer to the inwardly facing surface relative to the outwardly facing surface that is associated with the base portion; and a protruding member assembly positioned proximal to the inwardly facing surface of the sole member, wherein the sole member includes a first hole and a second hole, wherein the protruding member assembly includes a first protruding member and a second protruding member, wherein the first protruding member extends outward through the first hole and the second protruding member extends outward through the second hole, wherein the first and second protruding members are upwardly moveable relative to the sole member, and wherein a respective one of the plurality of recessed portions is located between the first and second protruding members.

2. The article of footwear of claim 1, wherein each of the plurality of protruding members is disposed adjacent to a respective one of the plurality of recessed portions.

3. The article of footwear of claim 1, wherein the plurality of recessed portions includes a first recessed portion, wherein the first recessed portion has a rounded inner surface.

4. The article of footwear of claim 1, wherein the plurality of recessed portions are arranged over the forefoot region, a midfoot region, and the heel region of the sole member.

5. The article of footwear of claim 4, wherein the plurality of recessed portions disposed in the midfoot region are more shallow than the plurality of recessed portions disposed in the heel region.

6. The article of footwear of claim 4, wherein the plurality of recessed portions include a first recessed portion disposed in the midfoot region have a greater cross-sectional area in a horizontal plane relative to the plurality of recessed portions disposed in the forefoot region.

7. The article of footwear of claim 1, wherein the protruding member assembly includes a plurality of protruding members connected together by a plurality of connecting portions.

8. The article of footwear of claim 7, the first protruding member being joined to the second protruding member by a first connecting portion, the first connecting portion having a substantially elongated, strip-like shape.

9. The article of footwear of claim 7, further comprising an inner member having a proximal side and a distal side disposed opposite the proximal side, wherein the inner member is disposed proximate the inward facing surface of the sole member, and wherein the distal side of the inner member is configured to elastically deform when the first protruding member is compressed inward.

10. The article of footwear of claim 1, wherein the plurality of recessed portions are configured to provide traction to the article of footwear.

11. An article of footwear, comprising:

a sole member having an outwardly facing surface and an inwardly facing surface disposed opposite the outwardly facing surface, the outwardly facing surface including a base portion extending from a heel region to a forefoot region of the article of footwear;

the outwardly facing surface of the sole member including a plurality of recessed portions that define a portion of the outwardly facing surface of the sole member to provide ground traction, wherein the outwardly facing surface associated with each of the plurality of recessed portions is disposed closer to the inwardly facing surface relative to the outwardly facing surface that is associated with the base portion; and a plurality of protruding members that extend away from the outwardly facing surface of the sole member, the plurality of protruding members including a first protruding member and a second protruding member, and the first and second protruding members being upwardly moveable relative to the sole member, wherein each of the first and second protruding members is disposed adjacent to at least one of the plurality of recessed portions, the at least one of the plurality of recessed portions being a dimple that extends between the first and second protruding members.

12. The article of footwear of claim 11, wherein each of the first and second protruding members is adjacent to at least two of the plurality of recessed portions.

13. The article of footwear of claim 11, wherein the at least one of the plurality of recessed portions includes a first recessed portion adjacent to the first protruding member and a second recessed portion adjacent to the second protruding member, and wherein the first and second recessed portions have rounded inner surfaces.

14. The article of footwear of claim 11, wherein the plurality of recessed portions are arranged over the forefoot region, a midfoot region, and the heel region of the sole member.

15. The article of footwear of claim 14, wherein the plurality of recessed portions disposed in the midfoot region are more shallow than the plurality of recessed portions disposed in the heel region.

16. The article of footwear of claim 14, wherein at least some of the plurality of recessed portions disposed in the midfoot region have a greater cross-sectional area in a horizontal plane relative to at least some of the plurality of recessed portions disposed in the forefoot region.

17. The article of footwear of claim 11, wherein the sole member comprises a plurality of holes and the plurality of protruding members extend through respective ones of the plurality of holes in the sole member.

18. The article of footwear of claim 11, wherein all of the plurality of recessed portions are disposed adjacent a respective one of the plurality of protruding members.

* * * * *